US012459700B2

(12) United States Patent
Gogola et al.

(10) Patent No.: US 12,459,700 B2
(45) Date of Patent: Nov. 4, 2025

(54) CAN ENDS HAVING RE-CLOSABLE COVERS

(71) Applicant: Ardagh Metal Packaging USA Corp., Chicago, IL (US)

(72) Inventors: Michael R. Gogola, Itasca, IL (US); Rex A. Villasin, Itasca, IL (US); Peter Kim, Arlington Heights, IL (US); Alex J. Teckenbrock, Lombard, IL (US); Jonathan M. Holland, Cary, IL (US); Abhik Soanpet, Oak Park, IL (US)

(73) Assignee: Ardagh Metal Packaging USA Corp, Chicago, IL (US)

( * ) Notice: Subject to any disclaimer, the term of this patent is extended or adjusted under 35 U.S.C. 154(b) by 323 days.

(21) Appl. No.: 18/172,153

(22) Filed: Feb. 21, 2023

(65) Prior Publication Data

US 2023/0264856 A1 Aug. 24, 2023

Related U.S. Application Data

(60) Provisional application No. 63/313,460, filed on Feb. 24, 2022.

(51) Int. Cl.
*B65D 17/40* (2006.01)
*B65D 17/28* (2006.01)

(52) U.S. Cl.
CPC .. *B65D 17/4014* (2018.01); *B65D 2517/0041* (2013.01)

(58) Field of Classification Search
CPC ..... B65D 17/4014; B65D 17/4012; B65D 17/401; B65D 43/18; B65D 2517/0041; B65D 2517/004; B65D 2517/0031; B65D 2517/0014
USPC ..... 220/254.4, 254.3, 254.1, 253, 259.4, 220/259.5, 259.3, 256.1, 272, 273, 270, 220/266, 265
See application file for complete search history.

(56) References Cited

U.S. PATENT DOCUMENTS

2009/0001081 A1 1/2009 Schlattl et al.
2014/0263334 A1* 9/2014 Scott ..... B65D 51/1672 220/269

(Continued)

FOREIGN PATENT DOCUMENTS

CA 2334995 C * 11/2005 ..... B65D 17/166
WO WO-9703894 A1 * 2/1997 ..... B65D 17/165

OTHER PUBLICATIONS

European Patent Office, "Extended European Search Report," issued in connection with European Patent Application No. 23158326.1-1014, mailed on Jul. 21, 2023, 8 pages.

*Primary Examiner* — Robert J Hicks
(74) *Attorney, Agent, or Firm* — Hanley, Flight & Zimmerman, LLC

(57) ABSTRACT

An example can end includes a can end having center panel defining a pour panel and a first wall extending from the center panel. A cover defines a first opening and rotatably couples to the can end. The cover is rotatable relative to the pour panel between a first position and a second position. The opening of the cover aligns with the pour panel to allow access to the pour panel when the cover is in the first position. The opening of the cover is offset relative to the pour panel such that the opening is misaligned with the pour panel to at least one of restrict or prevent access to the pour panel when the cover is in the second position.

24 Claims, 30 Drawing Sheets

(56) References Cited

U.S. PATENT DOCUMENTS

| | | | | |
|---|---|---|---|---|
| 2022/0161964 | A1* | 5/2022 | Hundeloh | B65D 17/4012 |
| 2022/0227527 | A1* | 7/2022 | Savenok | B65D 51/243 |

* cited by examiner

CAN ENDS HAVING RE-CLOSABLE COVERS

RELATED APPLICATIONS

This application claims the benefit of Provisional Patent Application No. 63/313,460 which was filed on Feb. 24, 2022, entitled "CAN ENDS HAVING RE-CLOSABLE COVERS". U.S. Provisional Patent Application Ser. No. 63/313,460 is hereby incorporated by reference in its entirety. Priority to U.S. Provisional Patent Application Ser. No. 63/313,460 is hereby claimed.

FIELD OF THE DISCLOSURE

This disclosure relates generally to can ends and, more particularly, to can ends having re-closable covers.

BACKGROUND

Beverage cans often employ easy-open ends. Easy-open ends typically include a tear or opening panel and an attached leverage tab for pushing the opening panel into the container to open a pour opening and access contents (e.g., liquid) stored inside the container. However, once opened, easy-open ends remain permanently open and cannot be re-closed.

Figure 1:
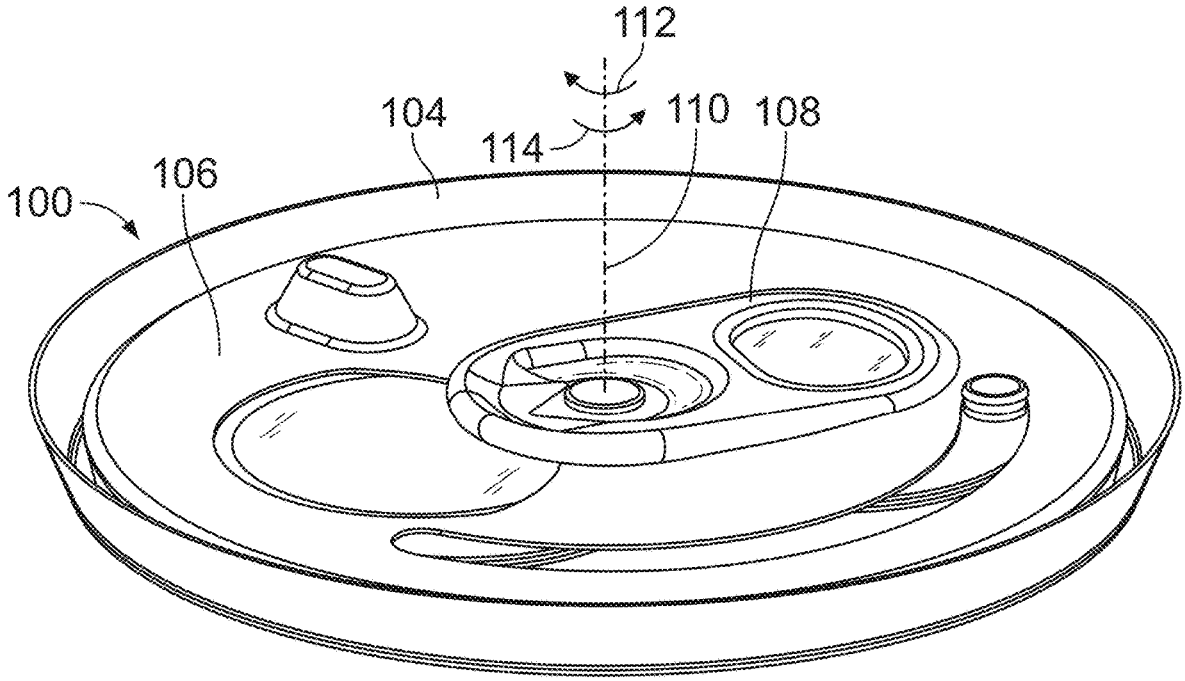
FIG. 1 is a perspective view of an example can end assembly in accordance with teachings disclosed herein.

The figures are not to scale. In general, the same reference numbers will be used throughout the drawing(s) and accompanying written description to refer to the same or like parts. As used herein, connection references (e.g., attached, coupled, connected, and joined) may include intermediate members between the elements referenced by the connection reference and/or relative movement between those elements unless otherwise indicated. As such, connection references do not necessarily infer that two elements are directly connected and/or in fixed relation to each other. As used herein, stating that any part is in "contact" with another part is defined to mean that there is no intermediate part between the two parts.

Unless specifically stated otherwise, descriptors such as "first," "second," "third," etc. are used herein without imputing or otherwise indicating any meaning of priority, physical order, arrangement in a list, and/or ordering in any way, but are merely used as labels and/or arbitrary names to distinguish elements for ease of understanding the disclosed examples. In some examples, the descriptor "first" may be used to refer to an element in the detailed description, while the same element may be referred to in a claim with a different descriptor such as "second" or "third." In such instances, it should be understood that such descriptors are used merely for identifying those elements distinctly that might, for example, otherwise share a same name. As used herein, "approximately" and "about" refer to dimensions that may not be exact due to manufacturing tolerances and/or other real world imperfections.

DETAILED DESCRIPTION

Beverage containers employ ends (e.g., easy-open ends) having pour openings through which contents can be dispensed. Beverage containers typically include a tear or opening panel and an attached leverage tab for pushing the panel into the container to expose the pour opening and access contents (e.g., liquid, a carbonated liquid, etc.) stored inside the container. The pour panel is formed in the can end via a score. To open a can end, the leverage tab displaces the pour panel of the can end. Specifically, the tab is lifted and forced against the pour panel to cause the score to rupture or sever along a length or perimeter of the score and allow the pour panel to partially detach from the can end. Accordingly, the tab displaces the pour panel to an angular orientation relative to the can end to expose the pour opening to the environment, which allows the contents in the container to be dispensed therethrough. The tab remains attached to the can end after the tab is used to open the pour panel. Such known can ends are commonly referred to as "ecology" or "stay-on-tab" (SOT) ends.

However, once the pour panel has been displaced, the pour panel cannot return to a closed or sealed position to block and/or cover (e.g., seal) the exposed pour opening. In other words, the pour panel of a beverage container is unable to return to a closed position relative to the pour opening after exposing the pour opening. As a result, the contents within the container are susceptible to spilling from the container when the container is not in an upright position. In addition, after a container of a carbonated beverage is opened, the contents therein remain exposed to air in the nearby environment, which causes the contents to quickly lose their effervescence as the entrained carbon dioxide is released from the beverage and passes into the air in the nearby environment. Accordingly, the quality of the beverage can deplete over time.

To preserve the contents within a beverage container, some beverage container ends employ a cover that can be repositioned over the pour opening after the pour opening has been initially exposed. However, these beverage containers can often be costly and/or difficult to manufacture. For instance, beverage container ends having repositionable covers often include additional parts, such as springs or elastic materials, to enable the cover to return to a closed position. Furthermore, complexities associated with operating these beverage container ends can present difficulties for consumers when opening and/or closing the container. In addition, these beverage container ends often do not prevent spillage and, instead, merely cover the pour opening of the container.

Example beverage containers disclosed herein employ re-closeable can ends. In some examples, beverage containers disclosed herein include can ends having spill-proof (e.g., watertight, airtight, gas-tight, etc.), re-closable covers that enable a pour opening of a can end to be closed after being opened (e.g., an initial opening). Additionally or alternatively, example covers of example can ends disclosed herein protect and/or preserve contents enclosed by the container. In some examples, the re-closeable can ends disclosed herein enable numerous opening and closing cycles (e.g., 5 cycles, 10 cycles, 20 cycles, etc.) without causing the cover to become damaged and/or detached from the can end. For example, example covers disclosed herein can be rotatably staked to the can end and, as a result, remain attached to the can end even after being moved (e.g., repeatedly) between open and closed positions to expose and cover (e.g., block) a pour opening of the can end. In some examples, re-closable can ends disclosed herein are made of metal (e.g., aluminum) to improve manufacturability and cost efficiency. Further, example can ends disclosed herein have moveable components that do not detach from or separate from a body (e.g., a panel) of the can ends.

Example can ends disclosed herein include a can end having a cover. In some examples, can ends disclosed herein have a dual can end configuration. For instance, an example dual can end disclosed herein is a can end assembly including a first can end (e.g., a primary can end) and a second can end (e.g., a secondary can end) rotatably coupled to the first can end. Specifically, example can ends disclosed herein include a first or a fixed can end and a second or rotatable can end or cover. In some examples, a cover (e.g., a second can end) is rotatably coupled to a can end (e.g., a first can end). Example can ends disclosed herein include a pour panel and example covers disclosed herein support or include a tab to rupture a score line of the pour panel to enable the pour panel to move relative to the can end to allow access to contents in the beverage container. In particular, an example can end (e.g. a first or primary can end) is coupled or attached to a container or a can body to seal contents within the container, and an example cover (e.g. a second or secondary can end) is rotatably coupled to the can end to provide a cover for a pour opening after the pour panel is ruptured.

Example covers disclosed herein are movable or rotatable (e.g., relative to a pour panel or pour opening) between a first or closed position to block a pour opening and a second or open position to expose the pour opening. In particular, when an example cover disclosed herein is in a first or closed position, the example cover covers or shields a pour opening of a can end to prevent or restrict access to the pour opening and/or spillage of contents from a container coupled to the can end. In some examples, a seal (e.g., a leak-proof seal, a gas-tight seal, etc.) is provided between the cover and the can end to prevent fluid (e.g., liquid) in the container from passing through the pour opening when the cover is in the closed position (e.g., positioned over the pour opening). Example seals disclosed herein can be a thin material attached to a bottom or non-exposed surface of the cover oriented toward the can end. Example seals disclosed herein can be thin materials composed of rubber or other materials and can be attached or sprayed onto a surface of the cover or the can end.

In some examples, example can end assemblies disclosed herein employ a can end, a cover, and a tab. In some examples, the cover is positioned between the tab and the can end. In some examples, the tab is staked to the can end via a rivet extending through an opening of the cover. In some examples, an example tab can be staked or clinched to the can end, but the cover is free to rotate. Thus, in some such examples where the tab is clinched to the can end, the cover can rotate (e.g., freely) relative to the can end and/or the tab between a first rotational direction (e.g., a clockwise or counterclockwise direction) and a second rotational direction (e.g., a clockwise or counterclockwise direction). In some examples, an example tab can be rotatably coupled to an example can end via an example rivet such that the tab can rotate relative to the can end and/or the cover. In some such examples, where the tab is rotatably coupled to the can end, the cover can rotate relative to the can end and/or the tab and the tab can rotate relative to the cover and/or the can end between a first rotational direction (e.g., a clockwise or counterclockwise direction) and a second rotational direction (e.g., a clockwise or counterclockwise direction). Alternatively, in some examples, an example tab disclosed herein can be coupled to (e.g., interlocked with or fixed to) an example cover, which the example cover and tab assembly is then staked to an example can end. In some such examples where the tab is interlocked with the cover, the tab and the cover rotate together (e.g., as a unitary structure) relative to the can end between a first rotational direction (e.g., a clockwise or counterclockwise direction) and a second rotational direction (e.g., a clockwise or counterclockwise direction).

Some example can end assemblies disclosed herein can include features that provide feedback when an example cover is in a closed position and/or an opened position. For example, the feedback can be a tactile feedback, an audible feedback and/or any other type of feedback. In some examples, an example can end and/or an example cover can include a bead or projection and the other one of the can end or the cover can include a recess or arcuate surface such that the bead or projection is accepted by the recess or arcuate surface when the cover is in a closed position and/or an open position relative to the can end. In some examples, an example cover disclosed herein can include a down panel adjacent a peripheral edge of the cover that engages a score line of the can end to provide tactile feedback and/or increase a frictional force to provide the tactile feedback.

Example can ends disclosed herein can be configured to accommodate can end sizes including, but not limited to, 202 size can ends (e.g., having larger opening ends (LOE)), 204 size can ends (5.715 cm), 206 size can ends (6.033 cm), 207.5 size can ends (6.271 cm), 209 size can ends (6.509 cm) and/or any other size can ends.

FIG. 1 is a perspective view of an example can end assembly 100 (e.g., a beverage can end) in accordance with teachings disclosed herein. The can end assembly 100 of the illustrated example couples to a beverage container or can body (e.g., an example can body 502 of FIG. 5B) that holds contents (e.g., carbonated liquid, non-carbonated liquid, alcohol, etc.). The can end assembly 100 of the illustrated example includes a multi-piece can end assembly. For instance, the can end assembly 100 of the illustrated example includes a can end 104 (e.g., a first can end or a lower shell), a cover 106 (e.g. a second can end or an upper shell) and a tab 108. Additionally, the can end assembly 100 of the illustrated example provides a dual-function can end assembly. For example, the can end assembly 100 of the illustrated example encloses or seals the contents in the container, and the cover 106 prevents or restricts access to (e.g., seal) the contents inside the container after the can end assembly 100 has been opened. As described in greater detail below, the cover 106 is rotatably coupled to the can end 104. Specifically, the cover 106 of the illustrated example rotates relative to the can end 104 about a longitudinal or rotational axis 110 of the can end assembly 100. For example, the cover 106 of the illustrated example rotates in a first rotational direction 112 (e.g., a clockwise direction in the orientation of FIG. 1) about the rotational axis 110 and a second rotational direction 114 (e.g., a counterclockwise direction in the orientation of FIG. 1) about the rotational axis 110 opposite the first rotational direction. In the illustrated example, the cover 106 rotates (e.g., only) around a portion of a circumference or perimeter of the can end 104 (e.g., between approximately 45 degrees and 180 degrees).

Figure 2A:
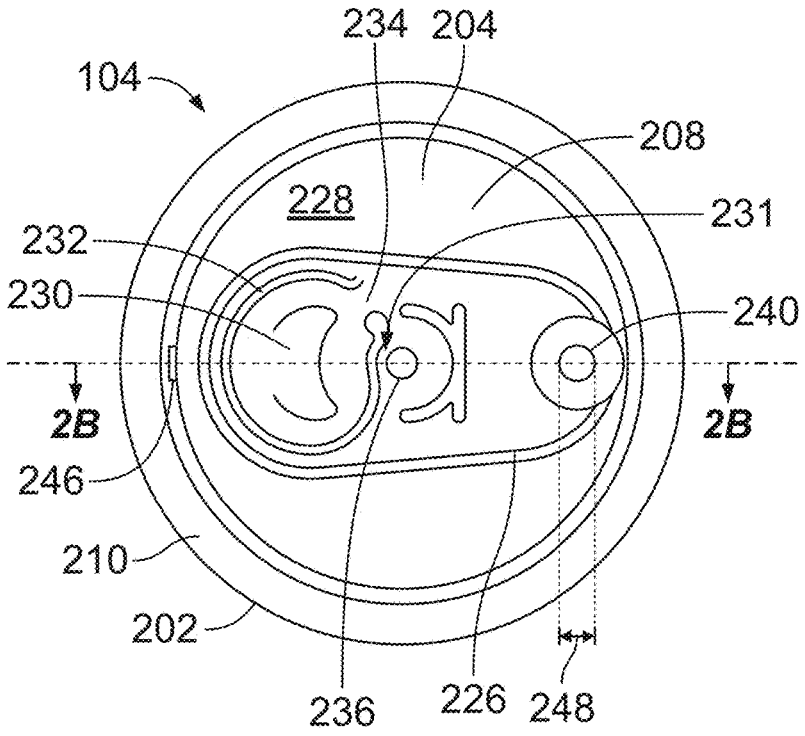
FIG. 2A is a top view of an example can end of the example can end assembly of FIG. 1.
Figure 2B:
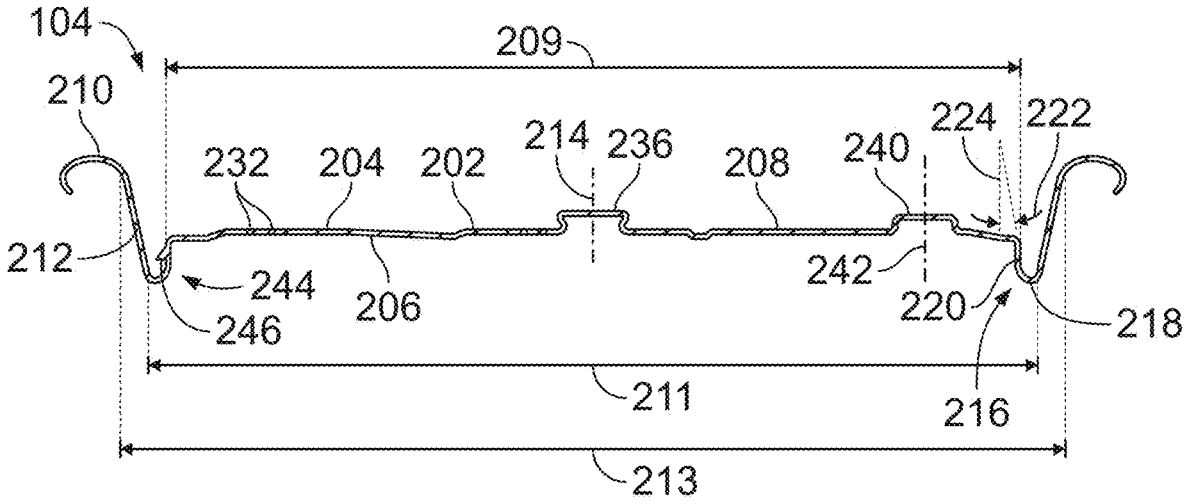
FIG. 2B is a cross-sectional view of the example can end taken along line 2-2 of FIG. 2A.

FIG. 2A is a top view of the can end 104 of FIG. 1. FIG. 2B is a cross-sectional view of the can end 104 of FIG. 2A taken along line 2-2. Referring to FIGS. 2A-2B, the can end 104 of the illustrated example is a cylindrical body 202 defining a first side 204 (e.g., an outer or top side) and a second side 206 (e.g., an inner or bottom side) opposite the first side 204. The can end 104 of the illustrated example has a center panel 208 separated from a seaming curl 210 by a circumferential wall 212. The center panel 208 of the illustrated example has a diameter 209. The circumferential wall 212 is an angled relative to vertical and has an inner diameter 211 and an outer diameter 213. The seaming curl 210 of the illustrated example defines an outer perimeter or diameter of the can end assembly 100 (e.g., a 202 size can end). The seaming curl 210 of the illustrated example is generally centered about a central or longitudinal axis 214 (e.g., a vertical axis) of the can end 104.

The circumferential wall 212 of the illustrated example extends (e.g., downward) from the seaming curl 210 to a strengthening member 216 (e.g., a bend) that is joined to (e.g., integral with) the center panel 208. In particular, the strengthening member 216 of the illustrated example includes a countersink 218 and a panel wall 220 that couple the circumferential wall 212 and the center panel 208. The panel wall 220 of the illustrated example has an angle 222 (e.g., a positive angle) relative to vertical 224. The can end 104 of the illustrated example couples to a container (e.g., the can body 502 of FIG. 5B) via the seaming curl 210.

The center panel 208 of the illustrated example includes a deboss panel 226. The deboss panel 226 of the illustrated example is recessed relative to a surface 228 (e.g., an upper or outer surface) of the center panel 208. To provide a pour opening, the can end 104 of the illustrated example includes a pour panel 230. The deboss panel 226 of the illustrated example circumscribes the pour panel 230 and a vent area 231. The deboss panel 226 of the illustrated example increases a relative stiffness of the pour panel 230 to improve openability of the pour panel 230. In some examples, the can end 104 can be implemented with the example tab 108 and may not include the deboss panel 226.

The pour panel 230 of the illustrated example is defined by a frangible score 232 (e.g., a score line) and a non-frangible hinge 234. The pour panel 230 of the illustrated example may be severed from the center panel 208 via the frangible score 232 and displaced at an angular orientation relative to the center panel 208 while the pour panel 230 remains connected to the center panel 208 via the non-frangible hinge 234. Displacing the pour panel 230 relative to the center panel 208 provides a pour opening of the can end 104. The vent area 231 ruptures via the frangible score line when the tab 108 is lifted in a direction away from the center panel 208.

Additionally, to secure the tab 108 (FIG. 1) to the can end 104, the can end 104 of the illustrated example employs a rivet 236 (e.g., a central rivet). The rivet 236 of the illustrated example extends or protrudes from the center panel 208 along the longitudinal axis 214 in a direction away from the center panel 208. The rivet 236 of the illustrated example is centrally located about the longitudinal axis 214 of the can end 104. In other words, the rivet 236 is coaxially aligned with the longitudinal axis 214 of the can end 104.

To guide a rotational movement of the cover 106 relative to the can end 104, the can end 104 of the illustrated example includes a guide pin 240 (e.g., a second or offset rivet). The guide pin 240 protrudes from the center panel 208 (e.g., the deboss panel 226) along a longitudinal axis 242 in a direction away from the center panel 208. The guide pin 240 (e.g., the longitudinal axis 242) of the illustrated example is parallel relative to the rivet 236 (e.g., the longitudinal axis 214). In other words, the longitudinal axis 214 of the rivet 236 is laterally offset relative to the longitudinal axis 242 of the guide pin 240. The guide pin 240 of the illustrated example is fixed to the can end 104 or center panel 208 (e.g., the guide pin 240 does not move relative to the center panel 208). The guide pin 240 of the illustrated example is cylindrical body having a diameter 248. However, in some examples, the guide pin 240 can have a square shape, an arcuate shape and/or any other shape.

Additionally, to guide or retain the cover 106 relative to the can end 104, the can end 104 of the illustrated example includes a retainer 244. The retainer 244 of the illustrated example is a protrusion 246. Specifically, the protrusion 246 extends away from the panel wall 220 in a direction non-parallel (e.g. perpendicular) relative to the longitudinal axis 214 and/or the center panel 208. In other words, the protrusion 246 extends from (e.g., a side surface) of the panel wall 220 in a direction toward the circumferential wall 212. As described in greater detail below, the guide pin 240 and the retainer 244 engage the cover 106 when the cover 106 is coupled to the can end 104.

Figure 3A:
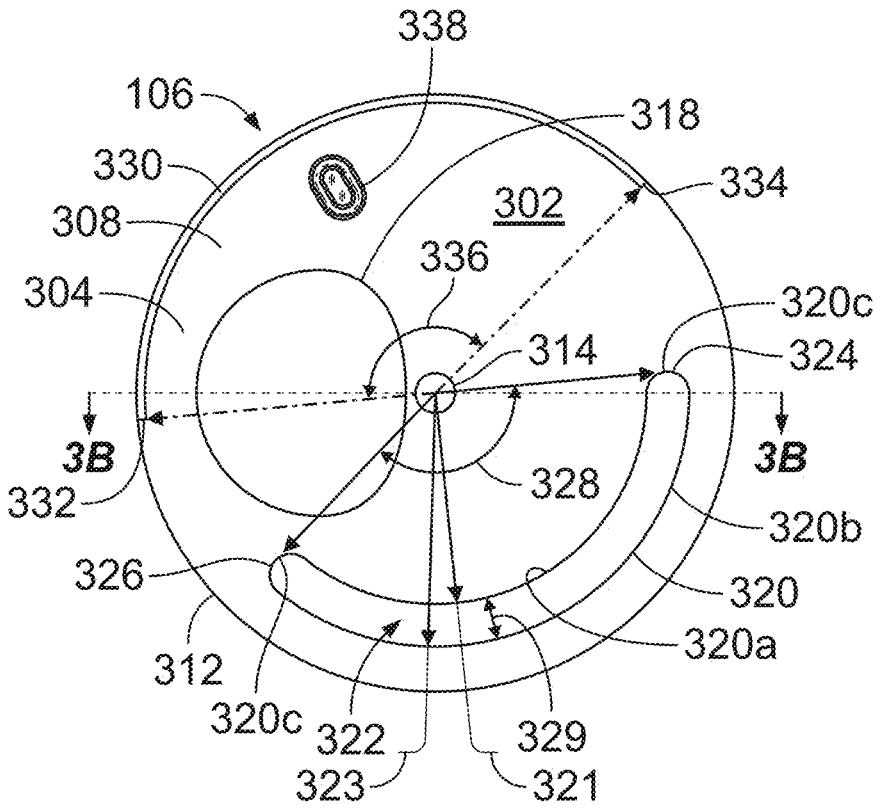
FIG. 3A is a top view of an example cover of the example can end assembly of FIG. 1.
Figure 3B:
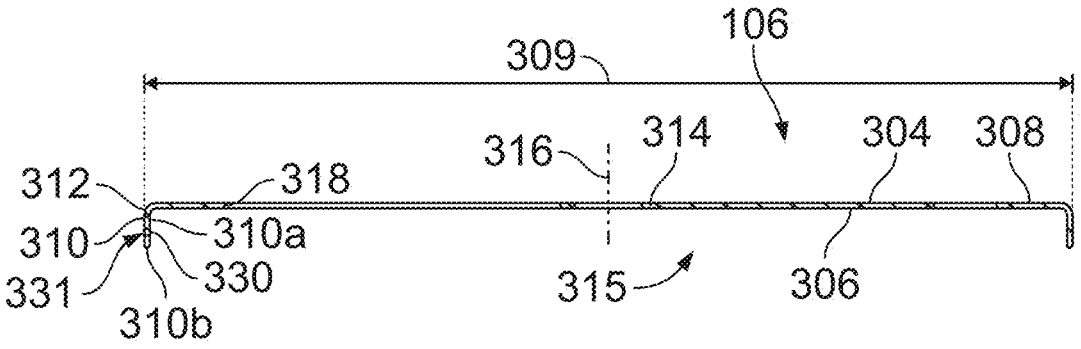
FIG. 3B is a cross-sectional view of the example cover taken along line 3-3 of FIG. 3A.

FIG. 3A is a top view of the example cover 106 of FIG. 1. FIG. 3B is a cross-sectional view of the example cover 106 taken along line 3-3 of FIG. 3A. Referring to FIGS. 3A and 3B, the cover 106 is a body 302 (e.g., a cylindrical body) defining a first side 304 (e.g., an outer or top side) and a second side 306 (e.g., an inner or bottom side) opposite the first side 304. The body 302 defines an upper wall 308 and a side wall 310. Specifically, the side wall 310 extends from a peripheral edge 312 (e.g., an outermost peripheral or outer edge) of the upper wall 308 in a direction away from the upper wall 308 (e.g., in a downwardly direction in the orientation of FIG. 3B). The side wall 310 extends substantially perpendicular (e.g., within 5% of perpendicular) relative to the upper wall 308. For example, the body 302 has a U-shaped cross-sectional shape. Thus, the body 302 defines a cavity 315 at the second side 306 of the body 302. The cover 106 (e.g., the upper wall 308) of the illustrated example has a diameter 309, which is greater than the diameter 209 of the center panel 208 and less than the inner diameter 211 of the circumferential wall 212 of FIG. 2B).

To receive or enable the rivet 236 of the can end 104 to pass through the cover 106, the cover 106 of the illustrated example includes a first or rivet opening 314. The rivet opening 314 is centrally located relative to the body 302 and is coaxially aligned with a central or longitudinal axis 316 of the cover 106. The rivet opening 314 of the illustrated example has a circular shape.

The cover 106 of the illustrated example includes a second or access opening 318. The access opening 318 is positioned adjacent to and spaced from the rivet opening 314. The access opening 318 of the illustrated example extends completely through the first side 304 and the second side 306 of the body 302. The access opening 318 enables access to the pour panel 230 (FIG. 2A) when the cover 106 is rotated to a position at which the access opening 318 is in alignment with the pour panel 230. In the illustrated example, the access opening 318 extends (e.g., completely) through the first side 304 and the second side 306 of the body 302 and has a shape that is complementary to a shape of the pour panel 230. In other words, the access opening 318 has an oblong shape.

To enable rotation of the cover 106 relative to the can end 104, the cover 106 of the illustrated example includes a guide track 320 (e.g., a third opening, a slot, etc.). In the illustrated example, the guide track 320 is positioned adjacent the peripheral edge 312 (e.g., an outermost peripheral edge) of the cover 106. Specifically, the guide track 320 is positioned between the peripheral edge 312 and the access opening 318. The guide track 320 of the illustrated example defines a gap or guide slot 322 between a first end 324 and a second end 326 opposite the first end 324. The guide slot 322 of the illustrated example extends (e.g., completely) through the first side 304 and the second side 306 of the body 302. Additionally, in the orientation of FIG. 3A, the guide track 320 of the illustrated example has an arcuate shape. For example, the guide track 320 of the illustrated example includes a first guide edge 320*a* having an arcuate shape and a second guide edge 320*b*, where respective ends of the first guide edge 320*a* and the second guide edge 320*b* are joined by arcuate ends 320*c*. In the illustrated example, the first guide edge 320*a* has a first radius of curvature 321 or arcuate length and the second guide edge 320*b* has a second radius of curvature 323 or arcuate length that is greater than the first radius of curvature 321 or arcuate length. In the illustrated example, an angle 328 between the first end 324 and the second end 326 of the guide track 320 is approximately between 45 degrees and 270 degrees (e.g., 180 degrees). Thus, an arcuate length and/or arcuate shape of the guide track 320 between the first end 324 and the second end 326 defines a rotational pathway of the cover 106 relative to the can end 104. In other words, the first end 324 of the guide track 320 defines a first travel limit and the second end 326 defines a second travel limit. The guide track 320 of the illustrated example is sized or configured to receive the guide pin 240 (FIG. 2A) of the can end 104. For example, a thickness 329 of the guide track 320 is similar to (e.g., slightly larger than) the diameter 248 of the guide pin 240. In other words, the guide pin 240 moves or slides within the guide track 320 (e.g., between the first and second guide edges 320*a*, 320*b* defined by the guide slot 322).

The side wall 310 of the illustrated example includes a retainer slot 330. The retainer slot 330 of the illustrated example defines a retainer opening 331 to receive (e.g., slidably receive) the retainer 244 (FIG. 2A) of the can end 104. Specifically, the retainer slot 330 is formed in the side wall 310 and extends partially around a circumference or perimeter of the side wall 310. For example, in the orientation of FIG. 3A, the retainer slot 330 of the illustrated example has an arcuate shape (e.g., that follows or is complementary to the circumferential shape of the side wall 310). In the orientation of FIG. 3A, the retainer slot 330 is diametrically opposed relative to the guide track 320. For example, the retainer slot 330 forms or defines an upper side wall portion 310*a* and a lower side wall portion 310*b*. The retainer slot 330 of the illustrated example has a first end 332 and a second end 334 opposite the first end 332. For instance, the first end 332 and the second end 334 of the retainer slot 330 are spaced apart by an angle 336 (e.g., an angle of between approximately 110 degrees and 150 degrees). The first end 332 defines a first travel limit and the second end 334 defines a second travel limit. For instance, first travel limit of the guide track 320 corresponds to (e.g., works in conjunction with) the first travel limit of the retainer slot 330 to limit a rotational position of the cover 106 relative to the can end 104 in a first rotational direction, and the second travel limit of the guide track 320 corresponds to (e.g., works in conjunction with) the second travel limit of the retainer slot 330 to limit a rotational position of the cover 106 relative to the can end 104 in a second rotational direction opposite the first rotational direction.

To facilitate rotation of the cover 106 relative to the can end 104, the cover 106 of the illustrated example includes a knob or grip 338. The grip 338 of the illustrated example protrudes from the upper wall 308 of the cover 106 in a direction away from the upper wall 308. In the illustrated example, the grip 338 is positioned between the retainer slot 330 and the access opening 318. In other words, the grip 338 is provided within a circumferential boundary defined by the retainer slot 330.

Figure 4A:
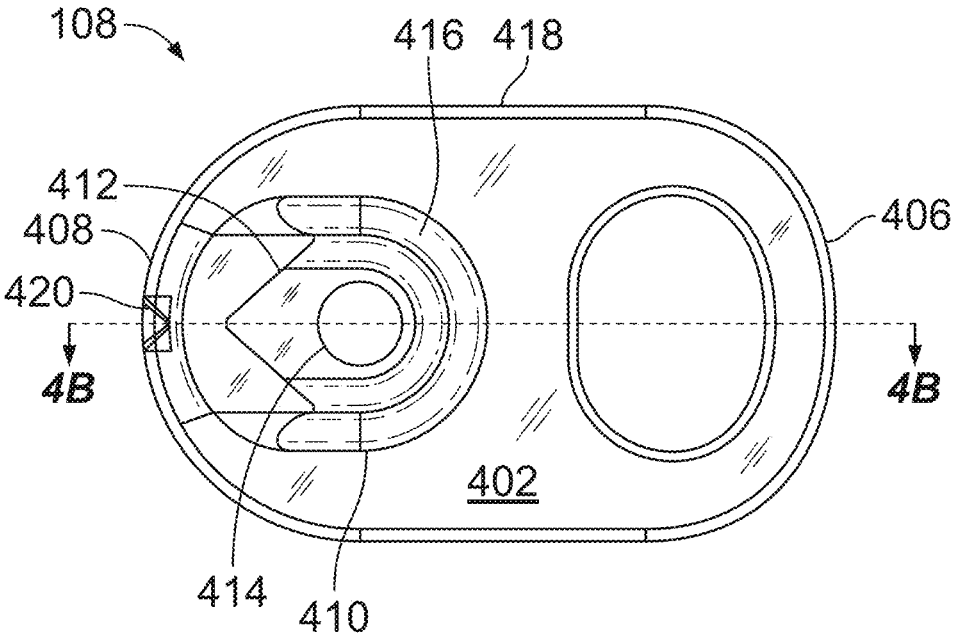
FIG. 4A is a top view of an example tab of the example can end assembly of FIG. 1.
Figure 4B:
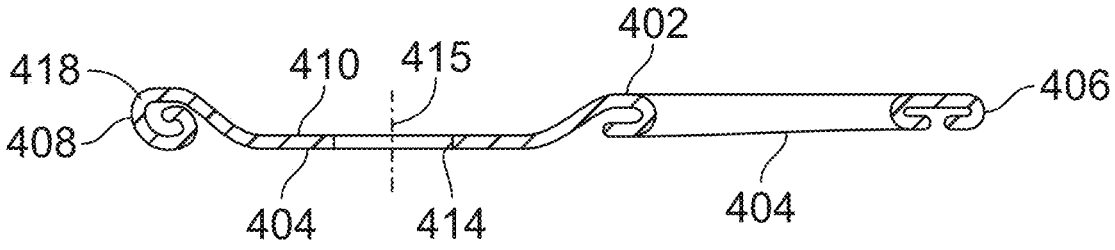
FIG. 4B is a cross-sectional view of the example cover taken along line 4-4 of FIG. 4A.

FIG. 4A is a top view of the tab 108 of FIG. 1. FIG. 4B is a cross-sectional view of the tab 108 taken along line 4-4 of FIG. 4A. Referring to FIGS. 4A and 4B, the tab 108 of the illustrated example includes a first side 402 and a second side 404 opposite the first side 402. The tab 108 of the illustrated example defines a length between a lift end 406 and a nose 408. The tab 108 of the illustrated example includes a central webbing 410 located between the lift end 406 and the nose 408. The central webbing 410 of the illustrated example includes a rivet island 412 (e.g., a hinge region) that includes an opening 414 to receive the rivet 236 (FIGS. 1A and 1B). The opening 414 defines a longitudinal axis 415. The central webbing 410 of the illustrated example includes an opening or void region 416. The void region 416 of the illustrated example has a curvilinear geometry that boarders the rivet island 412 and at least partially surrounds the rivet 236. To strengthen the tab 108 and/or hide any sharp edges, the tab 108 of the illustrated example has a curled portion 418 (e.g., having a radius of curvature) about its perimeter. The curled portion 418 extends generally about an entire perimeter of the tab 108 with one or more slit portions to accommodate rounded contours of the tab 108 and avoid wrinkling of metal of the tab 108. In some examples, the curled portion 418 is formed by rolling downwardly metal from the tab 108. Additionally, to enhance openability of the can end 104, the tab 108 of the illustrated example can include one or more cleats 420. However, in other examples, the tab 108 does not include the cleats 420.

Figure 5A:
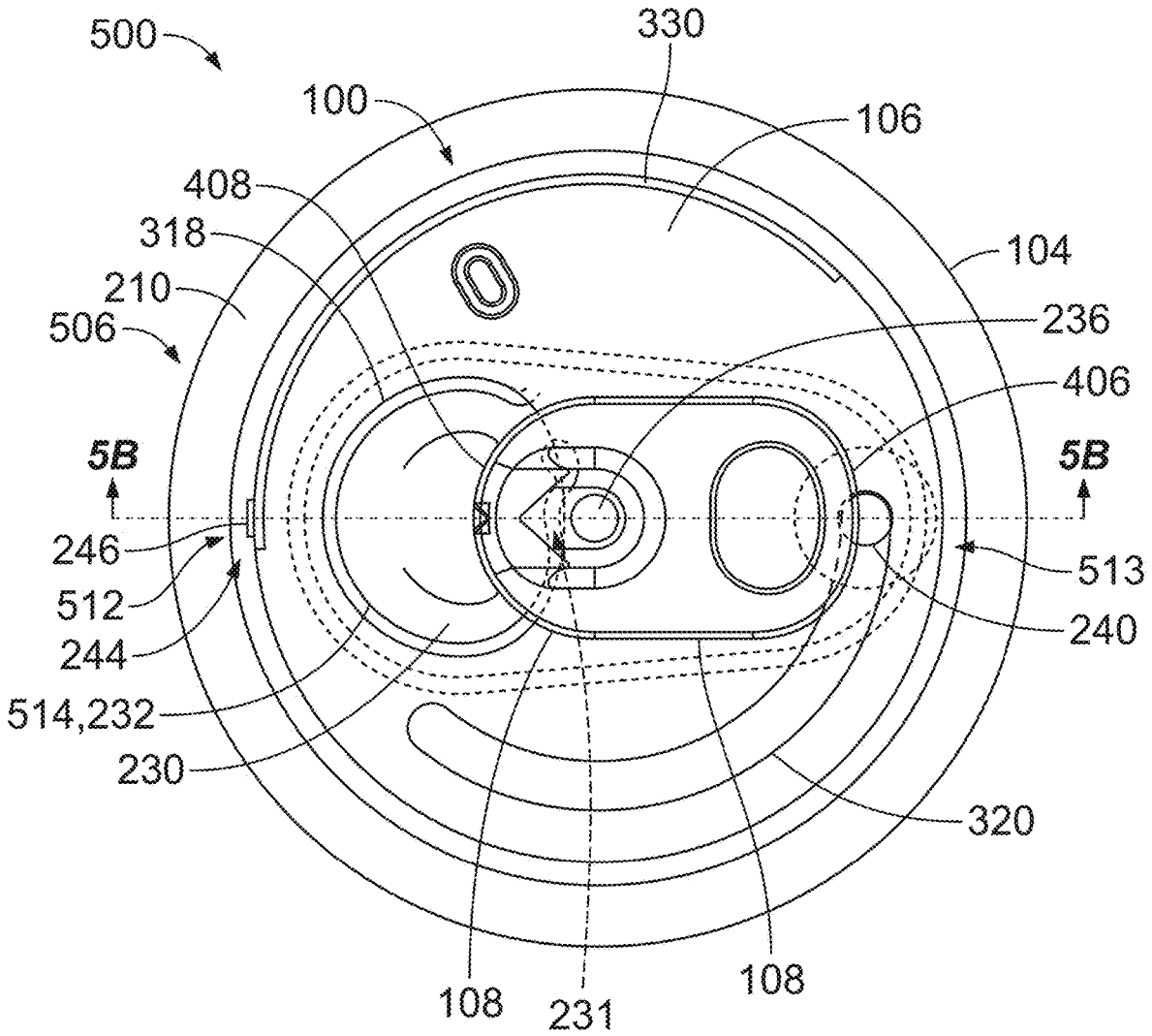
FIG. 5A is a top view of the example can end assembly of FIG. 1.
Figure 5B:
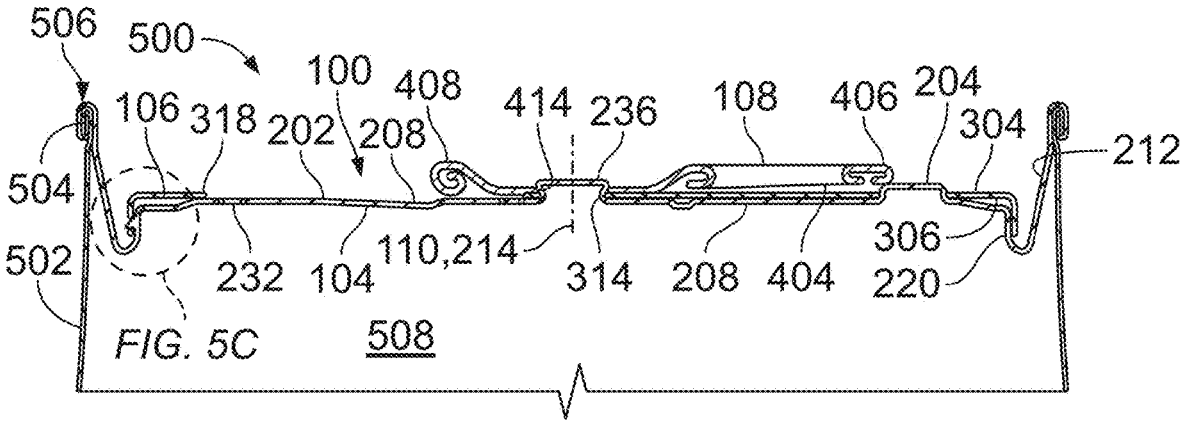
FIG. 5B is a cross-sectional view of the example can end assembly taken along line 5-5 of FIG. 5A.
Figure 5C:
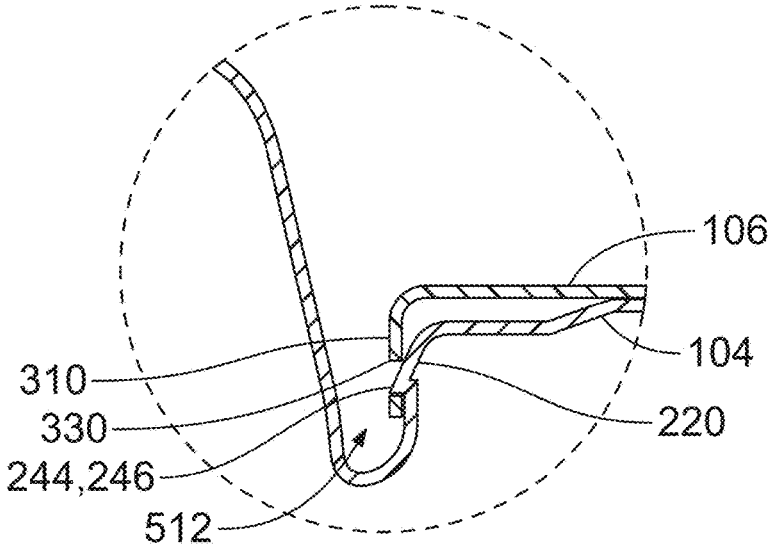
FIG. 5C is a partial, enlarged view of the example can end assembly of FIG. 5B.
Figure 5D:
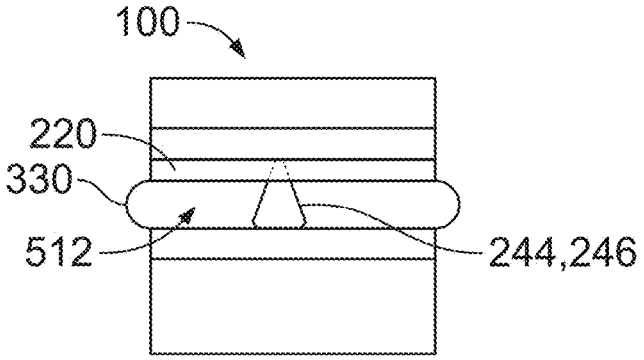
FIG. 5D is a partial, front view of the example can end assembly of FIG. 5A.

FIG. 5A is a top view of an example can 500 disclosed herein. FIG. 5B is a cross-sectional view taken along line 5-5 of FIG. 5A. FIG. 5C is an enlarged view of a portion of the example can end of FIG. 5B. FIG. 5D is a partial, front view of the example can 500 of FIG. 5A.

Referring to FIGS. 5A-5D, the can 500 of the illustrated example includes a container or can body 502 and the can end assembly 100 of FIG. 1 coupled to the can body 502. For example, after formation, the can end assembly 100 is coupled to the can body 502 via the seaming curl 210 (e.g., to enclose contents disposed in the can body 502). In particular, to couple the can end assembly 100 and the can body 502, the seaming curl 210 of the can end 104 and an end 504 (e.g., a neck) of the can body 502 are attached to form a double seam 506. The seaming curl 210 of the can end 104 is curled or folded over the end 504 of the can body 502 via a seaming operation (e.g., a two-step or double seaming operation) to form a double seam 506 to enclose contents (e.g., liquid, carbonated liquid, alcohol, etc.) inside a cavity 508 of the can body 502.

The cover 106 of the illustrated example is positioned on or supported by the can end 104. However, the cover 106 is positioned within the circumferential wall 212 of the can end 104. For example, the diameter 309 (FIG. 3) of the cover 106 is less than the inner diameter 211 of the circumferential wall 212 of the can end 104. Thus, the cover 106 of the can end assembly 100 does not interfere with the can body 502 and/or the can end 104 (e.g., during a seaming operation to form to the double seam 506).

Additionally, the cover 106 of the illustrated example is positioned between the can end 104 and the tab 108 (e.g., in an orientation along the longitudinal axis 214). Specifically, in the orientation of FIG. 5B, the second side 306 of the cover 106 is oriented toward the first side 204 of the can end 104, and the first side 304 of the cover 106 is oriented toward the second side 404 of the tab 108. The rivet 236 of the can end 104 of the illustrated example extends through the rivet opening 314 of the cover 106 and the opening of the tab 108. The rivet 236 stakes the tab 108 to the can end 104. In some examples, the tab 108, when staked to the can end 104, does not rotate relative to the cover 106 and/or the can end 104 about the longitudinal axis 316. In some examples, the tab 108 is coupled to the can end 104 such that the tab 108 can rotate about the longitudinal axis 316 relative to the can end 104 and/or the cover 106. In some examples, the tab 108 is formed with the cover 106 and the cover/tab assembly is coupled or staked to the can end 104, whereby the tab 108 and the cover 106 rotate together as a single piece relative the can end 104.

The cover 106 is rotatably coupled to the can end 104. The cover 106 of the illustrated example rotates about the rotational axis 110 (e.g., a central axis) of the can end assembly 100. In the illustrated example, the rotational axis 110 of the can end assembly 100 is a central axis coaxially aligned with the central or longitudinal axis 214 of the can end 104 of FIG. 2B, the longitudinal axis 316 of the cover 106 of FIG. 3B, and the longitudinal axis 415 of the tab 108 of FIG. 4B. However, in some examples, the rotational axis 110 of the can end assembly 100 and/or the longitudinal axis 316 of the rivet opening 314 can be offset or spaced from the longitudinal axis 214 of the can end 104 and/or the longitudinal axis 415 of the opening 414 of the tab 108. In other words, a rotational axis of the cover 106 can be offset relative to a center axis of the can end assembly 100. In some examples, the rivet 236 can be offset relative to the longitudinal axis 214 (FIG. 2B) of the can end 104.

The cover 106 of the illustrated example slides relative to the can end 104 when the cover 106 rotates about the rotational axis 110. For example, the side wall 310 of the cover 106 slides relative to the panel wall 220 of the can end 104 and the body 302 of the cover 106 slides relative to the center panel 208 of the can end 104. In the illustrated example, the diameter 309 (FIG. 3B) of the cover 106 is slightly larger than the diameter 209 (FIG. 2B) of the center panel 208 to enable the side wall 310 of the cover 106 to extend over the panel wall 220 of can end 104.

To guide, attach and/or define a rotational pathway of the cover 106 relative to the can end 104, the can end assembly 100 of the illustrated example includes a guide assembly 513. Specifically, the guide assembly 513 of the illustrated example includes the guide pin 240 and the guide track 320. Specifically, the guide pin 240 of the can end 104 is positioned inside the guide track 320 of the cover 106. In some examples, the guide assembly 513 attaches the cover 106 and the can end 104 and/or helps retain the cover 106 attached to the can end 104.

Additionally, referring to FIG. 5C, to retain the cover 106 and the can end 104, the can end assembly 100 of the illustrated example includes a retainer assembly 512. The retainer assembly 512 of the illustrated example includes the retainer 244 of the can end 104 and the retainer slot 330 of the cover 106. For example, the protrusion 246 of the retainer 244 of the can end 104 engages or is positioned within the retainer slot 330 of the cover 106. The protrusion 246 remains engaged with the retainer slot 330 in response to the cover 106 rotating relative to the can end 104. Referring to FIG. 5D, the retainer slot 330 of the illustrated example has a straight profile (e.g., substantially horizontal).

The tab 108 of the illustrated example is staked to the rivet 236 of the can end 104. The tab 108 can move or pivot relative to cover 106 and/or the can end 104 to rupture the vent area 231 (FIG. 2A) and displace the pour panel 230. The tab 108 of the illustrated example is positioned above the deboss panel 226 of the can end 104. The tab 108 of the illustrated example is pivotally and/or rotatably coupled to the center panel 208 via the rivet 236 (e.g., rotates about a longitudinal axis of the rivet). The tab 108 of the illustrated example at least partially extends over the pour panel 230. Thus, in response to lifting the lift end 406 of the tab 108, the tab 108 ruptures the vent area 231 and the nose 408 of the tab 108 ruptures or displaces the pour panel 230 relative to the can end 104. As shown in the illustrated example, the cover 106 does not interfere with the operation of the tab 108 and/or the nose 408 when the access opening 318 is aligned with the pour panel 230. For instance, the access opening 318 of the cover 106 is larger than at least a portion 514 of the frangible score 232 (FIG. 3A) defining the pour panel 230 such that the frangible score 232 is exposed (e.g., completely exposed) when the access opening 318 of the cover aligns with the pour panel 230 of the can end 104. In other words, the access opening 318 enables access to the pour panel 230 when the access opening 318 is aligned with the pour panel 230 as shown in FIGS. 5A and 5B.

Figure 6A:
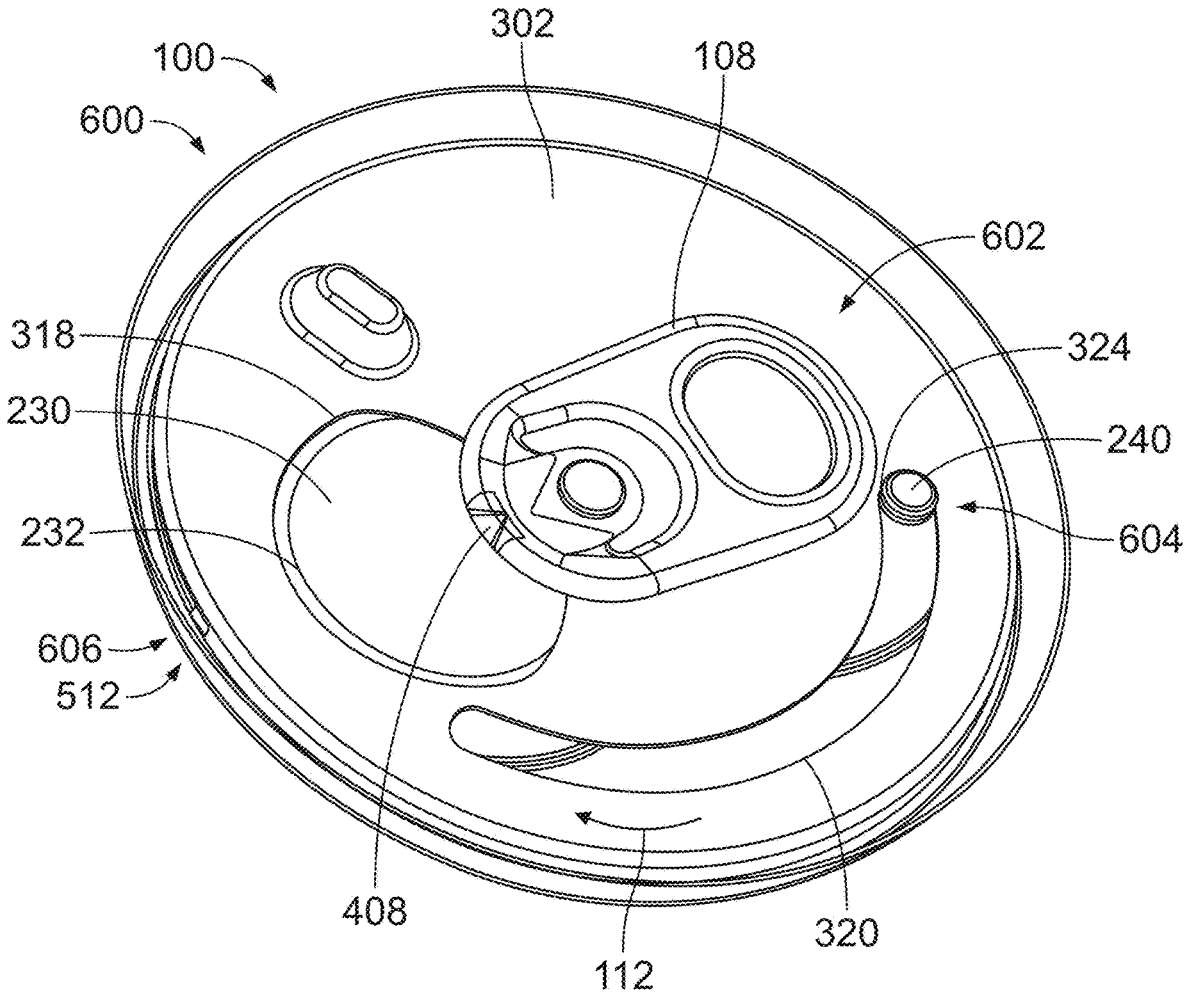
FIG. 6A is a perspective view of the can end assembly of FIG. 1 shown in a sealed condition and the example cover shown in an example first position.
Figure 6B:
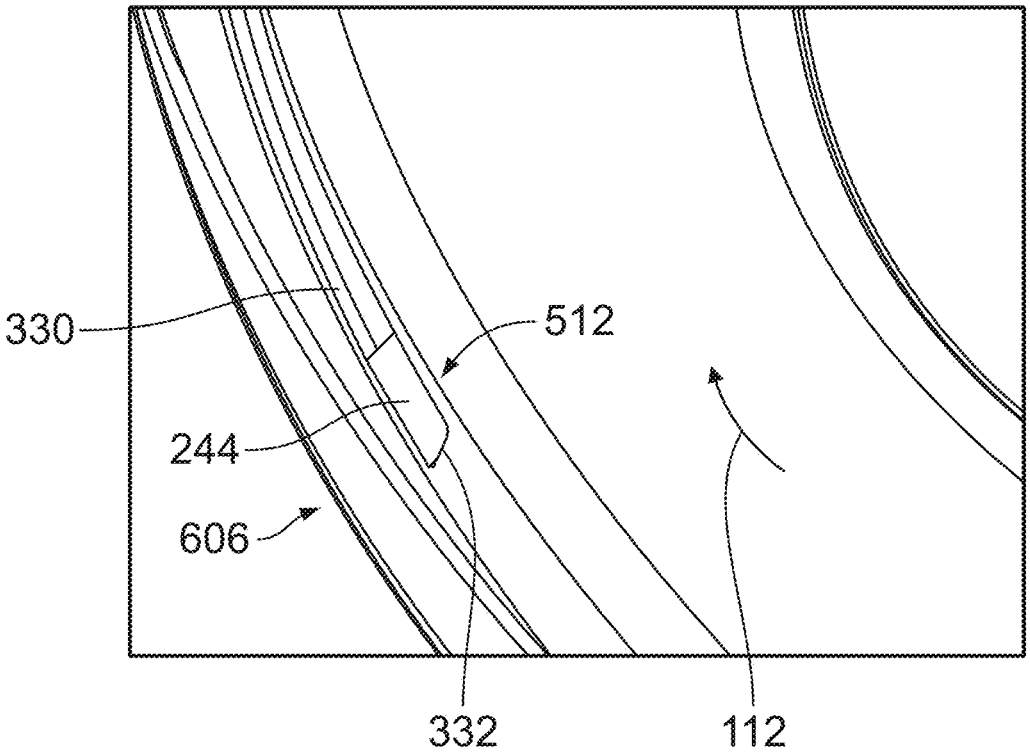
FIG. 6B is an enlarged, partial view of the example can end assembly of FIG. 6A.
Figure 6C:
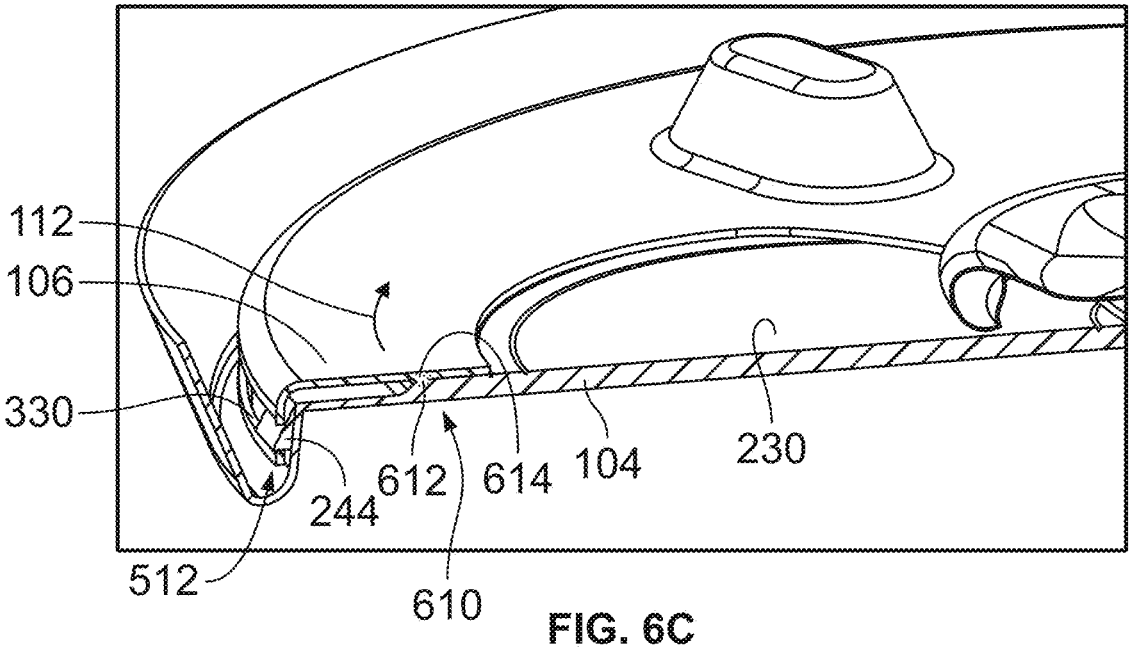
FIG. 6C is a partial, cross-sectional view of the example can end assembly of FIG. 6A.

FIG. 6A is a perspective view of the can end assembly 100 shown in a sealed condition 600. FIG. 6B is an enlarged, partial view of the can end assembly 100 of FIG. 6A. FIG. 6C is a perspective, partial cross-sectional view of the can end assembly of FIG. 6A. Referring to FIGS. 6A-6C, in the sealed condition 600, the pour panel 230 is in an unruptured state. In other words, the pour panel 230 is attached to the center panel 208 to prevent contents in the can body 502 (FIG. 5B) from escaping from within the cavity 508 (FIG. 5B). In other words, the frangible score 232 of the pour panel 230 of the illustrated example has not been ruptured. Additionally, the cover 106 of the illustrated example is shown in a first or access position 602. For example, in the access position 602, the cover 106 exposes or enables access to the pour panel 230. In this manner, the nose 408 of the tab 108 can engage the pour panel 230.

When the cover 106 is in the access position 602 shown in FIG. 6A, the guide pin 240 is in a first position 604. In the first position 604, the guide pin 240 of the can end 104 is positioned adjacent (e.g., in direct engagement or contact with) the first end 324 of the guide track 320. Additionally, referring to FIGS. 6B and 6C, the retainer assembly 512 is in a first position 606. In the first position 606, the retainer 244 of the retainer assembly 512 is positioned adjacent (e.g., in direct engagement or contact with) the first end 332 of the retainer slot 330. Thus, in the illustrated example, the guide pin 240 is positioned in engagement (e.g., direct engagement) with the first end 324 of the guide track 320 and the retainer 244 is positioned in engagement (e.g., direct engagement) with the first end 332 of the retainer slot 330 when the cover 106 is in the access position 602. Thus, the first end 324 of the guide track 320 and the first end 332 of the retainer slot 330 provide a first rotational travel limit for the cover 106 when the cover 106 rotates in the first rotational direction 112. The first travel limit corresponds to a rotational position at which the cover 106 is in the access position 602 of FIGS. 6A-6C.

In some examples, to provide feedback to a user that the cover 106 is in the access position 602 and/or a closed position, the can end assembly 100 can include a feedback feature 610. In this example, the can end 104 includes a protrusion 612 and the cover 106 includes a recess 614. The protrusion 612 projects from the center panel 208 of the can end 104 and the recess 614 is formed at the lower surface (e.g., the second side 306) of the cover 106. When the cover 106 is rotated to the access position 602, the protrusion 612 is received or engages the recess 614 to provide a feedback signal to a user. For example, the feedback signal can be a tactile feedback (e.g., a resistance, increased friction or locking feature) or an audible feedback (e.g., a click noise). In some examples, the cover 106 includes the protrusion 612 and the can end 104 includes the recess 614. In some examples, the protrusion 612 can be included on the side wall 310 (e.g., an inner surface of the side wall 310) of the cover 106 and the recess 614 can be included on the panel wall 220 of the can end 104, or vice versa. In some examples, the feedback feature (e.g., the protrusion 612 and the recess 614) can be formed with the retainer assembly 512 (e.g., with the protrusion 246 and the retainer slot 330). In some examples, the can end assembly 100 of the illustrated example can include any other feedback features and/or provided at any other location to provide tactile and/or audible feedback when the cover 106 is rotated to the access position 602 and/or a closed position (e.g., the closed position 902 of FIG. 9). For example, in some examples, the feedback features can be provided with the center panel 208 of the can end 104 and the upper wall 308 (e.g., an upper surface) of the cover 106.

Figure 7:
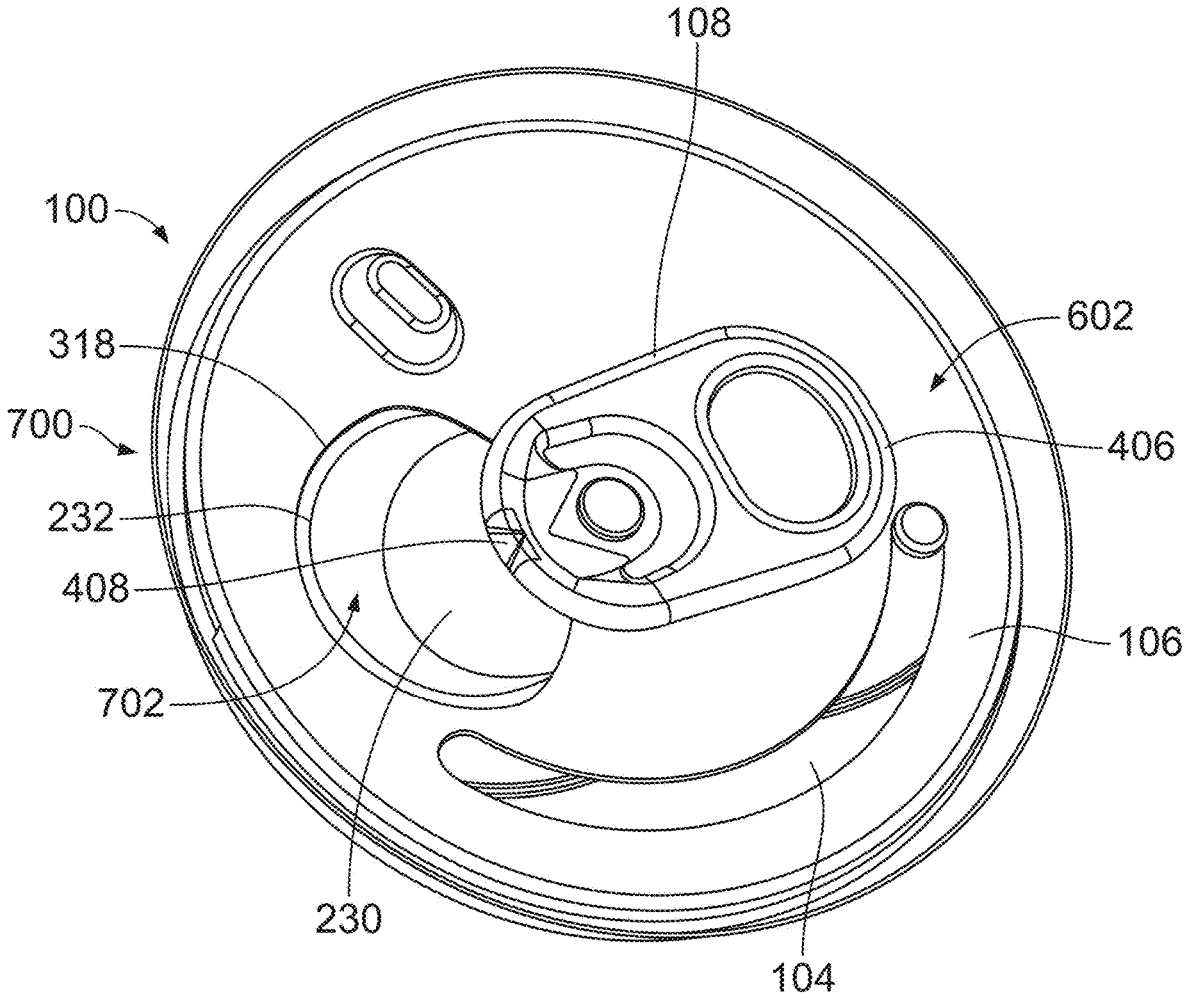
FIG. 7 is a perspective view of the can end assembly of FIG. 6A shown in an unsealed condition.

FIG. 7 is a perspective view of the can end assembly 100 of FIG. 1 shown in an unsealed condition 700 and the cover 106 shown in the access position 602. In the unsealed condition 700, the pour panel 230 is ruptured or displaced (e.g., vertically) relative to the can end 104 via the tab 108 to provide a pour opening 702 in the can end 104 and enable access to contents inside the cavity 508 of the can body 502 (FIG. 5B). For example, to enable access to the contents within the can body 502, the pour panel 230 of the illustrated example at least partially separates from the can end 104 and displaced at an angular orientation relative to the center panel 208 while another portion of the pour panel 230 remains connected to the center panel 208 via the non-frangible hinge 234 (FIG. 2A). An initial rupture of the frangible score 232 is primarily caused by a lifting force imparted to the lift end 406 of the tab 108 (e.g., via a finger of a person) resulting in lifting of a central region or the vent area 231 (FIG. 2A) of the center panel 208 immediately adjacent the rivet 236 that causes an initial separation (i.e., an initial "pop") of the residual metal of the frangible score 232. To continue the rupturing the frangible score 232 after the initial "pop" or venting of the pour panel 230, a push or opening force (e.g., a tear force) is provided by lifting the lift end 406 of the tab 108 away from the center panel 208 and/or the cover 106 to cause the nose 408 to push downwardly against the pour panel 230. As noted above, the access opening 318 provides access to the pour panel 230 and/or the pour opening 702 when the cover 106 is in the access position 602. In other words, the access opening 318 aligns with the pour panel 230 and/or the pour opening 702 when the cover 106 is in the access position 602. Additionally, during an opening or unsealing operation, the cover 106 does not interfere with the operation of the tab 108. For instance, the lift end 406 of the tab 108 lifts away from the cover 106 or can end 104 and the nose 408 can engage the pour panel 230 without interference from the cover 106. In the illustrated example, the access opening 318 is greater than a perimeter of the frangible score 232 so that the pour panel 230 and at least a portion of the frangible score 232 is exposed (e.g., visible to a user) via the access opening 318. In some examples, a raw edge on the access opening 318 of the cover 106 can be a hemmed edge or can be formed to include a bead/wipe down (e.g., a pour spout or drinking bead). In some examples, a portion of the raw edge of the access opening 318 can include a pour spout or drinking bead and a remaining portion of the raw edge can be hemmed or curled.

Figure 8A:
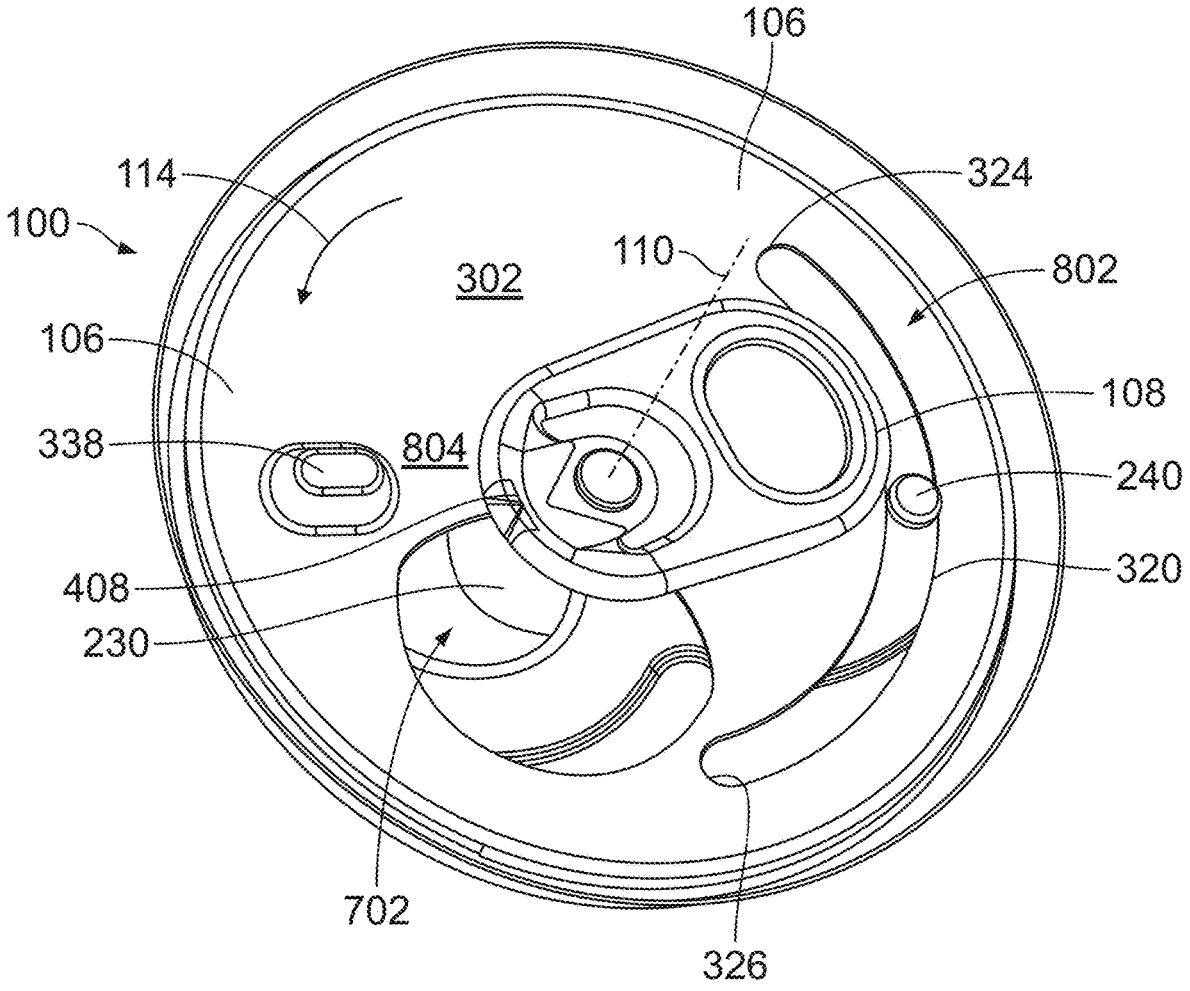
FIG. 8A is a perspective view of the can end assembly of FIG. 6A with the example cover shown in an intermediate position.
Figure 8B:
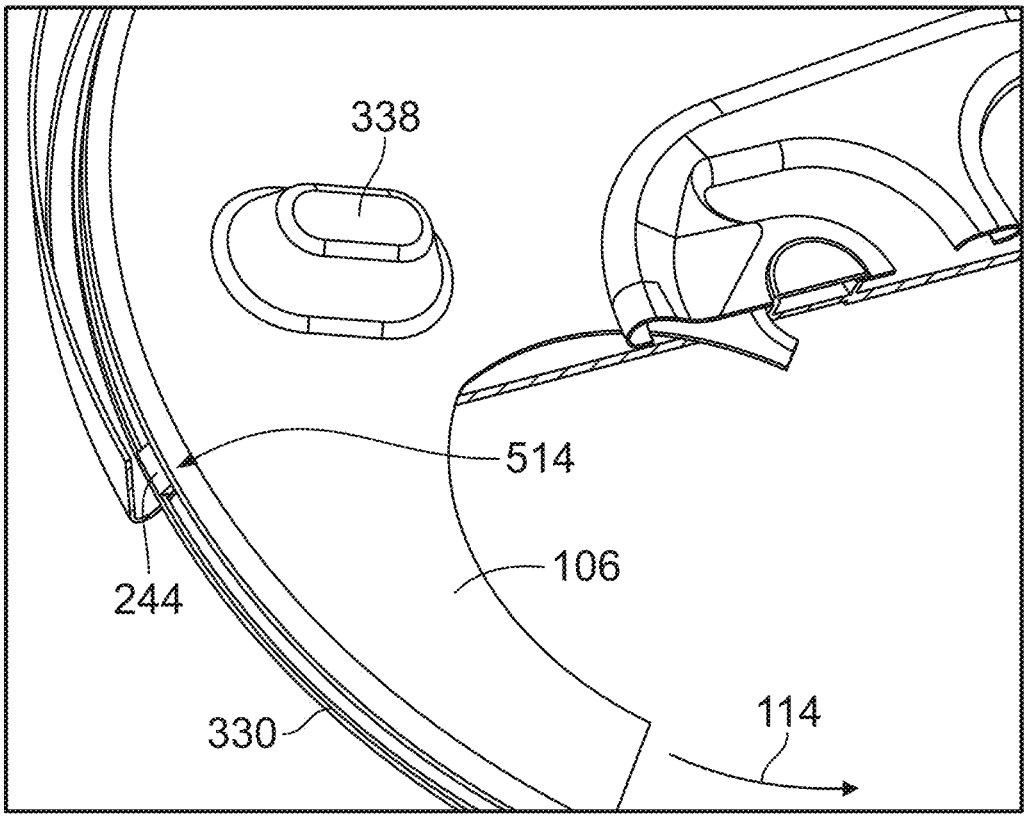
FIG. 8B is a perspective, partial cross-sectional view of the example can end assembly of FIG. 8A.

FIG. 8A is a perspective view of the can end assembly 100 of FIG. 1 with the cover 106 shown in an intermediate position 802. FIG. 8B is a perspective, partial cross-sectional view of the can end assembly 100 of FIG. 8A. The intermediate position 802 of FIG. 8 is positioned between the access position 602 of FIG. 6A and a closed position (e.g., an example blocking or closed position 902 of FIG. 9A). To rotate the cover 106 toward the intermediate position 802 from the access position 602 of FIG. 7, a user can grasp the grip 338 to rotate the cover 106 in the second rotational direction 114 about the rotational axis 110 of the can end assembly 100. In the intermediate position 802, the cover 106 (e.g., a portion 804 of the cover body 302) partially covers the pour opening 702 and/or the pour panel 230. Additionally, in the intermediate position 802, the guide pin 240 is positioned within the guide track 320 between the first end 324 and the second end 326. Similarly, referring to FIG. 8B, the retainer 244 of the retainer assembly 512 is positioned within the retainer slot 330 between the first end 332 and the second end 334. In other words, the guide pin 240 is not in direct engagement with either the first end 324 or the second end 326 of the guide track 320 and the retainer 244 is not in direct engagement with either the first end 332 or the second end 334 of the retainer slot 330 when the cover 106 is in the intermediate position 802. As shown in FIG. 8A, the guide pin 240 is fixed in position and the guide track 320 of the cover 106 moves along the guide pin 240. Additionally, the tab 108 does not interfere with the rotational movement of the cover 106 relative to the can end 104 and/or the tab 108. For example, the cover 106 of the illustrated example rotates between the second side 404 of the tab 108 (e.g., underneath the nose 408) and the first side 204 of the can end 104.

Figure 9A:
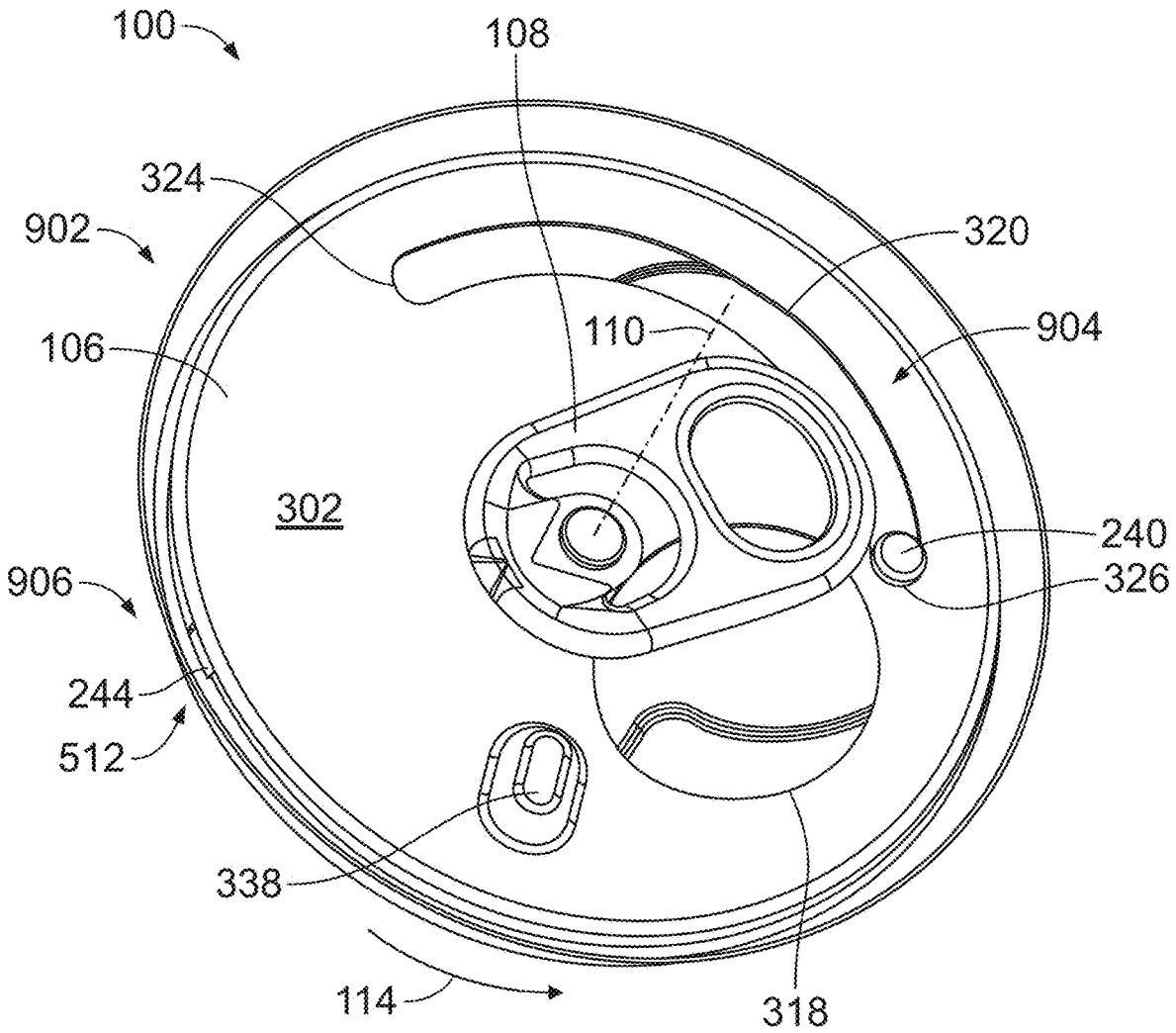
FIG. 9A a perspective view of the example can end assembly of FIG. 6A with the example cover shown in an example second position.
Figure 9B:
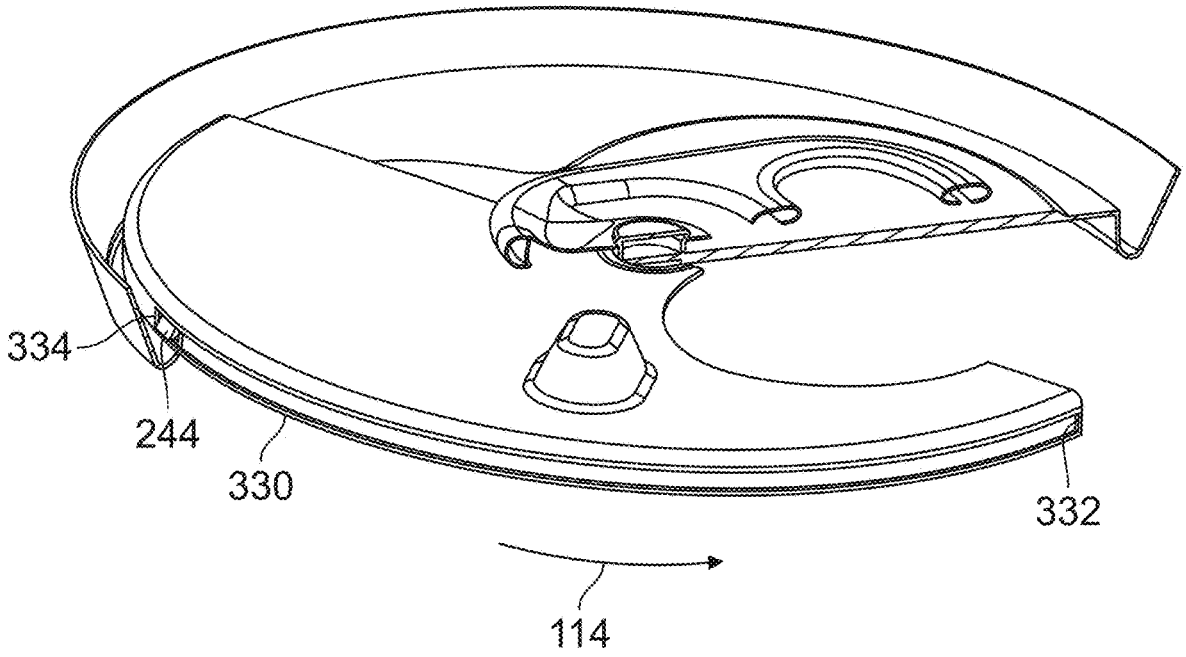
FIG. 9B is a perspective, partial cross-sectional view of the example can end assembly of FIG. 9A.
Figure 9C:
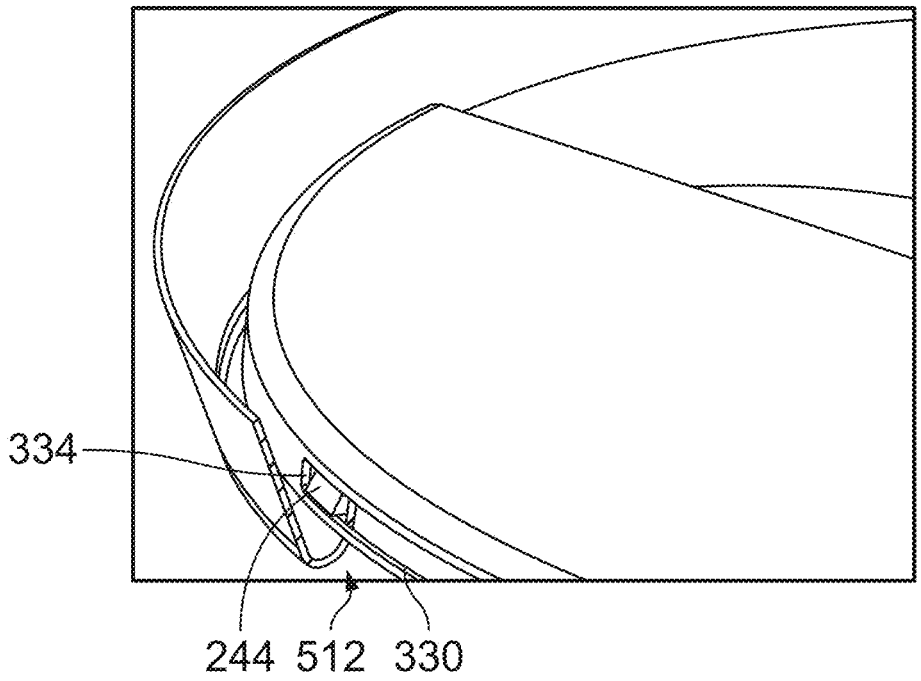
FIG. 9C is an enlarged, partial view of the example can end assembly of FIG. 9A.

FIG. 9A is a perspective view of the can end assembly 100 of FIG. 1 showing the cover 106 in a second or closed position 902 (e.g., a blocking position) when the can is in the unsealed condition 700. FIG. 9B is a perspective, partial cross-sectional view of the example can end assembly 100 of FIG. 9A. FIG. 9C is an enlarged, partial view of the example can assembly of FIGS. 9A and 9B. The cover 106 of the illustrated example is in a fully closed position.

Referring to FIGS. 9A-9C, in the closed position 902, the cover 106 prevents or restricts (e.g., blocks) access to the pour opening 702 (FIG. 7). Specifically, in the closed position 902, the access opening 318 is misaligned (e.g., laterally offset) relative the pour panel 230 and/or the pour opening 702 to at least one of restrict or prevent access the pour panel 230 or the pour opening 702 when the cover 106 is in the closed position 902. For example, in the closed position 902, the body 302 of the cover 106 is positioned over (e.g., directly above) the pour opening 702 to cover and/or obstructs access to the pour opening 702 and the contents inside the can body 502 (FIG. 5B). In some examples, in the closed position 902, the cover 106 seals the pour opening 702 and/or covers the pour opening 702 to prevent or restrict contents from within the cavity 508 of the can body 502 from escaping through the pour opening 702. For example, in the closed position 902, the body 302 of the cover 106 seals the pour opening 702 to obstruct, restrict and/or prevent spillage of contents from the can body 502 through the pour opening 702 if the can body 502 is tipped on its side or is positioned in an upside down orientation (e.g., the first side 304 of the cover 106 is oriented toward the ground). In some examples, the cover 106 prevents or restricts foreign substances, insects, etc., from entering the pour opening 702 when the cover 106 is in the closed position 902. In some examples, the second side 306 of the cover body 302 can include a seal or gasket (e.g., a rubber film, a coating, etc.) to provide a tighter seal against the can end 104 to prevent leakage of fluid through the pour opening 702 when the cover 106 is in the closed position 902.

In the closed position 902 of FIGS. 9A-9C, the guide pin 240 is in a second position 904 relative to or within the guide track 320. In the second position 904, the guide pin 240 of the can end 104 is positioned adjacent (e.g., in direct contact or engagement with) the second end 326 of the guide track 320. Additionally, the retainer assembly 512 is in a second position 906. In the second position 906, the retainer 244 of the retainer assembly 512 is positioned adjacent (e.g., in direct contact or engagement with) the second end 334 of the retainer slot 330. Thus, in the illustrated example, the guide pin 240 is positioned in engagement (e.g., directly engaged) with the second end 326 of the guide track 320 and the retainer 244 is positioned in engagement (e.g., directly engaged) with the second end 334 of the retainer slot 330 when the cover 106 is in the closed position 902. Thus, the second end 326 of the guide track 320 and the second end 334 of the retainer slot 330 provide a second rotational travel limit for the cover 106 when the cover 106 is rotated in the second rotational direction 114 about the rotational axis 110. Thus, the cover 106 of the illustrated example does not rotate 360 degrees about the rotational axis 110. Instead, the first and second travel limits set rotational limits of the cover 106 relative to the can end 104. For example, the first and second travel limits enable the cover 106 to rotate approximately between 90 degrees and 180 degrees. In some examples, the first travel limit can be spaced from the second travel limit a rotational angle relative to the longitudinal axis 316 of approximately between 30 degrees and 270 degrees to limit rotation of the cover 106 relative to the can end 104 between 30 degrees and 270 degrees. In some examples, the angle between the limits can be any angle between 10 degrees and 350 degrees. In some examples, the travel limits are not provided and the cover 106 can rotate 360 degrees relative to the can end 104.

The cover 106 of the illustrated example is a re-closeable cover that enables a pour opening 702 to be closed after being opened (e.g., an initial opening). During use, the cover 106 is rotatable between the access position 602 to allow access to the pour opening 702 and the contents within the can body 502 and the closed position 902 to prevent or restrict access to the contents within the can body 502. For example, the cover 106 is rotated in the first rotational direction 112 (e.g., via the grip 338) about the rotational axis 110 to move the cover 106 from the closed position 902 to the access position 602 to align the access opening 318 and the pour opening 702. To move the cover 106 from the access position 602 to the closed position 902 (e.g., blocking position), the cover 106 is rotated in the second rotational direction 114 (e.g., via the grip 338) about the rotational axis 110 so that the body 302 of cover 106 is positioned over the pour opening 702 to prevent, block and/or restrict access to the pour opening 702. Thus, the body 302 of the cover 106 provides a blocking body portion that prevents access to the pour panel 230 when the body 302 is rotated in alignment with the pour panel 230. In some examples, the tab 108 can be staked with the cover 106.

Thus, referring to FIGS. 6A, 7, 8A, and 9A, in operation, a user positions the cover 106 to the access position 602 if necessary by rotating the cover 106 (e.g., via the grip 338) in the first rotational direction 112 about the rotational axis 110 to position the access opening 318 of the cover 106 in alignment with the pour panel 230 of the can end 104. After the access opening 318 is aligned with the pour panel 230, a user lifts the lift end 406 of the tab 108 away from the center panel 208 of the can end 104. Due to the attachment between the rivet 236 and the tab 108, the initial lift movement of the tab 108 causes a partial tear of the center panel 208 or vent area 231 (e.g., adjacent the pour panel 230). Further lifting of the tab 108 away from the center panel 208 causes the nose 408 of the tab 108 to engage the pour panel 230 and cause the pour panel 230 to detach from the can end 104 along the frangible score 232 to provide the pour opening 702 and enable access to the cavity 508 of the can body 502. To reclose the pour opening 702, the cover 106 is rotated (e.g., via the grip 338) in the second rotational direction 114 relative to the rotational axis 110 approximately between 90 degrees and 180 degrees (e.g., 120 degrees) to move the body 302 of the cover 106 over the pour opening 702 to cover the pour opening 702 and prevent or restrict access to the contents within the cavity 508 of the can body 502. To reopen the can end 104, a user simply rotates the cover 106 in the first rotational direction 112 to realign the access opening 318 and the pour opening 702 to enable access to the contents in the cavity 508 of the can body 502.

FIGS. 10, 11A, 11B, 12A-12C, 13, 14, 15A-15C, 16A, 16B, 17A, 17B, 18, 19A and 19B illustrate other example can end assemblies disclosed herein. Many of the components of the example can end assemblies of FIGS. 10, 11A, 11B, 12A-12C, 13, 14, 15A-15C, 16A, 16B, 17A, 17B, 18, 19A and 19B are substantially similar or identical to the components described above in connection with FIGS. 1, 2A-2B, 3A-3B, 4A-4B, 5A-5C, 6A-6C, 7, 8A-8B, and 9A-9C. As such, those components will not be described in detail again below. Instead, the interested reader is referred to the above corresponding descriptions for a complete written description of the structure and operation of such components. To facilitate this process, similar or identical reference numbers will be used for like structures in FIGS. 10, 11A, 11B, 12A-12C, 13, 14, 15A-15C, 16A, 16B, 17A, 17B, 18, 19A and 19B as used in FIGS. 1, 2A-2B, 3A-3B, 4A-4B, 5A-5C, 6A-6C, 7, 8A-8B, and 9A-9C.

Figure 10:
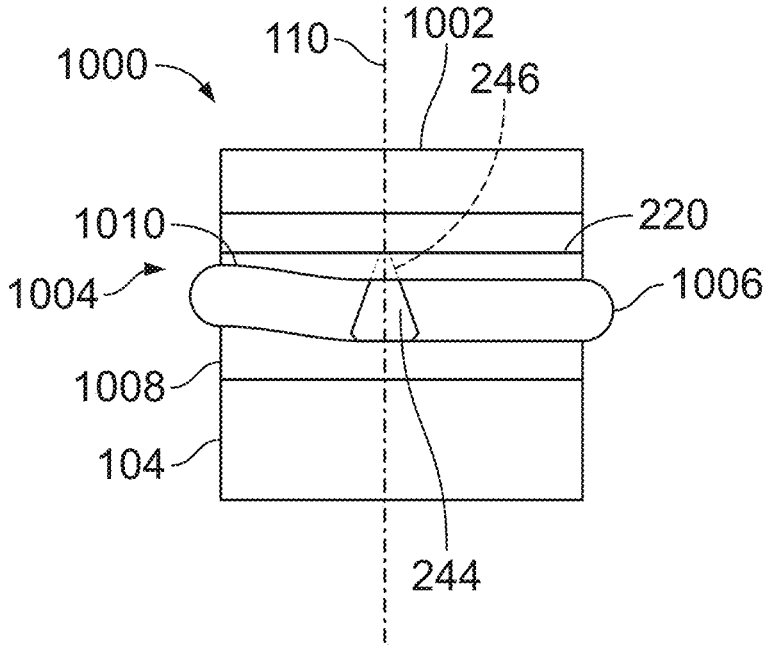
FIG. 10 is a partial front view of another example can end assembly disclosed herein.

FIG. 10 is a front view of a portion of another can end assembly 1000 disclosed herein. The can end assembly 1000 of the illustrated example includes a can end 104 and a cover 1002. In contrast with the can end assembly 100 of FIG. 1, the can end assembly 1000 of the illustrated example has an example retainer assembly 1004. Specifically, the retainer assembly 1004 of the illustrated example includes a retainer 244 and a retainer slot 1006. The retainer 244 of the illustrated example is fixed to the can end 104 (e.g., a panel wall 220) and the retainer slot 1006 is formed in a side wall 1008 (e.g., similar to the side wall 310 of FIG. 3) of the cover 1002. Additionally, at least a portion 1010 (e.g., an arcuate length, a length or section) of the retainer slot 1006 of the illustrated example has an arcuate or tapered profile. In this manner, the retainer assembly 1004 of the illustrated example draws the cover 1002 (e.g., presses the cover 1002) toward the can end 104 (e.g., a center panel 208) (e.g., downwardly in the orientation of FIG. 10). For example, as the protrusion 246 is drawn into the portion 1010 of the retainer slot 1006, the protrusion 246 causes the cover 1002 to move in a downward direction (e.g., along the rotational axis 110 or vertical direction) in the orientation of FIG. 10. Thus, when the cover 1002 is in the closed position 902, the protrusion 246 draws or pulls the cover 1002 toward the center panel 208 to seal a pour opening (e.g., the pour opening 702 of FIG. 7) of the can end 104. Drawing the cover 1002 toward the can end 104 can improve a sealing characteristic of the can end assembly 1000. In some examples, an entire length (e.g., arcuate length) of the retainer slot 1006 (e.g., between first and second travel limits) can be formed with a tapered profile.

Figure 11A:
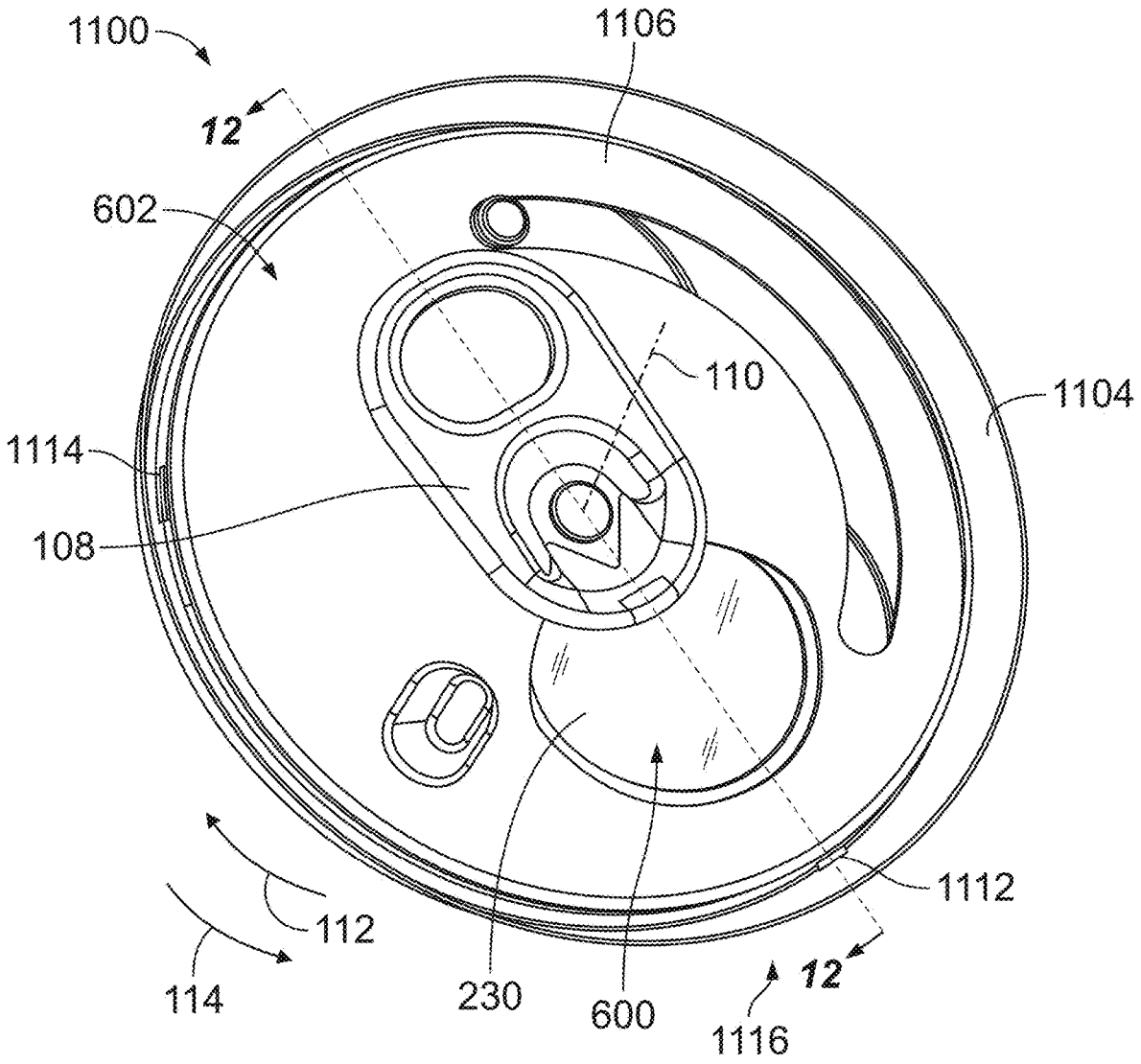
FIG. 11A is a perspective view of another example can end assembly disclosed herein. The example can end assembly is shown in an example first condition.
Figure 11B:
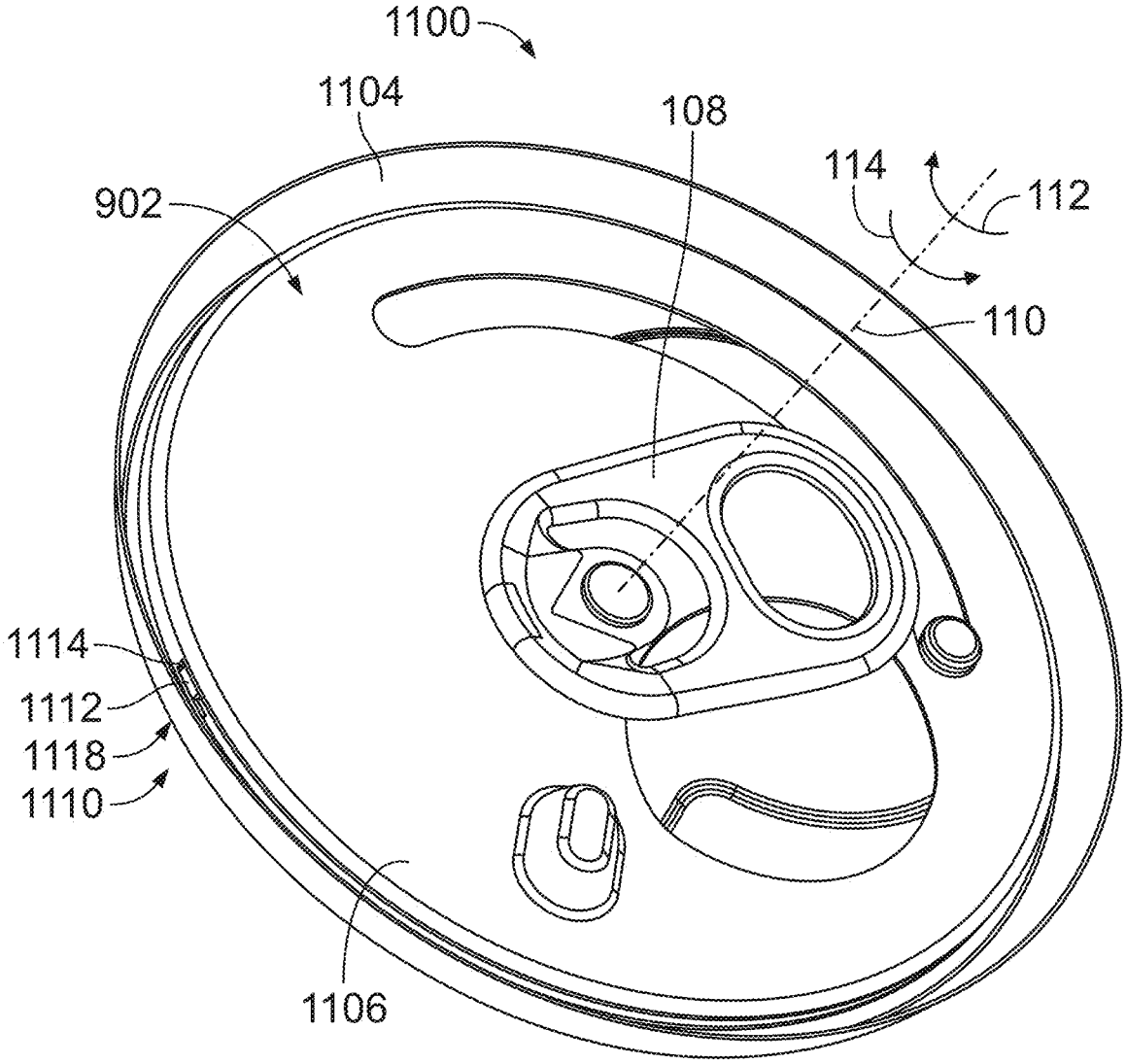
FIG. 11B is a perspective view of the example can end assembly of FIG. 11A shown in an example second condition.

FIGS. 11A and 11B are perspective views of another example can end assembly 1100 disclosed herein. The can end assembly 1100 of the illustrated example includes a can end 1104, a cover 1106 and a tab 108. In FIG. 11A, the can end assembly 1100 is shown in a sealed condition 600 and the cover 1106 is shown in an open or access position 602. In FIG. 11B, the can end assembly 1100 is shown in the sealed condition 600 and the cover 1106 is shown in a blocking or closed position 902. In other words, the cover 1106 of the illustrated example is rotatably coupled to the can end 1104. The cover 1106 of the illustrated example rotates about a rotational axis 110 in a first rotational direction 112 to move from the closed position 902 to the access position 602 and rotates about the rotational axis 110 in a second rotational direction 114 to move from the access position 602 to the closed position 902.

The can end 1104 and the cover 1106 of FIGS. 11A and 11B are substantially similar to the can end 104 and the cover 106 of FIGS. 1, 2A-2B, 3A-3B, 4A-4B, 5A-5C, 6A-6C, 7, 8A-8B, and 9A-9C. However, the can end 1104 and the cover 1106 of FIGS. 11A and 11B include a retainer assembly 1110 that is different than the retainer assembly 512. The retainer assembly 1110 of the illustrated example includes a protrusion 1112 and a retainer slot 1114. In the illustrated example, the retainer assembly 1110 is in a first position 1116 when the cover 1106 is in the access position 602 of FIG. 11A. Specifically, the protrusion 1112 of the retainer assembly 1110 is spaced or disengaged from the retainer slot 1114 when the retainer assembly 1110 is in the first position 1116 (e.g., the cover 1106 is in the access position 602 (FIG. 11A)). In the illustrated example, the retainer assembly 1110 is in a second position 1118 when the cover 1106 is in the closed position 902 of FIG. 11B. Specifically, the protrusion 1112 of the retainer assembly 1110 is engaged with the retainer slot 1114 when the retainer assembly is in the second position 1118 (e.g., the cover 1106 being in the closed position 902 (FIG. 11B)).

Figure 12A:
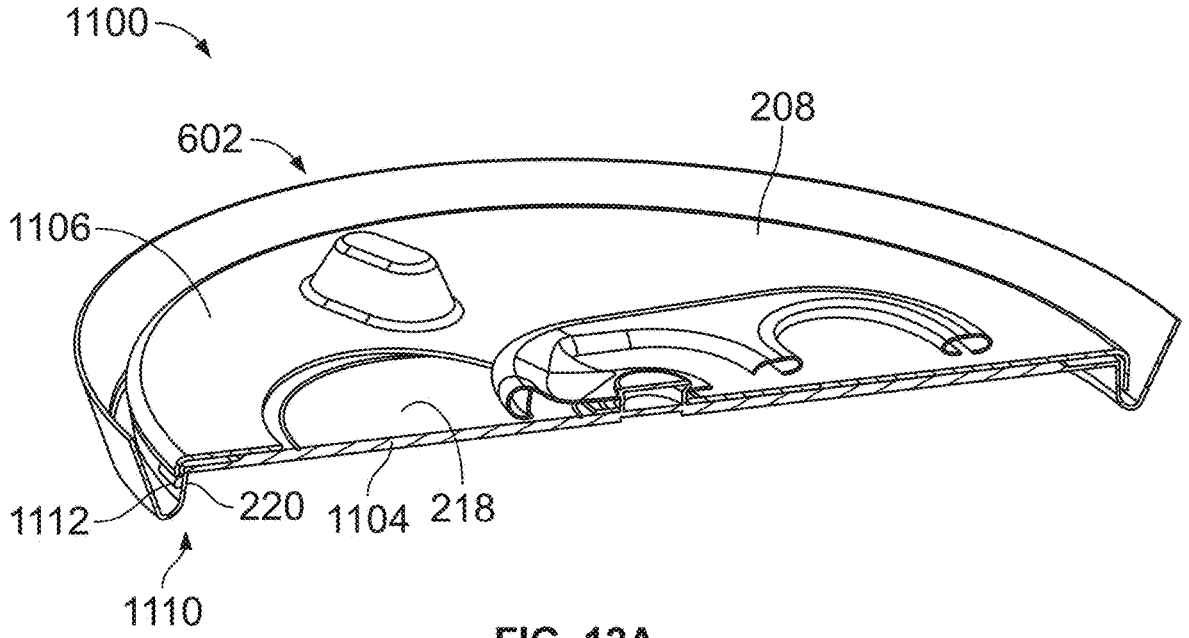
FIG. 12A is a perspective, cross-sectional view of the example can end assembly of FIG. 11A.
Figure 12B:
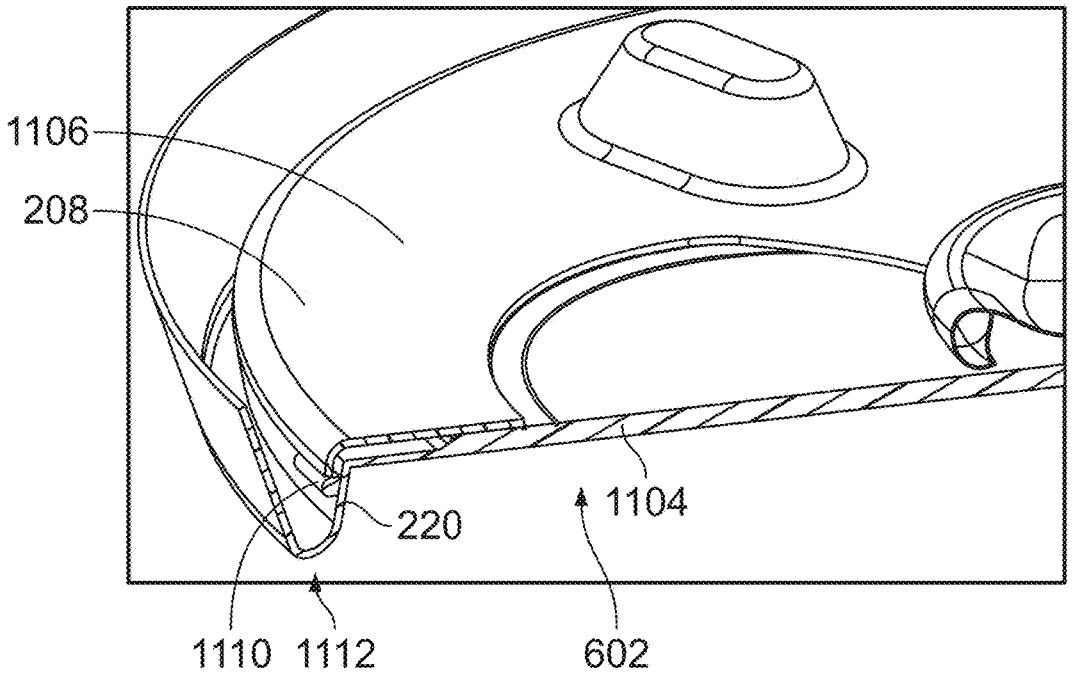
FIG. 12B is a partial, enlarged view of the example can end assembly of FIG. 12A.
Figure 12C:
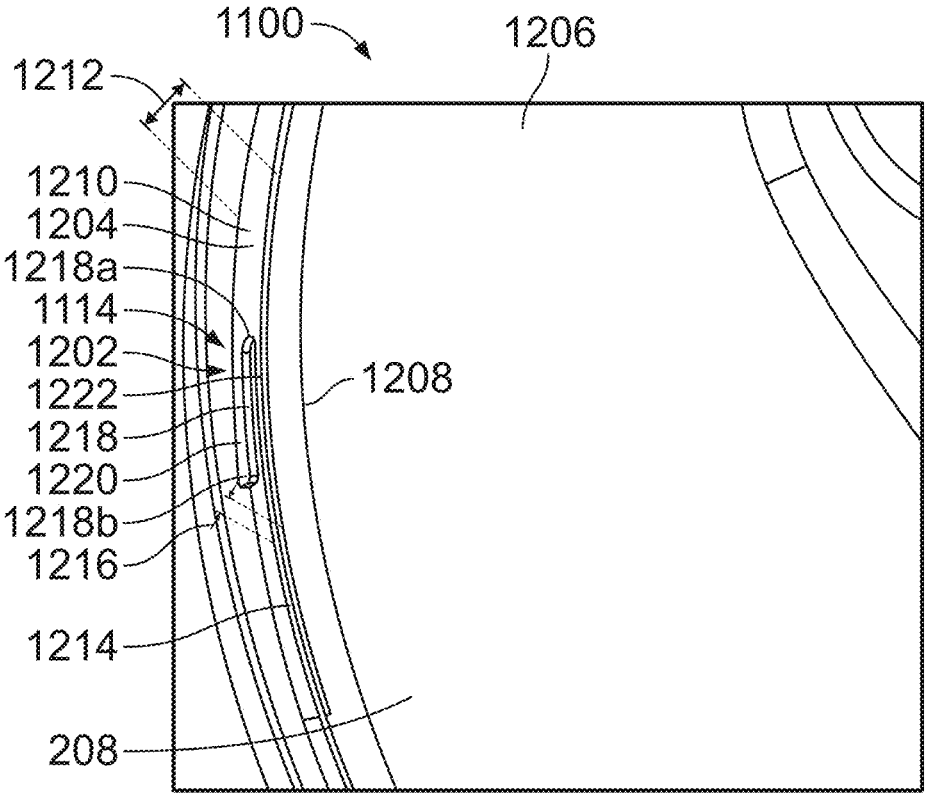
FIG. 12C is a partial, enlarged view of the can end assembly of FIG. 11A.

FIG. 12A is a cross-sectional view of the example can end assembly 1100 taken along line 12-12 of FIG. 11A. FIG. 12B is a partial, enlarged view of the example can end assembly 100 of FIG. 12B. FIG. 12C is an enlarged, partial view of the of the retainer slot 1114 of the can end assembly 1100 of FIG. 12A. Referring to FIG. 12A-12C, the protrusion 1112 of the retainer assembly 1110 of the illustrated example extends from the can end 1104. Specifically, the protrusion 1112 of the illustrated example protrudes from a panel wall 220 of the can end 1104. The panel wall 220 extends downwardly from a center panel 208. The protrusion 1112 of the illustrated example is fixed to the can end 1104. Additionally, the protrusion 1112 of the illustrated example has a semi-cylindrical shape or arcuate shape.

Referring to FIG. 12C, the protrusion 1112 is disengaged or separated from the retainer slot 1114 when the cover 1106 is in an access position (e.g., the access position 602 of FIG. 6A). The retainer slot 1114 of the illustrated example is a retainer hook 1202. Specifically, the retainer slot 1114 of the illustrated example is formed on a side wall 1204 of the cover 1106. The side wall 1204 of the cover 1106 of the illustrated example is non-parallel (e.g., perpendicular) relative to an upper surface 1206 of the cover 1106. In other words, the side wall 1204 of the cover 1106 depends downwardly from a peripheral edge 1208 of the upper surface 1206. The side wall 1204 of the illustrated example has a stepped profile such that a first arcuate wall portion 1210 of the side wall 1204 extends a first distance 1212 from the upper surface 1206 of the cover 1106 and a second arcuate wall portion 1214 of the side wall 1204 extends a second distance 1216 from the upper surface 1206 of the cover 1106 that is greater than the first distance 1212 to define a retainer hook 1202. Specifically, the retainer hook 1202 of the illustrated example is formed by an opening or slot 1218 formed between the first arcuate wall portion 1214 (e.g., a tall wall) and the second arcuate wall portion 1214 (e.g., a short wall). Thus, the retainer hook 1202 of the illustrated example includes a leg 1220 that extends over a least a portion 1222 of the second arcuate wall portion 1214. In this manner, the leg 1220 and the at least the portion 1222 of the second arcuate wall portion 1214 define a pocket or opening to receive the protrusion 1112. The slot 1218 of the illustrated example includes a closed end 1218*a* oriented toward the first arcuate wall portion and an opened end 1218*b* oriented toward the second arcuate wall portion 1214 and/or the protrusion 1112. The second arcuate wall portion 1214 has an arcuate length along a circumference or perimeter of the side wall 1204 that corresponds to (e.g., equals to) a rotational angle between the access position 602 and the closed position 902. In other words, the second arcuate wall portion 1214 is formed along only an arcuate section of the side wall 1204 that is in a rotational pathway of the cover 1106 between the access position 602 and the closed position 902. For instance, the protrusion 1112 abuts against the first arcuate wall portion 1210 (e.g., opposite the retainer hook 1202) when the cover 1106 is in the access position 602 and the protrusion 1112 engages the retainer hook 1202 when the cover 1106 is in the closed position 902.

Figure 13A:
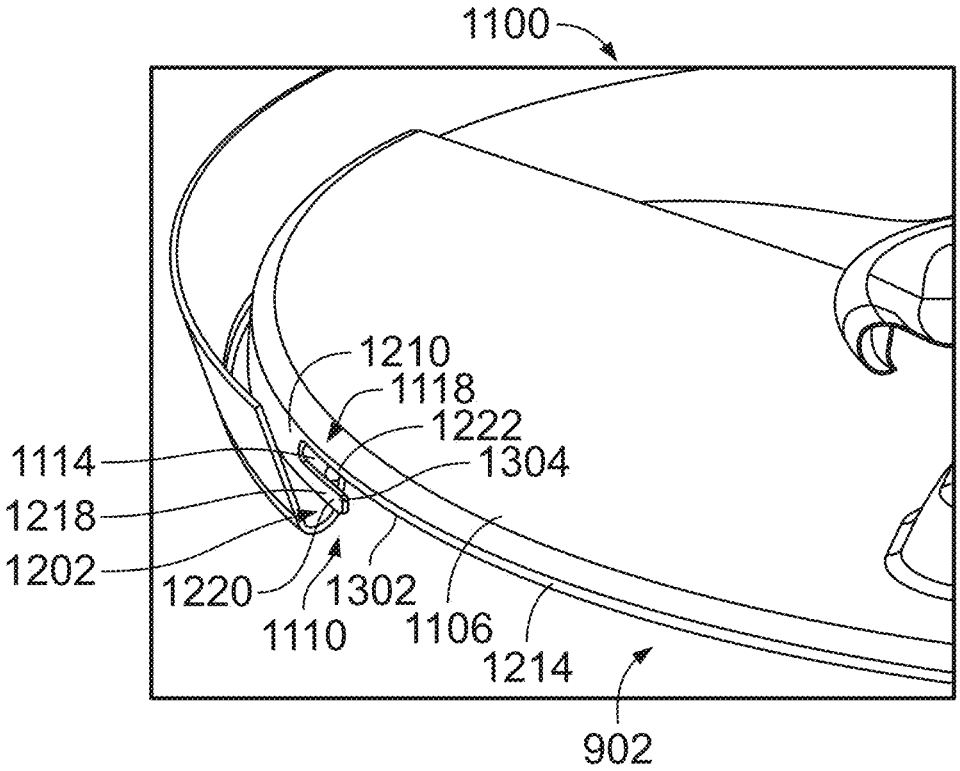
FIG. 13A is a partial, enlarged view of the example can end assembly of FIG. 11B.

FIG. 13A is a partial, enlarged view of the can end assembly 1100 of FIGS. 11A, 11B, and 12A-12C when the cover 1106 is in the closed position 902. When the cover 1106 is in the closed position 902, the retainer assembly 1110 is in the second position 1118. Specifically, the protrusion 1112 is positioned in or captured by the retainer hook 1202. As shown in the illustrated example, the protrusion 1112 is positioned within the slot 1218 of the retainer hook 1202 such that the protrusion 1112 is positioned between a lower surface 1302 of the second arcuate wall portion 1214 and an upper surface 1304 of the leg 1220 of the retainer hook 1202 (e.g., a portion of the first arcuate wall portion 1210). Thus, in the closed position 902, the cover 1106 is held in position or in a downwardly direction via the retainer hook 1202 to provide a tighter seal against the can end 104 and/or a pour opening (e.g., the pour opening 702 of FIG. 7).

Figure 13B:
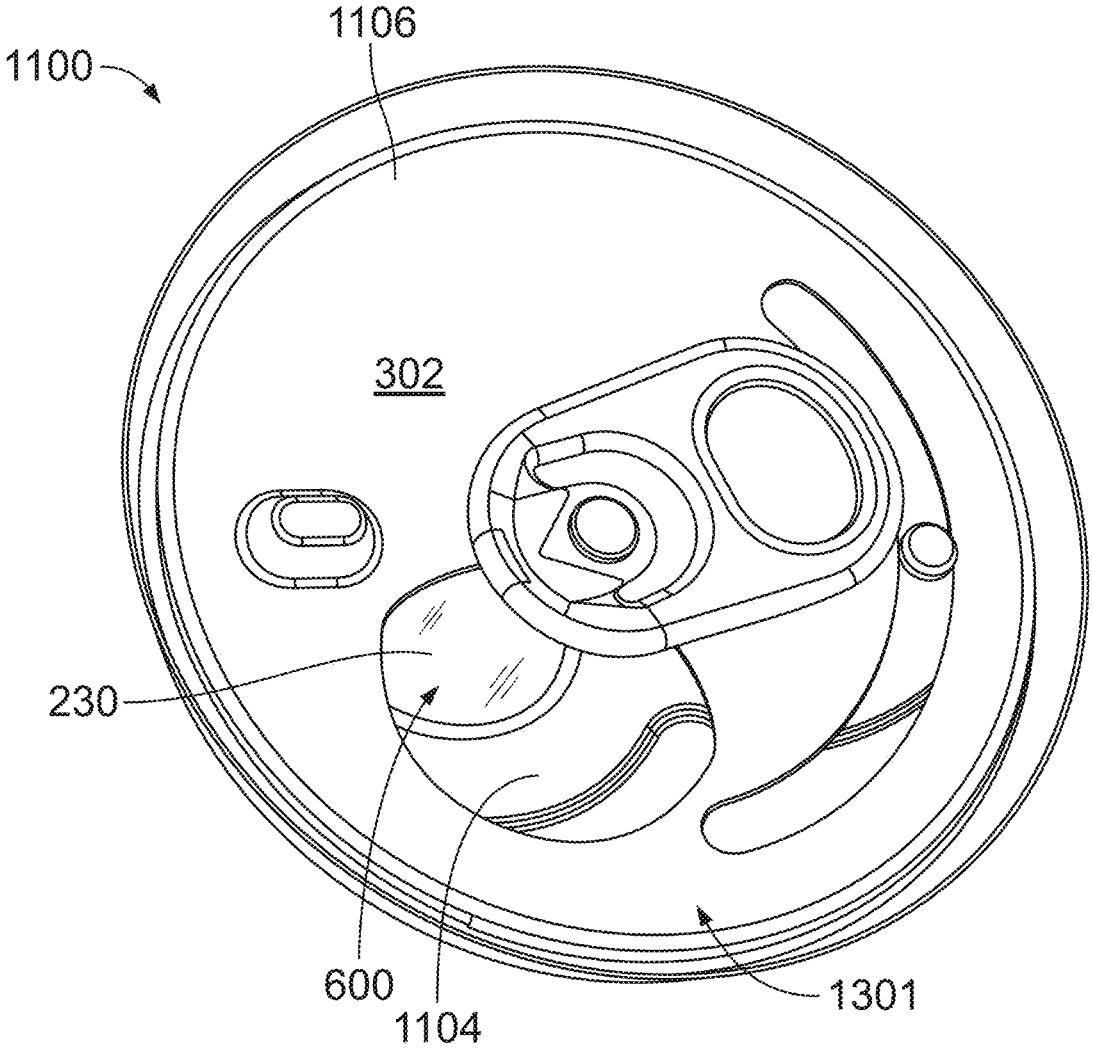
FIG. 13B is a perspective view of another example can end assembly disclosed herein.

FIG. 13B is a perspective view of the example can end assembly 1100 of FIGS. 11A and 11B shown in a sealed condition 600 and the cover 1106 is shown in an intermediate position 1301. The cover 1106 of the illustrated example can be rotated to the closed position 902 (FIG. 11B) when the pour panel 230 is in a closed or sealed position relative to the can end 1104. In this manner, the pour panel 230 can be protected by a body 302 of the cover 1106 during, for example, a transportation operation. For instance, the cover 1106 can be positioned in the closed position 902 when the can end 1104 is in the sealed condition 600 when transporting a plurality of vertically stacked cans.

Thus, the cover 1106 of the illustrated example can be moved to the closed position 902 after the pour panel 230 is opened to prevent or restrict spillage of contents in a can body (e.g., the can body 502 of FIG. 5B) when the can body 502 is tipped over. Additionally or alternatively, the cover 1106 of the illustrated example can be moved to the closed position 902 after the pour panel 230 is opened to prevent access to a pour opening (e.g., the pour opening 702 of FIG. 7) after the pour panel has been opened. In some examples, the cover 106 can be moved to the closed position 902 when the pour panel 230 is sealed or in the sealed condition 600 during transportation.

Figure 14A:
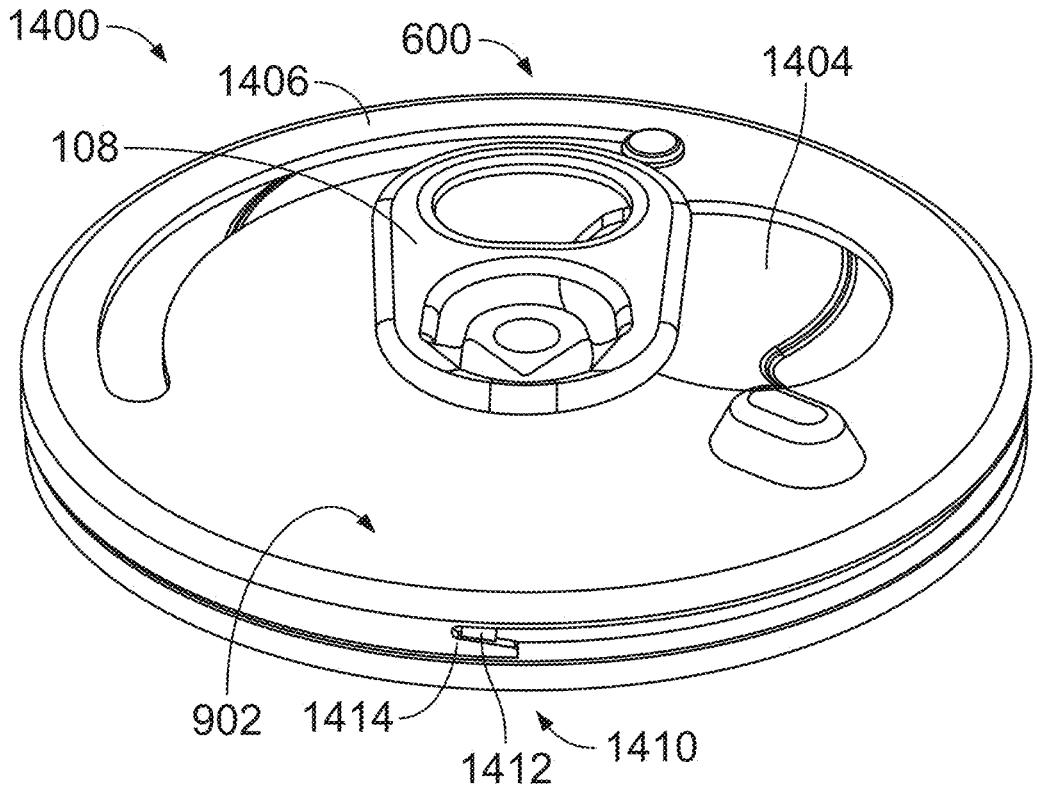
FIGS. 14A-14F are various views of another example can end assembly disclosed herein.

FIGS. 14A-14E illustrate another example can end assembly 1400 disclosed herein. FIG. 14A is a perspective view of the example can end assembly 1400. The can end assembly 1400 of the illustrated example includes a can end 1404, a cover 1406 and a tab 108. In FIG. 14A, the can end assembly 1400 is shown in a sealed condition 600 and the cover 1406 is shown in a blocking or closed position 902. The can end 1404 and the cover 1406 of FIG. 14A is substantially similar to the can end 104 and the cover 106 of FIGS. 1, 2A-2B, 3A-3B, 4A-4B, 5A-5C, 6A-6C, 7, 8A-8B, and 9A-9C, and the can end assembly 1100 (e.g., the can end 1104 and the cover 1106) of FIGS. 11A and 11B. However, the can end 1404 and the cover 1406 of FIG. 14A includes a retainer assembly 1410 that is different than the retainer assembly 512 of FIG. 1 and/or the retainer assembly 1110 of FIGS. 11A and 11B. In other words, most of the features of the can end assembly 1400 are similar to the features of the can end assembly 100 and/or the can end assembly 1100. The retainer assembly 1410 of the illustrated example includes a protrusion 1412 and a retainer slot 1414. In particular, the protrusion 1412 and the retainer slot 1414 are formed at an angle relative to horizontal.

Figure 14B:
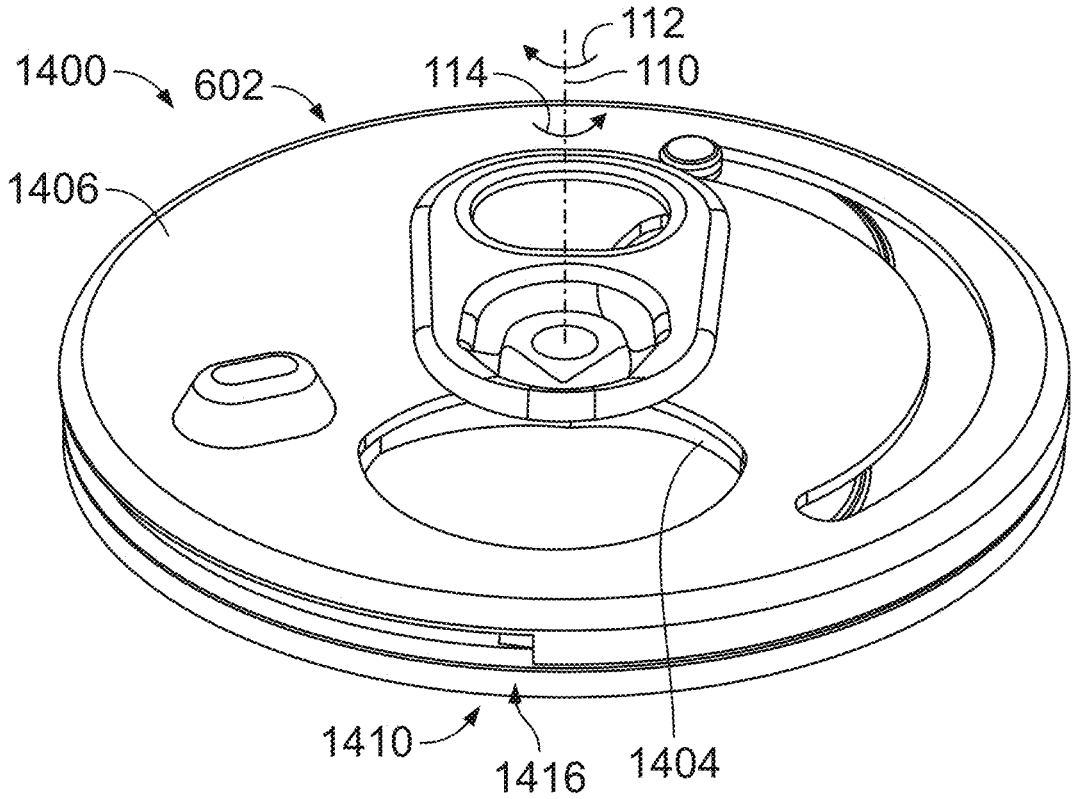
Figure 14C:
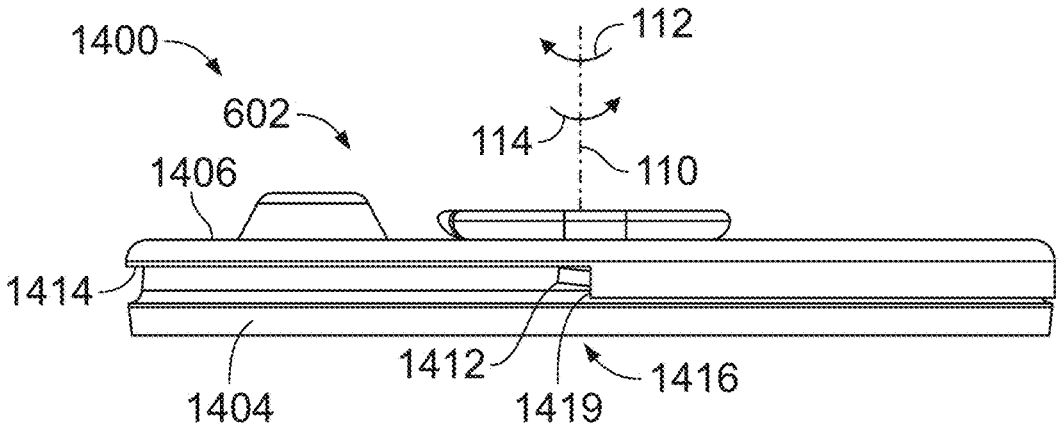

FIG. 14B is a perspective view of the can end assembly 1400 of FIG. 14A. FIG. 14C is a side view of the example can end assembly 1400 of FIG. 14B. FIGS. 14B and 14C illustrate the cover 1406 in an example open or access position 602. The cover 1406 of the illustrated example is rotatably coupled to the can end 1404. The cover 1406 of the illustrated example rotates about a rotational axis 110 in a first rotational direction 112 (e.g., clockwise direction) to move from the closed position 902 of FIG. 14A to the access position 602 of FIG. 14B and rotates about the rotational axis 110 in a second rotational direction 114 (e.g., a counterclockwise direction) opposite the first rotational direction 112 to move from the access position 602 of FIG. 14B to the closed position 902 of FIG. 14A.

Referring to FIGS. 14B and 14C, the retainer assembly 1410 is in a first position 1416 when the cover 1406 is in the access position 602 of FIG. 14A. Specifically, the protrusion 1412 of the retainer assembly 1410 is disengaged or separated from the retainer slot 1414 when the retainer assembly 1410 is in the first position 1416 (e.g., the cover 1406 is in the access position 602 (FIG. 14B)). Additionally, a first side wall or edge 1419 of the retainer slot 1414 provides a first stop when the cover 1406 is rotated to the access position 602.

Figure 14D:
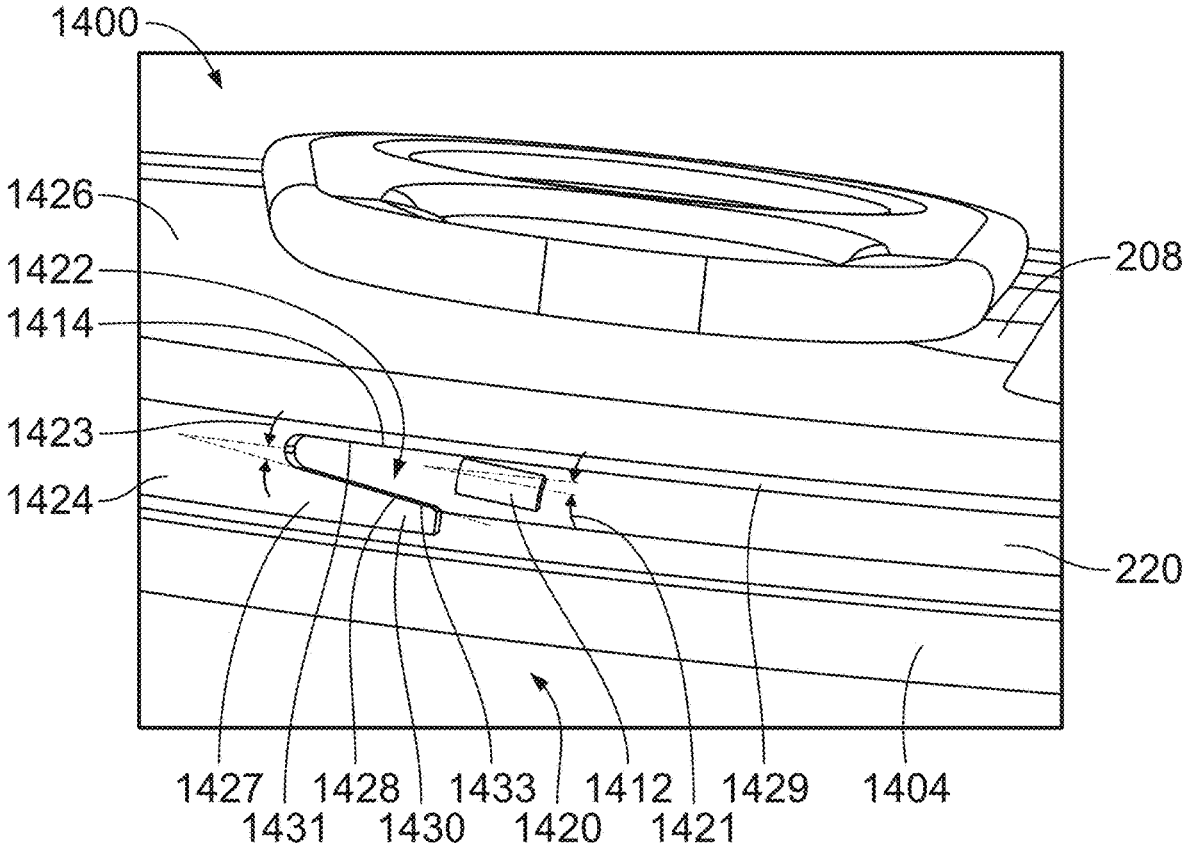

FIG. 14D is a perspective, enlarged view of the can end assembly 1400 of FIGS. 14A-14C. In the illustrated example, the can end assembly 1400 is in an intermediate position 1420. Specifically, the intermediate position 1420 is between the access position 602 and the closed position 902. In the intermediate position 1420 of the illustrated example, the protrusion 1412 is positioned away or disengaged from the retainer slot 1414 (e.g., the hook).

Referring to FIG. 14D, the protrusion 1412 of the retainer assembly 1410 of the illustrated example extends from the can end 1404. Specifically, the protrusion 1412 of the illustrated example protrudes from a panel wall 220 (e.g., a peripheral wall) of the can end 1404. The panel wall 220 extends downwardly from a center panel 208 of the can end 1404. The protrusion 1412 of the illustrated example is fixed to the can end 1404. Additionally, the protrusion 1412 of the illustrated example has a semi-cylindrical shape or arcuate shape (e.g., half barrel).

Furthermore, the protrusion 1412 is at an angle 1421 (e.g., non-parallel) relative to horizontal and/or the panel wall 220 of the can end 1404. In some examples, the angle 1421 can be between approximately five degrees and 45 degrees relative to horizontal. In other words, the protrusion 1412 is slated or canted relative to the panel wall 220 and/or horizontal. Additionally, the retainer slot 1414 of the illustrated example is canted or slanted at an angle 1423 relative to horizontal and/or the panel wall 220. In some examples, the angle 1423 can be between approximately five degrees and 45 degrees relative to horizontal. In some examples, the angle 1423 of the retainer slot 1414 is complementary to the angle 1421 of the protrusion 1412. In some examples, the angle 1423 of the retainer slot 1414 is different than the angle 1421 of the protrusion 1412.

The retainer slot 1114 of the illustrated example is a retainer hook 1422. Specifically, the retainer slot 1414 of the illustrated example is formed on a side wall 1424 of the cover 1406. The side wall 1424 of the cover 1406 of the illustrated example is non-parallel (e.g., perpendicular) relative to an upper surface 1426 of the cover 1106. In other words, the side wall 1424 of the cover 1106 depends downwardly from a peripheral edge of the upper surface 1206. In this example, the side wall 1424 partially overlaps the panel wall 220 of the can end 1404. The side wall 1204 of the illustrated example has a stepped profile defining the retainer slot 1414. Specifically, the retainer hook 1422 of the illustrated example is formed by an opening 1428 formed between a first wall portion 1427 (e.g., a tall wall) of the side wall 1424 and a second wall portion 1429 (e.g., a short wall) of the side wall 1424. Thus, the retainer hook 1422 of the illustrated example includes a leg 1430 that extends over a least a portion 1431 of the second wall portion 1429. In this manner, the leg 1430 and the at least the portion 1431 of the second wall portion 1429 define a pocket or opening to receive the protrusion 1412.

The retainer hook 1422 formed by the retainer slot 1414 is similar to the retainer hook 1202 of FIG. 12A except that a lower wall portion or the leg 1430 of the retainer hook 1422 of the illustrated example is slated or canted relative to horizontal. For example, the leg 1430 is configured to have a tapering profile (e.g., a ramp profile). In the illustrated example, an upper surface 1433 of the leg 1430 (oriented toward the opening 1428) has a tapered profile that tapers or reduces (e.g., continuously or linearly reduces) a size (e.g., an area) of the opening 1428 of the retainer hook 1422 in a direction towards a first wall portion 1427 of the side wall 1424. In other words, the opening 1428 reduces in size from an entrance of the opening 1428 to the first wall portion 1427. In some examples, a lower surface of the portion 1431 of the second wall portion 1429 can be tapered or slanted relative to horizontal.

The second wall portion 1429 has an arcuate length along a circumference or perimeter of the side wall 1424 that corresponds to (e.g., equals to) a rotational angle between the access position 602 and the closed position 902. In other words, the second wall portion 1429 is formed along only an arcuate section of the side wall 1424 to define a rotational pathway of the cover 1106 between the access position 602 and the closed position 902. For instance, the protrusion 1412 abuts against the edge 1419 (e.g., opposite the retainer hook 1422) when the cover 1106 is in the access position 602 and the protrusion 1412 engages the retainer hook 1422 when the cover 1106 is in the closed position 902.

Figure 14E:
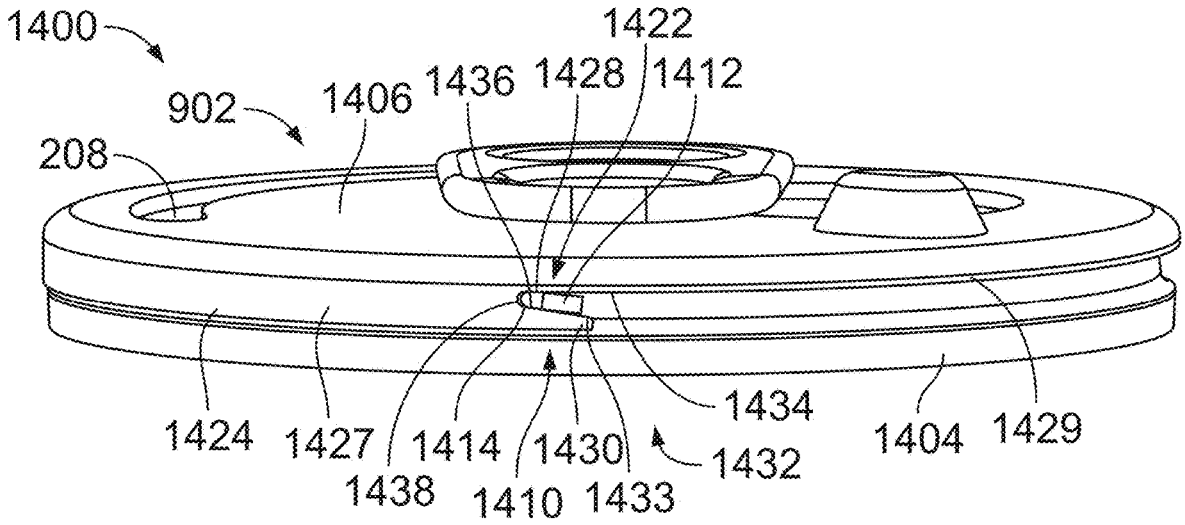
Figure 14F:
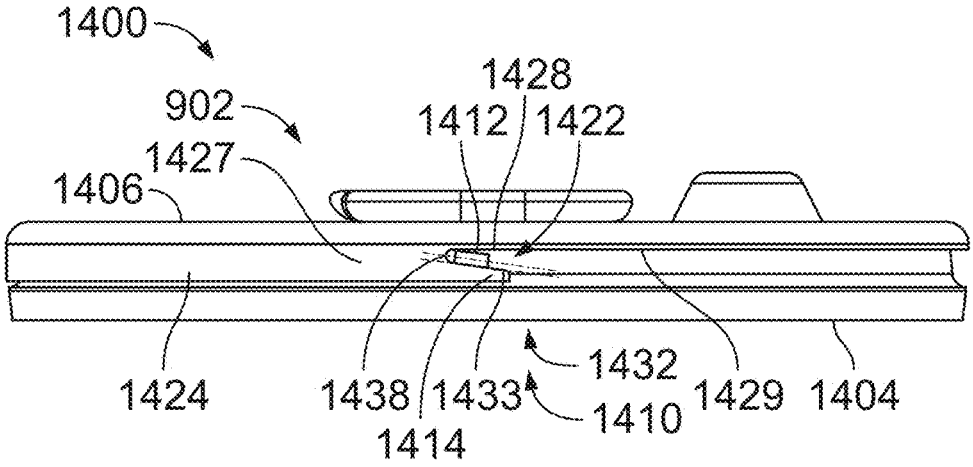

FIG. 14E is a perspective view of the can end assembly 1400 of FIGS. 14A-14D when the cover 1406 is in the closed position 902. FIG. 14F is a side view of FIG. 14E. Referring to FIG. 14E and FIG. 14F, the retainer assembly 1410 is in a second position 1432 when the cover 1406 is in the closed position 902. For example, the protrusion 1412 of the retainer assembly 1410 is engaged with the retainer slot 1414 when the retainer assembly is in the second position 1432 (e.g., the cover 1406 being in the closed position 902 (FIG. 11B)).

Specifically, the protrusion 1412 is positioned in or captured by the retainer hook 1422. As shown in the illustrated example, the protrusion 1412 is positioned within the opening 1428 of the retainer hook 1422 such that the protrusion 1412 is positioned (e.g., captured) between a lower surface 1434 of the second wall portion 1429 and the upper surface 1433 of the leg 1430 of the retainer hook 1422. The tapered profile of the retainer hook 1422 and the protrusion 1412 generate a pulling force (e.g., a progressively or continuously increasing downward force) to cause the cover 1406 to move in a direction toward the can end 1404 when the retainer hook 1422 receives the protrusion 1412. Thus, in the closed position 902, the cover 1406 is held in position or in a downwardly direction against a center panel 208 of the can end 1404 via the retainer hook 1422 to provide a tighter seal against the can end 1404 and/or a pour opening (e.g., the pour opening 702 of FIG. 7). In the illustrated example, at least a portion of the retainer assembly 1410 draws the cover 1106 toward the can end 1404 when the cover 1106 is in the closed position 902. In this manner, the tapered profile of the retainer hook 1422 and/or retainer slot 1414 draws or directs the cover 1406 toward the center panel 208 of the can end 1404 (e.g., in a direction along the rotational axis 110 or a vertical axis) when the cover 1406 is in the closed position 902. A second side or edge 1438 of the first wall portion 1427 and/or of the retainer hook 1422 provides engages the protrusion 1412 to provide a stop that prevents further rotation of the cover 1406 beyond a rotational position of the closed position 902. In other words, the edge 1438 provides a stop in the second rotational direction 114.

Figure 15C:
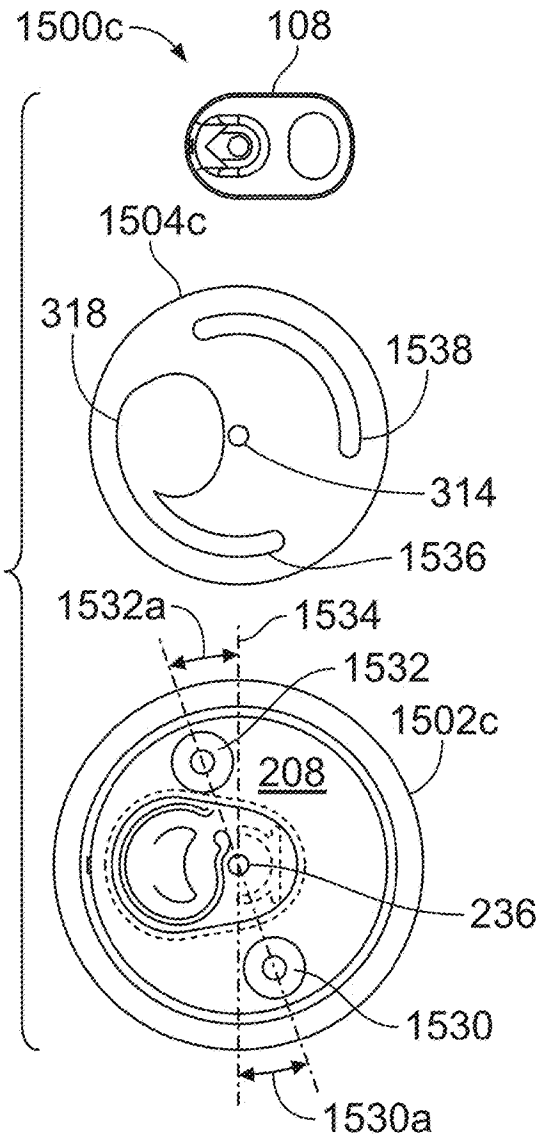
FIGS. 15A-15C are top, partially exploded views of other example can end assemblies disclosed herein.
Figure 15B:
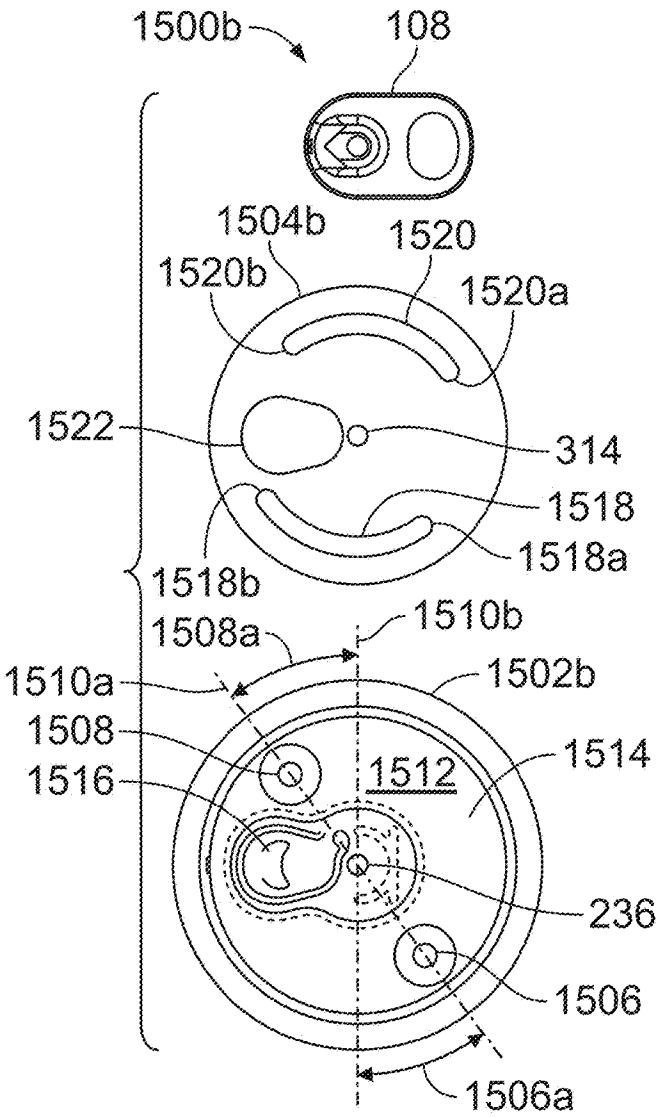
Figure 15A:
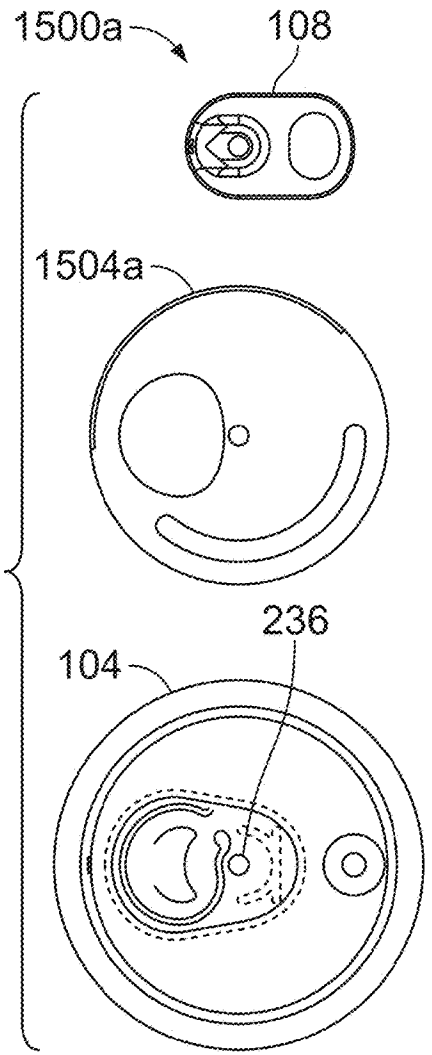

FIGS. 15A-15C are exploded views of other example can end assemblies 1500*a-c* disclosed herein. Referring to FIG. 15A, the can end assembly 1500*a* of the illustrated example includes a can end 104, a cover 1504*a*, and a tab 108. The cover 1504*a* of the illustrated example is substantially similar to the cover 106 of the example can end assembly 100 of FIG. 1 except the cover 1504*a* of FIG. 15A does not include a grip (e.g., the grip 338 of FIG. 3A).

Referring to FIG. 15B, the can end assembly 1500*b* of the illustrated example includes a can end 1502*b*, a cover 1504*b* and a tab 108. The can end 1502*b* of the illustrated example includes a first guide pin 1506 (e.g., the guide pin 240 of FIG. 2A) and a second guide pin 1508. In the illustrated example, the first guide pin 1506 is diametrically opposed relative to the second guide pin 1508. For example, an angular reference line 1510*a* extending across an upper surface 1512 of the can end 1502*b* (e.g., horizontally in the orientation of FIG. 15B) intersects the first guide pin 1506, the second guide pin 1508 and a rivet 236 formed on a central panel 1514 of the can end 1502*b*. In the illustrated example, the rivet 236 is positioned between the first guide pin 1506 and the second guide pin 1508. Additionally, the second guide pin 1508 is positioned closer to a pour panel 1516 than the first guide pin 1506. For instance, the first guide pin 1506 is positioned on a first side of a y-axis reference 1510*b* in the orientation of FIG. 15B and the second guide pin 1508 is positioned on a second side of the y-axis reference 1510*b* opposite the first side. For example, the first guide pin 1506 is positioned at a first angle 1506*a* (e.g., relative to the y-axis reference 1510*b* in the orientation of FIG. 15B) and the second guide pin 1508 is positioned at a second angle 1508*a*. In the illustrated example, the first angle 1506*a* is substantially similar to (e.g., equal or within 5% of) the second angle 1508*a*. In some examples, the first angle 1506*a* is different than (e.g., greater than or less than 5% of) the second angle 1508*a*. The first angle 1506*a* and/or the second angle 1508*a* of the illustrated example can be between approximately 10 percent and 80 percent relative to the y-axis reference 1510*b*. The pour panel 1516 of the illustrated example has a smaller dimensional footprint or perimeter compared to the pour panel 230 of FIG. 2A. However, in some examples, the can end 1502*b* can be formed with the pour panel 230 of FIG. 2A. In some such examples, the first guide pin 1506 and/or the second guide pin 1508 can be positioned at different angular positions than shown in FIG. 15B to accommodate for the pour panel 230.

The cover 1504*b* of the illustrated example includes a first guide slot 1518 and a second guide slot 1520. The first guide slot 1518 of the illustrated example is separate or isolated from the second guide slot 1520. The first guide slot 1518 of the illustrated example includes a first arcuate length between a first end 1518*a* and a second end 1518*b* opposite the first end 1518*a*. The second guide slot 1520 of the illustrated example includes a second arcuate length between a third end 1520*a* and a fourth end 1520*b* opposite the third end 1520*a*. The first guide slot 1518 of the cover 1504*b* receives (e.g., slidably receives) the first guide pin 1506 and the second guide slot 1520 of the cover 1504*b* receives (e.g., slidably receives) the second guide pin 1508. The cover 1504*b* of the illustrated example includes an access opening 1522 and a rivet opening 314. The access opening 1522 of FIG. 15B is similar to the access opening 318 of the cover 106 of FIG. 3A except that the access opening 1522 is sized smaller than the access opening 318.

Referring to FIG. 15C, the can end assembly 1500*c* includes a can end 1502*c*, a cover 1504*c* and a tab 108. The can end 1502*c* of the illustrated example includes a pour panel 230, a rivet 236 a first guide pin 1530 and a second guide pin 1532 formed on a center panel 208 of the can end 1502*c*. The first guide pin 1530 is positioned at a first angle 1530*a* relative to a y-axis reference 1534 and the second guide pin 1532 is positioned at a second angle 1532*a* relative to the y-axis reference 1534. For example, the first angle 1530*a* and/or the second angle 1532*b* is between approximately 5 degrees and 30 degrees relative to the y-axis reference 1534.

The cover 1504*c* of the illustrated example includes a rivet opening 314, an access opening 318, a first guide track 1536 and a second guide track 1538. The first guide track 1536 is separate or isolated from the second guide track 1538. However, the first guide track 1536 of the illustrated example is joined with the access opening 318. In other words, the first guide track 1536 and the access opening 318 form a continuous opening or aperture through the cover 1504*c*. To this end, the first guide track 1536 and the access opening 318 are not isolated or separate.

Figure 16A:
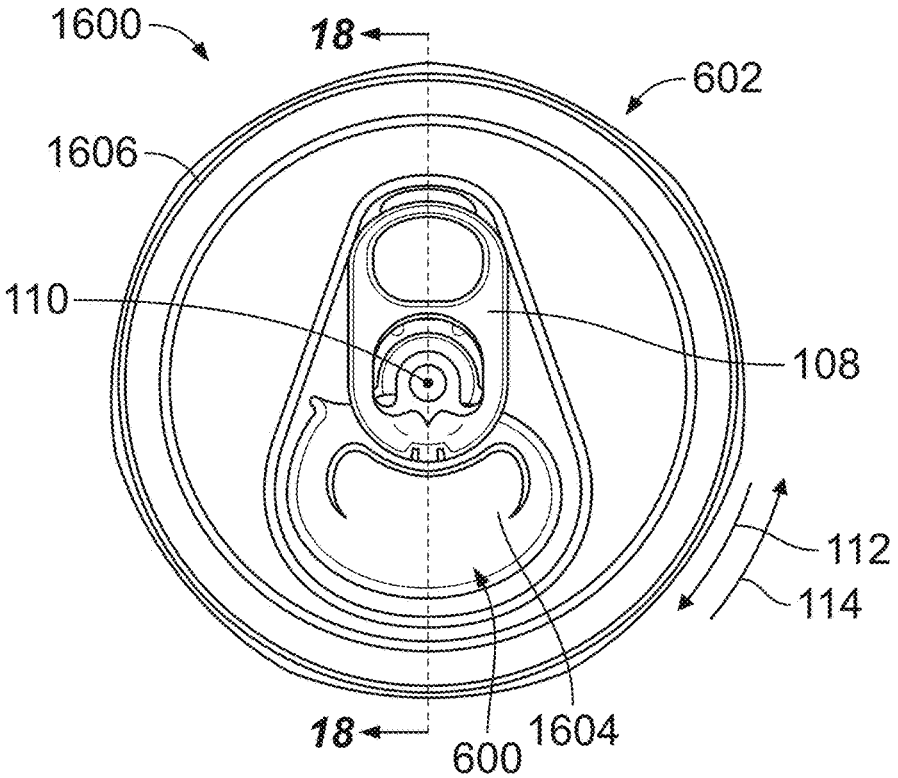
FIG. 16A is a top view of another example can end assembly disclosed herein shown in an example first condition.
Figure 16B:
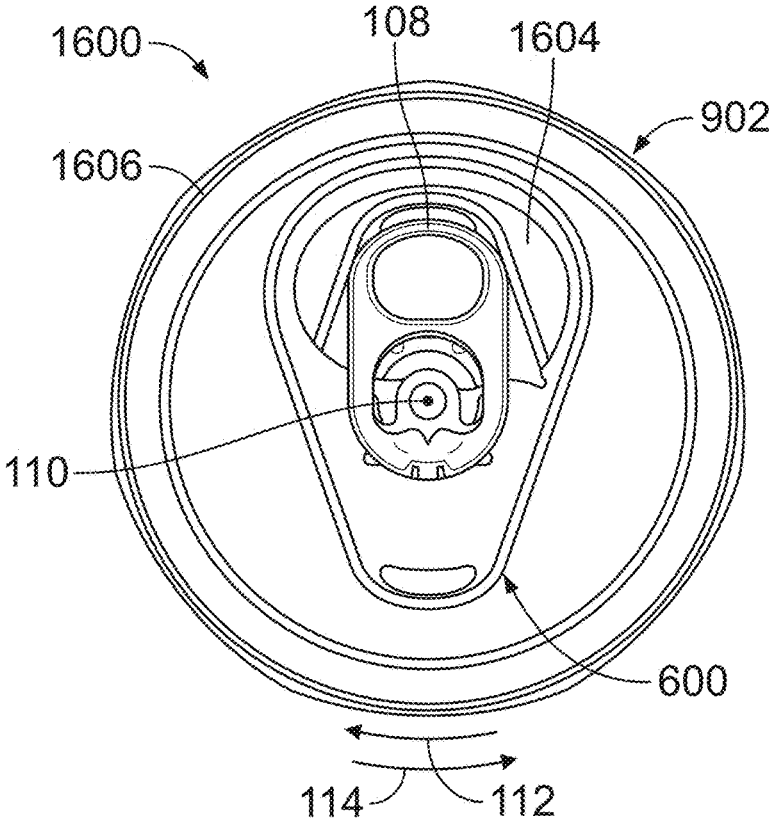
FIG. 16B is a top view of the example can end assembly of FIG. 16B shown in an example second condition.

FIGS. 16A and 16B are top views of another example can end assembly 1600 disclosed herein. The can end assembly 1600 of the illustrated example includes a can end 1604 (e.g., a lower shell), a cover 1606 (e.g., an upper shell) and a tab 108. In FIG. 16A, the can end assembly 1600 is shown in a sealed condition 600 and the cover 1606 is shown in an open or access position 602. In FIG. 16B, the cover 1106 is shown in a blocking or closed position 902 (e.g., the can end assembly 1600 can be in the sealed condition 600 of FIG. 16A or an unsealed condition (e.g., the unsealed condition 700 of FIG. 7) when the cover 1106 is in the closed position 902). The cover 1606 of the illustrated example is rotatably coupled to the can end 1604. The cover 1606 of the illustrated example rotates about a rotational axis 110 in a first rotational direction 112 to move from the closed position 902 to the access position 602 and rotates about the rotational axis 110 in a second rotational direction 114 to move from the access position 602 to the closed position 902.

Figure 17A:
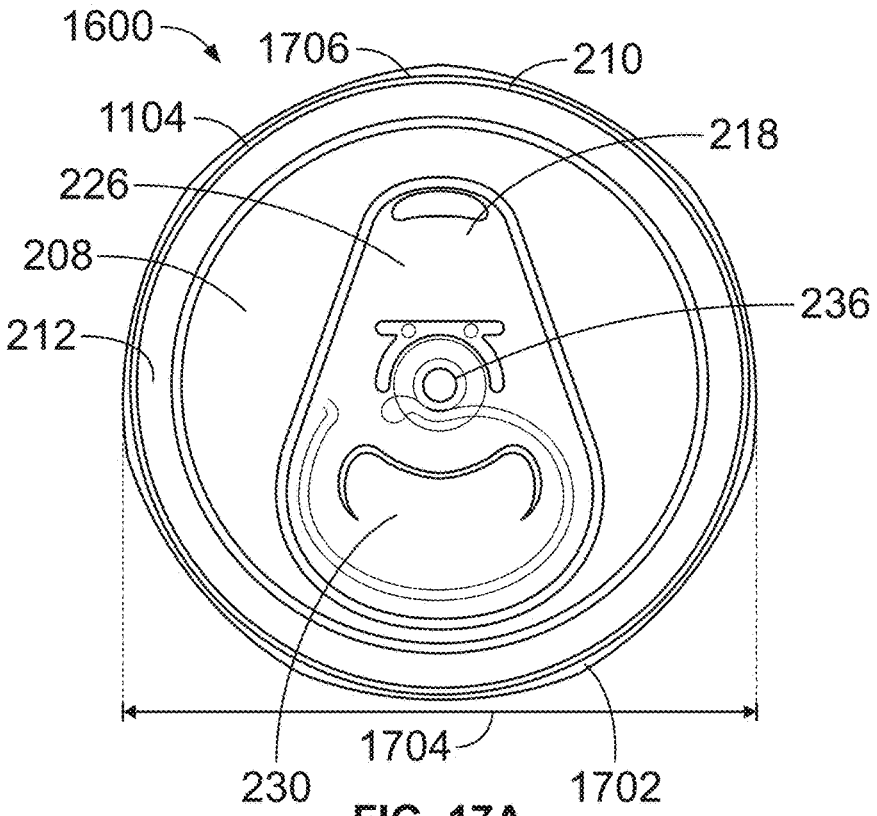
FIG. 17A is a top view of the example can end assembly of FIG. 16A shown without an example cover.

FIG. 17A is a top view of the example can end assembly 1600 of FIG. 16A shown without the cover 1606. Referring to FIG. 17A, the can end 1604 of the illustrated example is coupled to (e.g., seemed on) an example can body 1702. The can end 1604 of the illustrated example includes a pour panel 230, a rivet 236, a center panel 208, a deboss panel 226, a circumferential wall 212 (e.g., a cylindrical wall) and a seaming curl 210. The seaming curl 210 defines an outer diameter 1704 (e.g., an outermost diameter) of the can end 1604. The seaming curl 210 and an end of the can body 1702 form a double seam 1706 to couple the can end 1604 and the can body 1702.

Figure 17B:
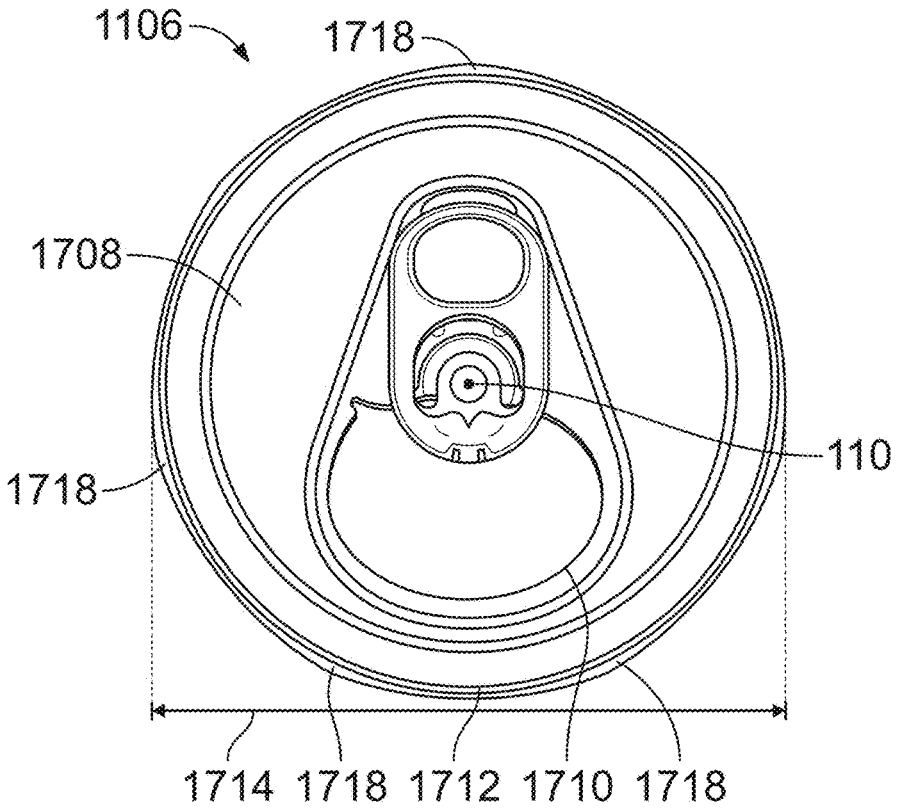
FIG. 17B is a top view of the example cover of the example can end assembly of FIGS. 16A and 16B.

FIG. 17B is a top view of the example cover 1606 of FIGS. 17A and 17B. The cover 1606 of the illustrated example is a cylindrical body 1708 defining an access opening 1710 and a peripheral edge 1712. The peripheral edge 1712 of the illustrated example has a cover diameter 1714. The cover diameter 1714 of the illustrated example is greater than the outer diameter 1704 of the can end 1604 (FIG. 17A). In this manner, the peripheral edge 1712 of the cover couples (e.g., rotatably couples) to the can end 1604. In the illustrated example, the peripheral edge 1712 is curled or wrapped (e.g., encased or wrapped) around the double seam 1706 of the can end 1604. In the illustrated example, the peripheral edge 1712 of the cover is wrapped about a portion of the double seam 1706. For instance, the cover 1606 of the illustrated example includes a plurality of seaming curls 1718. The seaming curls 1718 are spaced apart circumferentially relative to the rotational axis 110 (e.g., of angles of approximately between 20 degrees and 60 degrees). In some examples, the peripheral edge 1712 of the cover 1606 curls or wraps around the double seam 1706 of the can end 1604 about an entire circumference (e.g., 360 degrees) of the can end to form a continuous seaming curl.

Figure 18:
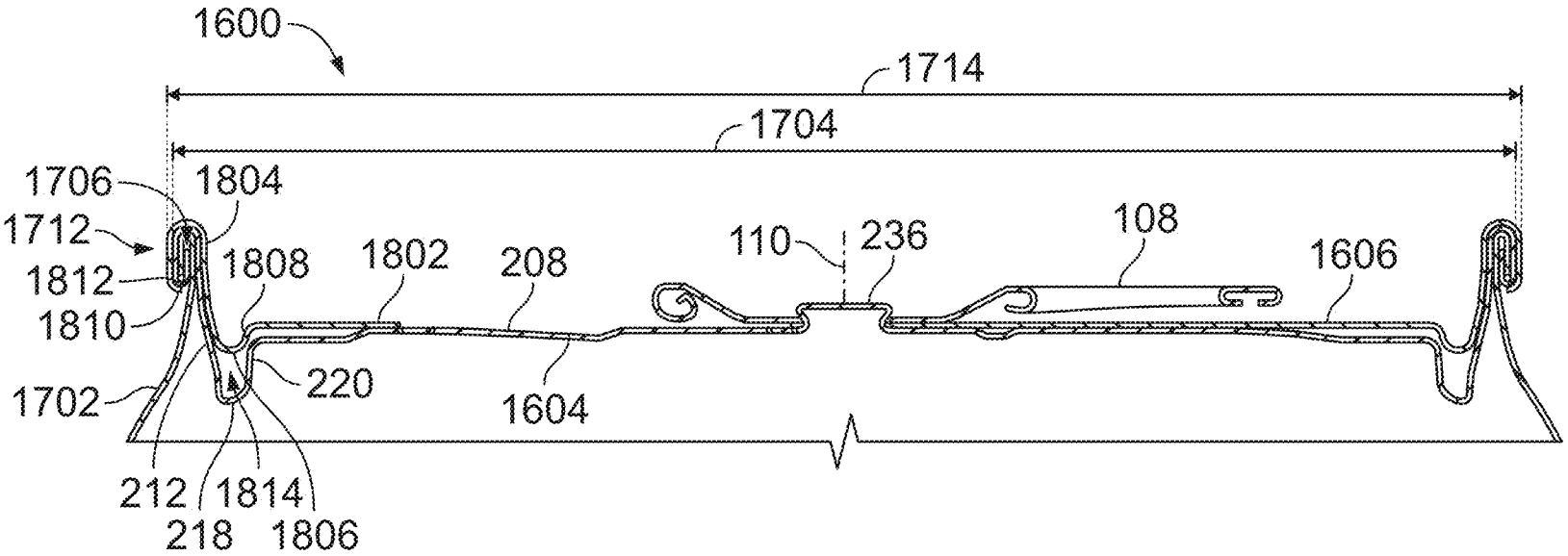
FIG. 18 is a cross-sectional view of the example can end assembly of FIG. 16A.

FIG. 18 is a cross-sectional view of the can end assembly 1600 taken along line 18-18 of FIG. 16A. Referring to FIG. 18, the cover 1606 of the illustrated example includes a center panel 1802 coupled to a circumferential wall 1804 by a countersink 1806 and a panel wall 1808. The panel wall 1808 of the illustrated example couples the center panel 1802 and the countersink 1806, and the countersink 1806 couples the panel wall 1808 and the circumferential wall 1804. The peripheral edge 1712 of the cover 1606 is coupled to the circumferential wall 1804. Thus, the cover 1606 is a unitary piece or structure. In the illustrated example, the peripheral edge 1712 of the cover 1606 is curled or bent over the double seam 1706 formed between the can body 1702 and the can end 1604. Thus, the peripheral edge 1712 of the cover 1606 that is wrapped around the double seam 1706 of the can end 1604 and the can body 1702 encases or encircles the double seam 1706. In other words, the cover 1606 extends over (e.g., covers) a portion of the circumferential wall 212 of the can end 1604 (e.g., that is oriented toward the center panel 208 of the can end 1604) and the double seam 1706 of the can end 1604 oriented away from the center panel 208. As shown, the cover diameter 1714 (e.g., an outer most diameter of the cover 1606) is greater than the outer diameter 1704 (e.g., an outermost diameter) of the can end 1604.

Additionally, an attachment between the double seam 1706 and the peripheral edge 1712 provides a retainer to restrict or prevent detachment of the cover 1606 relative to the can end 1604. To provide a retainer, an end 1810 of the peripheral edge 1712 is positioned underneath a lowermost outer edge 1812 of the double seam 1706. In other words, the end 1810 of the peripheral edge 1712 is tucked underneath the double seam 1706. The end 1810 of the peripheral edge 1712 of the cover 1606 of the illustrated example is positioned underneath the double seam 1706 to provide a retainer that prevents or restricts the cover 1606 from decoupling or separating from the can end 1604 when the cover 1606 rotates relative to the can end 1604 about the rotational axis 110. In this manner, the cover 1606 remains attached to the double seam 1706 when the cover 1606 rotates between the access position 602 and the closed position 902.

The countersink 1806 of the cover 1606 of the illustrated example at least partially protrudes within a cavity 1814 formed by the countersink 218 of the can end 1604 (e.g., between a panel wall 220 and the circumferential wall 212 of the can end 1604). In some examples, the countersink 1806 of the cover 1606 does not extend within the cavity 1814 formed by the countersink 218 of the can end 1604. In some examples, the peripheral edge 1712 of the cover 1606 is wrapped around the double seam 1706 of the can end 1604 and the can body 1702 about an entire circumference (e.g., 360 degrees) of the double seam 1706. In some examples, the peripheral edge 1712 of the cover 1606 is curled or wrapped over the double seam 1706 of the can end 1604 and the can body 1702 after formation of the double seam 1706.

Although the peripheral edge 1712 of the cover 1606 is wrapped around the double seam 1706 of the can end 1604 and the can body 1702, the cover 1606 rotates relative to the double seam 1706 and/or the can end 1604. For example, the cover 1606 is coupled (e.g., loosely attached) to the can end 1604 to enable rotational movement about the rotational axis 110. Thus, the double seam 1706 of the can end 1604 and the can body 1702 guides rotational movement of the cover relative to the can end. Additionally, the circumferential wall 212, the center panel 208 and/or panel wall 220 of the can end 1604 can guide rotational movement of the cover 1606 relative to the can end 1604.

In operation, a user can grasp or grip the cover 1606 (e.g., the peripheral edge 1712 and/or the plurality of seaming curls 1716) and rotate the cover 1606 about the rotational axis 110. For example, to rotate the cover 1606, a user can grip the peripheral edge 1712 of the cover 1606 (e.g., similar to a lid of ajar) and rotate the cover 1606 about the rotational axis 110 between approximately 90 degrees and 180 degrees. In some examples, the can end assembly 1600 can include a positive stop or travel limit (e.g., a bead, a protrusion, etc.) to facilitate alignment between a pour opening of the can end 1604 and the access opening 1710 of the cover 1606.

Figure 19A:
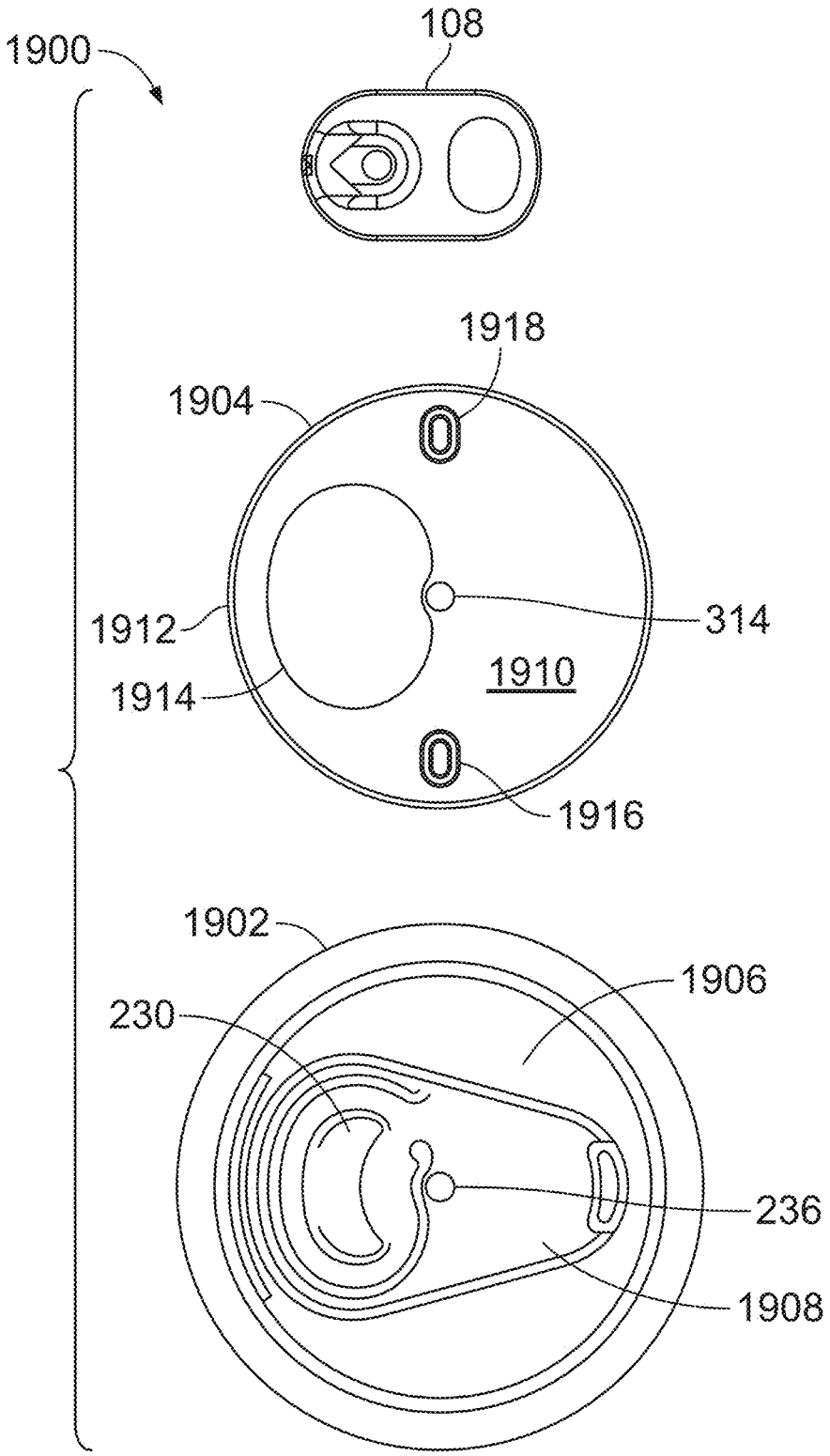
FIG. 19A is top, partially exploded view of another example can end assembly disclosed herein.

FIG. 19A is a top, exploded view of another example can end assembly 1900 disclosed herein. The can end assembly 1900 of the illustrated example includes a can end 1902, a cover 1904, and a tab 108. The can end 1902 of the illustrated example includes a center panel 1906 having a deboss area 1908 that includes a rivet 236 and a pour panel 230. The cover 1904 of the illustrated example includes an upper surface 1910 and a side wall 1912. The cover 1904 defines an access opening 1914 and a rivet opening 314. Additionally, the cover 1904 of the illustrated example includes a first grip 1916 (e.g., a first bead or protrusion) and a second grip 1918 (e.g., a second bead or protrusion) protruding from the upper surface 1910.

Figure 19B:
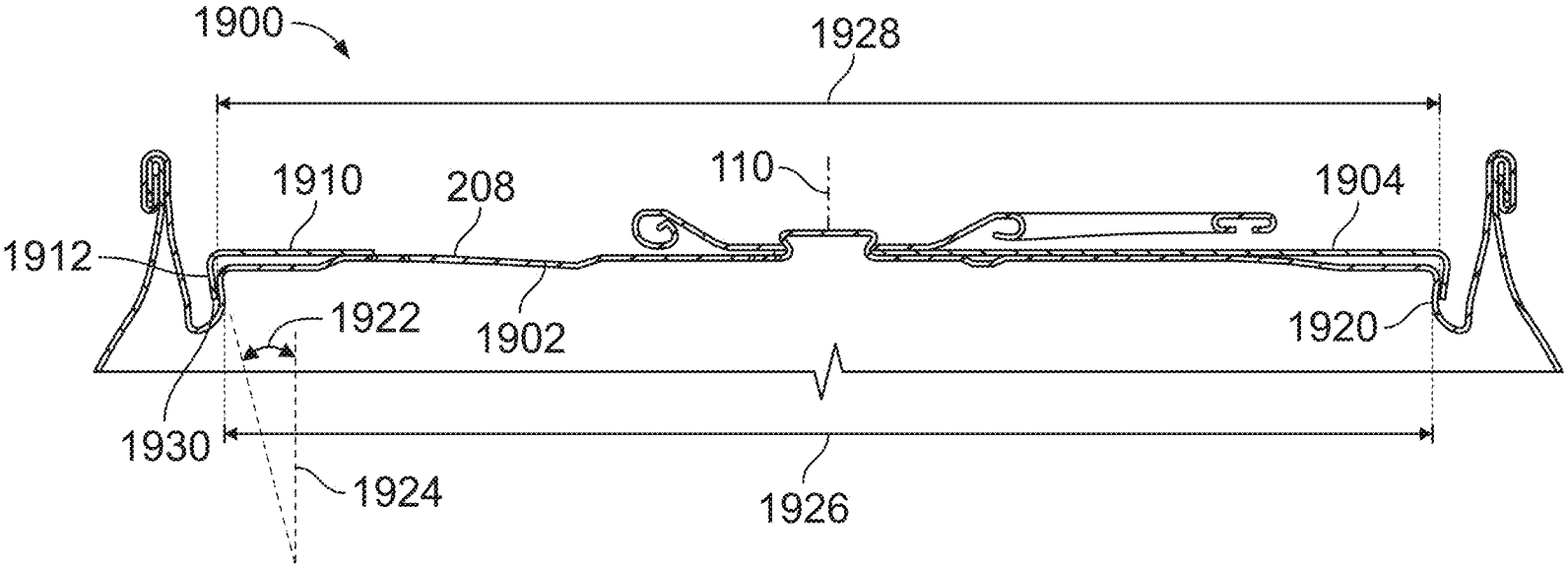
FIG. 19B is a cross-sectional view of the example can end assembly of FIG. 19A.

FIG. 19B is a cross-sectional view of the can end assembly 1900 of FIG. 19A. Referring to FIG. 19B, the cover 1904 of the illustrated example is rotatably coupled to the center panel 208 of the can end 1902. In contrast with the can end assembly 100 of FIG. 1, the can end assembly 1900 of FIG. 19B does not include the guide assembly 513 and the retainer assembly 512. To retain the cover 1904 coupled to the can end 1902, a panel wall 1920 of the can end 1902 of the illustrated example has an angle 1922 (e.g., a negative angle) relative to vertical 1924 such that the panel wall 1920 has a diameter 1926 that is less than a diameter 1928 of the center panel 208. In other words, the panel wall 1920 of the illustrated example tapers toward the rotational axis 110. Additionally, the side wall 1912 of the cover 1904 of the illustrated example is angled or tapered relative to the upper surface 1910 of the cover 1904. In other words, the side wall 1912 of the cover 1904 tapers inwardly toward the rotational axis 110 from the upper surface 1910 toward an end 1930 of the side wall 1912. Thus, the side wall 1912 retains the cover 1904 coupled to the can end 1902 and/or prevents the cover 1904 from detaching or decoupling (e.g., separating from) from the can end 1902 when the cover 1904 rotates about the rotational axis 110 between the access position 602 and the closed position 902.

Figure 20:
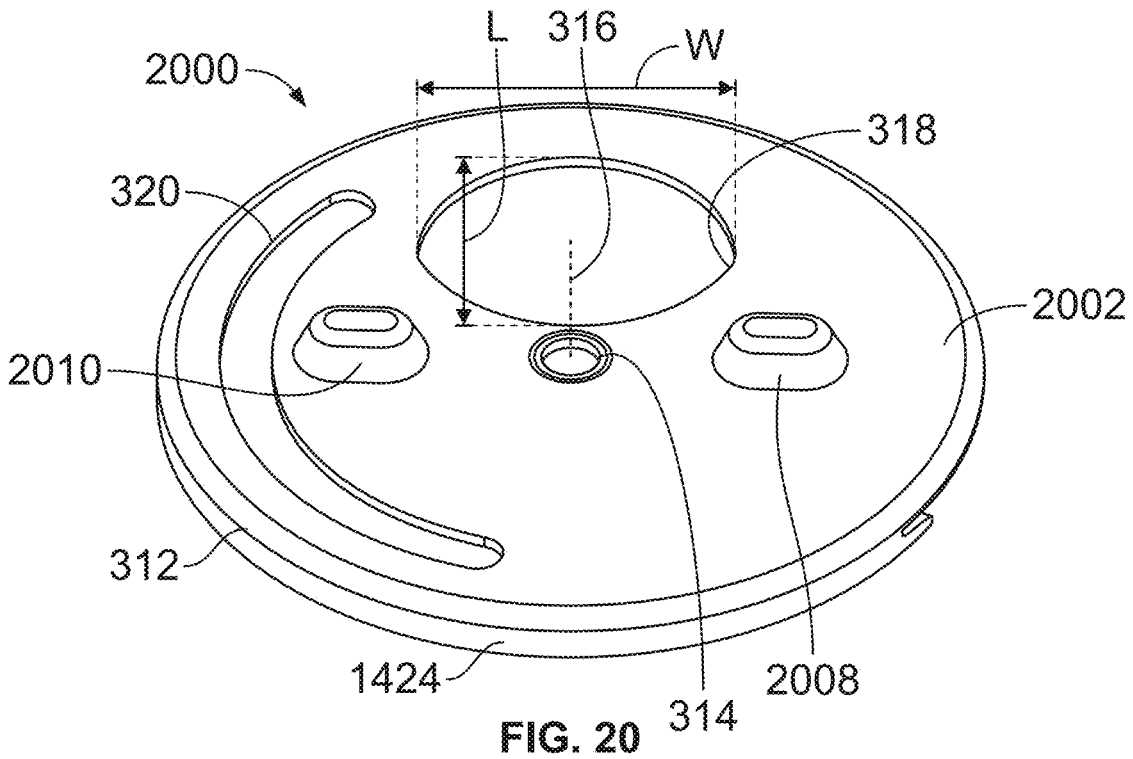
FIG. 20 is a perspective view of another example cover disclosed herein.

FIG. 20 is perspective view of an example cover 2000 disclosed herein. The cover 2000 is similar to the cover 1406 of FIG. 14A. For example, the cover 2000 of the illustrated example includes an upper wall 2002 (e.g., an upper surface) and a side wall 1424. To receive or enable a rivet (e.g., the rivet 236 of FIG. 2) of a can end (e.g., the can end 1404) to pass through the cover 2000, the cover 2000 of the illustrated example includes a first or rivet opening 314. The rivet opening 314 is centrally located relative to the upper wall 2002 and is coaxially aligned with a central or longitudinal axis 316 of the cover 2000. The rivet opening 314 of the illustrated example has a circular shape. The cover 106 of the illustrated example includes a second or access opening 318. The access opening 318 is positioned adjacent to and spaced from the rivet opening 314. The access opening 318 enables access to a pour panel (e.g., the pour panel 230 of FIG. 2A) when the cover 2000 is rotated to a position at which the access opening 318 is in alignment with the pour panel. In the illustrated example, the access opening 318 has an oblong shape (e.g., a width W greater than a length L).

To enable rotation of the cover 2000 relative to a can end, the cover 106 of the illustrated example includes a guide track 320 (e.g., a third opening, a slot, etc.). In the illustrated example, the guide track 320 is positioned adjacent the peripheral edge 312 (e.g., an outermost peripheral edge) of the cover 106. Specifically, the guide track 320 is positioned between the peripheral edge 312 and the access opening 318. An arcuate length and/or arcuate shape of the guide track 320 defines a rotational pathway of the cover 106 relative to the can end 104. The guide track 320 of the illustrated example is sized or configured to receive the guide pin 240 (FIG. 2A) of the can end 104, 1104. For example, respective ends of the arcuate length of the guide track 320 can be spaced at a rotational position of approximately between 10 degrees and 270 degrees relative to the longitudinal axis 316. In other words, a rotational movement of profile of the cover 2000 relative to a can end can be between approximately 10 degrees and 270 degrees (e.g., 180 degrees) when moving or rotating the cover 2000 between an open position (e.g., the access position 602) and a closed position (e.g., the closed position 902).

To facilitate rotation of the cover 2000 relative to a can end, the cover 2000 of the illustrated example includes a first knob or grip 2008 and a second knob or grip 2010 (e.g., the grip 338 of FIG. 3A). Thus, the first grip 2008 and the second grip 2010 provide a The first grip 2008 and the second grip 2010 of the illustrated example protrude from the upper wall 2002 of the cover 2000 in a direction away from the upper wall 2002. The first grip 2008 and/or the second grip 2010 of the illustrated example have a trapezoidal or pyramid type shape in a direction along the longitudinal axis 316 and an oblong cross-sectional shape in a plane taken perpendicular to a vertical plane parallel to the longitudinal axis 316 (e.g., from a top view of the cover 2000). In the illustrated example, the first grip 2008 is diametrically opposed from the second grip 2010. In the illustrated example, the first grip 2008 is positioned between the rivet opening 314 and the peripheral edge 312 opposite the guide track 320. The first grip 2008 and the second grip 2010 provide a dual gripping feature to enable a user to grasp the cover 2000 with two or more figures to rotate the cover 2000 relative to a can end between an open position (e.g., the access position 602 of FIGS. 14B-14C) and a closed position (e.g., the closed position 902 of FIGS. 14E-14F). The first grip 2008 of the illustrated example is positioned at a one-hundred and eighty degree (180°) rotational position relative to the second grip 2010. However, in some examples, the first grip 2008 and the second grip 2010 can be positioned at any desired angle (30 degrees apart, 60 degrees, apart, 90 degrees apart, 120 degrees apart, and/or any other enable between 15 degrees and 270 degrees). The first grip 2008 is aligned with the second grip 2010 (e.g., a straight line passes through the first grip 2008 and the second grip 2010).

To avoid interference between the second grip 2010 and a tab (e.g., the tab 108 of FIGS. 14A-14E), a tab coupled to the cover 2000 can be pivotally attached to the cover 2000 and/or a can end. In this manner, the tab can be rotated relative to the cover 2000 and/or the can end about the longitudinal axis 316. As a result, either a user can manually move the tab outside of a pathway of the second grip 2010 prior to rotating the cover 2000 and/or the second grip 2010 can engage the tab to rotate the tab relative to the cover 2000 when the cover 2000 rotates between the closed position and the open position. In some examples, a rivet of the can end extends through the rivet opening 314 to stake the tab the cover 2000 such that the tab can rotated about the rivet and relative to (e.g., above) the upper wall 2002 of the cover 2000. Thus, the tab, when positioned on the upper wall 2002 of the cover 2000 does not interfere with the second grip 2010 (and/or the first grip 2008) during a rotational movement of the cover 2000 relative to a can end.

Figure 21:
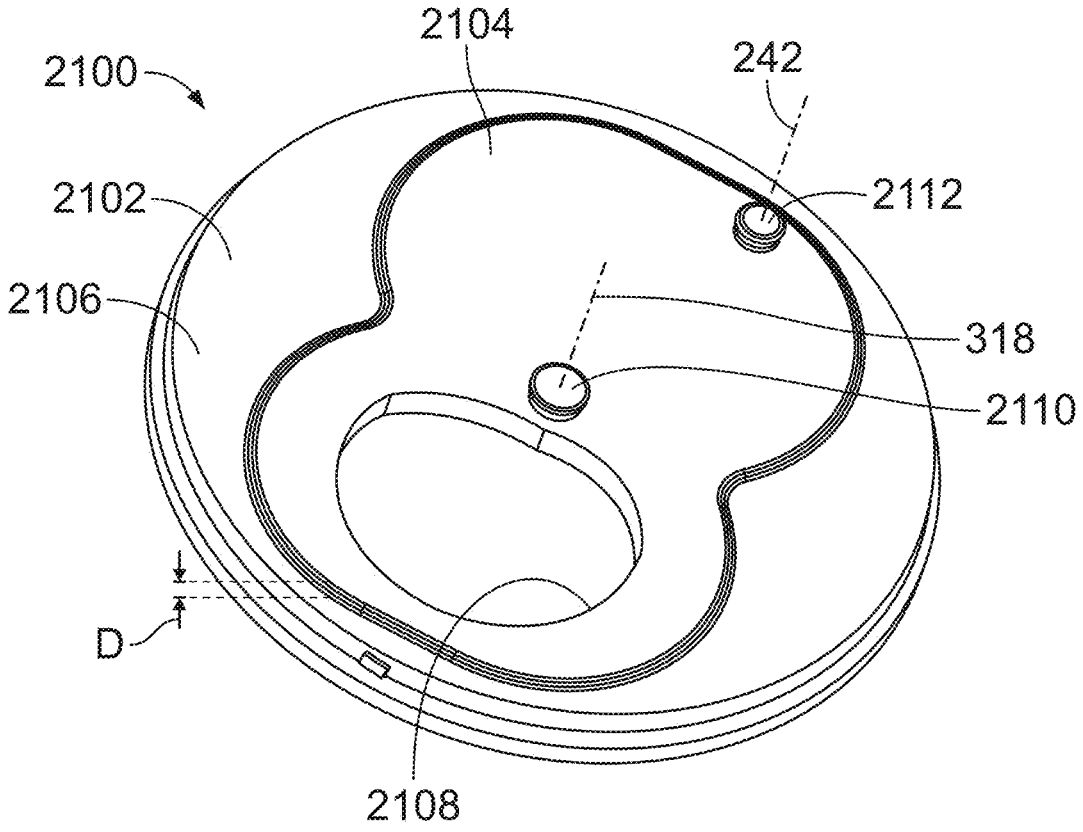
FIG. 21 is a perspective view of another example can end disclosed herein.

FIG. 21 is a perspective view of another example can end 2100 disclosed herein. The can end 2100 can be used with the cover 106, 1106, 1406, 2000 and/or any other cover disclosed herein. The can end 2100 of the illustrated example includes a center panel 2102. Unlike the center panel 208 of FIG. 2A, the center panel 2102 of the illustrated example does not include the deboss panel 226 of FIG. 2A. Instead, the center panel 2102 of the illustrated example includes a stepped surface or platform 2104. The platform 2104 of the illustrated example protrudes relative to a surface 2106 (e.g., an upper or outer surface) of the center panel 2102. In the illustrated example, the platform 2104 protrudes from and/or is elevated relative to the center panel 2102 by a distance D. In some examples, the distance can be between 0.01 inches and 0.0.5 inches. In the illustrated example, a pour panel (e.g., to cover the pour opening 2108), a rivet 2110 and a guide pin 2112 are formed on the platform 2104.

The platform 2104 of the illustrated example includes the pour opening 2108. The illustrated example of FIG. 21 shows the can end 2100 without a pour panel. Although not shown, to provide the pour opening 2108, the platform 2104 of the illustrated example includes a pour panel (e.g., the pour panel 230 of FIG. 2A), a frangible score (e.g., a frangible score 232 of FIG. 2A), a non-frangible hinge (e.g., the non-frangible hinge 234 of FIG. 2A) and a vent area (e.g., the vent area 231 of FIG. 2A). The platform 2104 of the illustrated example reduces a gap or space between a cover (e.g., the cover 106, 1106, 1406, 2000) and the can end 2100 in a direction (e.g., a vertical direction) along a longitudinal axis 316 of the can end 2100. In this manner, the platform 2104 enables a tighter seal between the cover and the can end 2100 (e.g., when the cover is in a closed position).

To secure a tab (e.g., the tab 108 of FIG. 1) to the can end 104, the can end 104 of the illustrated example employs the rivet 2110 (e.g., a central rivet) formed on the platform 2104. The rivet 2110 of the illustrated example is centrally located about the longitudinal axis 316 of the can end 2100. The rivet 2110 of the illustrated example extends or protrudes from the platform 2104 along the longitudinal axis 316 in a direction away from the platform 2104. Thus, the platform 2104 reduces a length (e.g., a vertical length) of the rivet needed to reach a tab positioned on the cover. In other words, the platform 2104, being raised relative to the surface 2106 of the center panel 2102 by a distance D, reduces a distance needed by the rivet 2110 to stake the tab to the can end 2100. The rivet 2110 enables rotation of the tab about a body of the rivet in a rotational direction about the longitudinal axis 316 (e.g., a counterclockwise and/or a clockwise direction about the longitudinal axis 316).

To guide a rotational movement of a cover relative to the can end 2100, the can end 2100 of the illustrated example includes the guide pin 2112 (e.g., a second or offset rivet). The guide pin 2112 protrudes from the platform 2104 along a longitudinal axis 242 in a direction away from the platform 2104. The guide pin 2112 (e.g., the longitudinal axis 242) of the illustrated example is parallel relative to the rivet 2110 (e.g., the longitudinal axis 316). In other words, the longitudinal axis 316 of the rivet 2110 is laterally offset relative to the longitudinal axis 242 of the guide pin 2112. The guide pin 2112 of the illustrated example is fixed to the can end 2100 or platform 2104 (e.g., the guide pin 2112 does not move relative to the platform 2104). The guide pin 2112 of the illustrated example has cylindrical body. However, in some examples, the guide pin 2112 can have a square shape, an arcuate shape and/or any other shape.

Figure 22:
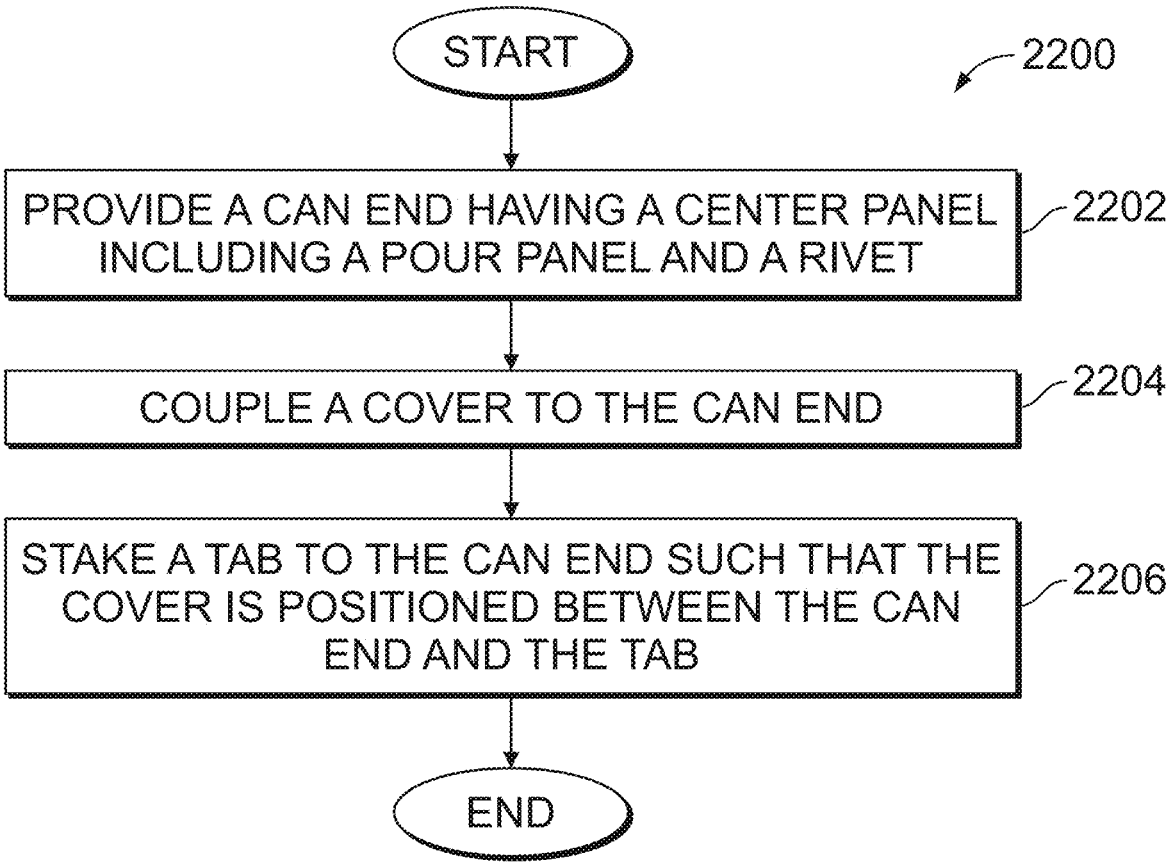
FIG. 22 is an example method of assembling an example can end assembly disclosed herein.

FIG. 22 is an example method 2200 of assembling an example can end assembly disclosed herein. A can end having a center panel including a pour panel and a rivet is provided (block 2022). In some examples, a center panel can be formed with one or more guide pins. For instance, the can end 104 disclosed herein can be formed with the center panel 208 that includes the frangible score 232, the rivet 236, the guide pin 240 and/or a portion of the retainer assembly 512. Example can ends disclosed herein can be formed or manufactured via stamping and/or other manufacturing techniques or processes.

A cover is coupled to the can end (block 2204). For example, the cover is coupled to the center panel of the can end such that the cover rotates within a perimeter defined by a wall of the can end. In some examples, the cover is coupled to the can end by wrapping a peripheral edge of the cover over a curled peripheral edge of the can end after the can end has been attached to a can body. In some examples, the cover is coupled to the can end within a perimeter defined by the can end. For instance, the cover attaches to a panel wall of the can end. In some examples, the covers disclosed herein can be formed with the guide track 320, the grip 338, the access opening 318, and/or a portion of the retainer assembly 512. Example covers disclosed herein can be formed or manufactured via stamping and/or other manufacturing techniques or processes.

Next, a tab is staked to the can end (block 2206). Example tabs disclosed herein can be formed or manufactured via stamping and/or other manufacturing techniques or processes. After formation of the tab, the tab is coupled to the can end. For example, the tab is staked to the can end via the rivet. For example, the cover is positioned between the tab and the can end. In such examples, the rivet passes through an opening formed in the cover. The cover is rotatable between the center panel of the can end and the tab.

In some examples, tab can be staked or clinched to the can end, but the cover is free to rotate. Thus, in some such examples where the tab is clinched to the can end, the cover can rotate (e.g., freely) relative to the can end and/or the tab. In some examples, an example tab can be rotatably coupled to an example can end via the rivet such that the tab can rotate relative to the can end and/or the cover. Alternatively, in some examples, an example tab disclosed herein can be coupled to (e.g., interlocked with or fixed to) an example cover, which the example cover and tab assembly is then staked to an example can end. Thus, in some examples, the tab is coupled to the cover in a first operation, and then the cover and the tab can be coupled to the can end in a second operation. In some examples, the cover is coupled to the can end, and then the tab is coupled to the can end after attachment of the cover to the can end. In some examples, the cover is coupled to the can end in a first operation, and then the tab is staked to the cover in a second operation. In some examples, the tab is coupled to the cover in a first operation, and the tab and the cover is coupled to and/or staked to the can end in a second operation.

The foregoing examples of the can end assemblies (e.g., the can ends and the covers) can be used with aluminum cans. In some examples, the can end assembly 100, 1000, 1100, 1500*a-c*, 1600, 1900, the cover 2000 and/or can end 2100 are made from aluminum, plastic, and/or other materials, and/or a combination thereof. In some examples, the can ends 104, 1104, 1502*b*, 1502*c*, 1604, 1902, 2100 are made from aluminum, plastic, and/or other materials, and/or a combination thereof. In some examples, the covers 106, 1002, 1106, 1504*a-c*, 1606, 1904, and/or 2000 are made from aluminum, plastic, and/or other materials, and/or a combination thereof.

Also, although each example can end, covers and/or can end assemblies other components disclosed above are depicted as having certain features, it should be understood that it is not necessary for a particular feature of one example to be used exclusively with that example. Instead, any of the features described above and/or depicted in the drawings can be combined with any of the examples, in addition to or in substitution for any of the other features of those examples. Features of one example are not mutually exclusive to features of another example. Instead, the scope of this disclosure encompasses any combination of any of the features.

"Including" and "comprising" (and all forms and tenses thereof) are used herein to be open ended terms. Thus, whenever a claim employs any form of "include" or "comprise" (e.g., comprises, includes, comprising, including, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended in the same manner as the term "comprising" and "including" are open ended. The term "and/or" when used, for example, in a form such as A, B, and/or C refers to any combination or subset of A, B, C such as (1) A alone, (2) B alone, (3) C alone, (4) A with B, (5) A with C, (6) B with C, and (7) A with B and with C. As used herein in the context of describing structures, components, items, objects and/or things, the phrase "at least one of A and B" is intended to refer to implementations including any of (1) at least one A, (2) at least one B, and (3) at least one A and at least one B. Similarly, as used herein in the context of describing structures, components, items, objects and/or things, the phrase "at least one of A or B" is intended to refer to implementations including any of (1) at least one A, (2) at least one B, and (3) at least one A and at least one B. As used herein in the context of describing the performance or execution of processes, instructions, actions, activities and/or steps, the phrase "at least one of A and B" is intended to refer to implementations including any of (1) at least one A, (2) at least one B, and (3) at least one A and at least one B. Similarly, as used herein in the context of describing the performance or execution of processes, instructions, actions, activities and/or steps, the phrase "at least one of A or B" is intended to refer to implementations including any of (1) at least one A, (2) at least one B, and (3) at least one A and at least one B.

As used herein, singular references (e.g., "a," "an," "first," "second," etc.) do not exclude a plurality. The term "a" or "an" entity, as used herein, refers to one or more of that entity. The terms "a" (or "an"), "one or more," and "at least one" can be used interchangeably herein. Furthermore, although individually listed, a plurality of means, elements or method actions may be implemented by, e.g., a single unit or processor. Additionally, although individual features may be included in different examples or claims, these may possibly be combined, and the inclusion in different examples or claims does not imply that a combination of features is not feasible and/or advantageous.

From the foregoing, it will be appreciated that example re-closable can ends have been disclosed that protect and preserve contents within an associated container. The example re-closable can ends disclosed herein can be aluminum and/or maintain functionalities through numerous opening and closing cycles to allow consumers to enjoy the contents within the associated container at their own pace. In addition, the example re-closable can ends disclosed herein provide an easy-to-use design to minimize or otherwise reduce difficulties encountered by consumers when opening and/or closing the example re-closable can ends. For instance, the example re-closable can ends disclosed herein include a grip for easy movement of an associated cover. Additionally, the cover of the example re-closable can ends disclosed herein snaps into and/or out of a latched position to indicate the state of the example re-closable can end to the associated consumer. In addition, the example re-closable can ends disclosed herein include tamper evidence features to ensure consumers of the security of the associated container.

Example can ends having re-closable covers are disclosed herein. Further examples and combinations thereof include the following:

Example 1 includes a can end assembly having a can end having center panel defining a pour panel and a first wall extending from the center panel. A cover defines a first opening and rotatably couples to the can end. The cover is rotatable relative to the pour panel between a first position and a second position. The opening of the cover aligns with the pour panel to allow access to the pour panel when the cover is in the first position. The opening of the cover is offset relative to the pour panel such that the opening is misaligned with the pour panel to at least one of restrict or prevent access to the pour panel when the cover is in the second position.

Example 2 includes the can end assembly of example 1, where the cover is rotatably coupled to the center panel of the can end.

Example 3 includes the can end assembly of any one of examples 1-2, where the cover is rotatably coupled to a peripheral edge of the can end.

Example 4 includes the can end assembly of any one of examples 1-3, where the can end includes a rivet, and wherein the cover is rotatably coupled to the can end via the rivet.

Example 5 includes the can end assembly of any one of examples 1-4, further including a tab coupled to the rivet, wherein the cover is positioned between the can end and the tab.

Example 6 includes the can end assembly of any one of examples 1-5, further including a grip extending from an upper surface of the cover.

Example 7 includes a can end assembly having a can end defining a pour panel and a rivet, the can end to attach to a container body, a cover rotatably coupled to the can end, and a tab coupled to the can end via the rivet, the cover positioned between the can end and the tab.

Example 8 includes the can end assembly of example 7, where the can end defines a center panel defining the pour panel.

Example 9 includes the can end assembly of any one of examples 7-8, where the cover includes an opening to rotate relative to the can end to position the opening over the pour panel when the cover is in a first position and position a body of the cover over the pour panel when the cover is in a second position different than the first position.

Example 10 includes the can end assembly of any one of claims 7-9, where the cover is rotatably coupled to the center panel of the can end.

Example 11 includes the can end assembly of any one of examples 7-10, where the can end includes a guide pin protruding from the center panel, and wherein the cover includes a track to receive the guide pin.

Example 12 includes the can end assembly of any one of examples 7-11, where the can end includes a protrusion extending from a panel wall extending from the center panel.

Example 13 includes the can end assembly of any one of examples 7-12, where the cover includes a retainer slot formed in a side wall of the cover to receive the protrusion.

Example 14 includes the can end assembly of any one of examples 7-13, where the slot has at least one of a straight or horizontal shape.

Example 15 includes the can end assembly of any one of examples 7-14, where at least a portion of the slot has a tapered profile.

Example 16 includes the can end assembly of any one of examples 7-15, where the cover includes a hook formed on a side wall of the cover, the hook to receive the protrusion when the cover is in the second position.

Example 17 includes the can end assembly of any one of examples 7-16, where the cover is rotatably coupled to a peripheral edge of the can end.

Example 18 includes the can end assembly of any one of examples 7-17, where a peripheral edge of the cover is curled around the peripheral edge of the can end.

Example 19 includes a can end assembly having means for sealing a container, the means for sealing including means for accessing contents stored in the container; means for rupturing the means for accessing to enable access to the contents; and means for covering the means for accessing after rupturing, the means for covering rotatably coupled to the means for sealing and movable between a first position to cover the means for accessing and a second position to at least one of prevent or restrict access to the means for accessing, the means for covering positioned between the means for sealing and the means for rupturing.

Example 20 includes the can end assembly of example 19, further including means for staking the means for rupturing and the means for sealing.

Example 21 includes a method including forming a can end having a center panel defining a pour panel, coupling a cover to the can end, and staking a tab to the can end, wherein the cover is positioned between the tab and the can end.

Example 22 includes the method of example 21, where coupling the cover to the can end includes coupling the cover to the center panel such that the cover rotates within a perimeter defined by a wall of the can end.

Example 23 includes the method of any one of examples 21-23, where the coupling of the cover to the can end includes wrapping a peripheral edge of the cover over a curled peripheral edge of the can end after the can end has been attached to a can body.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

The following claims are hereby incorporated into this Detailed Description by this reference, with each claim standing on its own as a separate embodiment of the present disclosure.

What is claimed is:

1. A can end assembly comprising:

a can end having a center panel defining a pour panel and a first wall extending from the center panel, the first wall including a retainer extending outwardly from an outer surface of the first wall; and a cover having an upper wall defining a first opening and a side wall extending from the upper wall, the side wall including a retainer slot to receive the retainer, the cover rotatably coupled to the can end, the cover rotatable relative to the pour panel between a first position and a second position, the opening of the cover to align with the pour panel to allow access to the pour panel when the cover is in the first position, the opening of the cover to offset relative to the pour panel such that the opening is misaligned with the pour panel to at least one of restrict or prevent access to the pour panel when the cover is in the second position.

2. The can end assembly of claim 1, wherein the can end includes a rivet, and wherein the cover is rotatably coupled to the can end via the rivet.

3. The can end assembly of claim 2, further including a tab coupled to the rivet, wherein the cover is positioned between the can end and the tab.

4. The can end assembly of claim 2, further including a grip extending from an upper surface of the cover.

5. The can end assembly of claim 1, wherein the retainer is a protrusion that extends outwardly from the outer surface of the first wall in a direction non-parallel relative to a center axis of the can end.

6. The can end assembly of claim 1, wherein the cover includes a guide track to receive a guide pin extending from the center panel.

7. The can end assembly of claim 6, wherein ends of the guide track correlate to respective ends of the guide track such that when the cover is rotated to the first position relative to the can end, the guide pin is positioned in engagement with a first end of the guide track and the retainer is positioned in engagement with a first end of the retainer slot, and when the cover is rotated to the second position relative to the can end, the guide pin is positioned in engagement with a second end of the guide track and the retainer is positioned in engagement with a second end of the retainer slot.

8. The can end assembly of claim 1, wherein at least a portion of the retainer slot has at least one of an arcuate or tapered profile, the retainer and the retainer slot to draw or pull the cover toward the can end in a downward direction when the cover moves to the second position.

9. The can end assembly of claim 1, wherein the retainer and the retainer slot are at an angle relative to the first wall or horizontal, the retainer and the retainer slot to generate a pulling force to cause the cover to move in a direction toward the can end when retainer engages the retainer slot.

10. The can end assembly of claim 1, wherein the first wall of the can end extends downwardly from the center panel of the can end, and the side wall of the cover extends downwardly from the upper wall of the cover.

11. A can end assembly comprising:

a can end defining a pour panel and a rivet, the can end to attach to a container body, the can end including:

a center panel;

a panel wall extending from the center panel; and a protrusion extending from the panel wall;

a cover rotatably coupled to the can end; and a tab coupled to the can end via the rivet, the cover positioned between the can end and the tab.

12. The can end assembly of claim 11, wherein the can end defines a center panel defining the pour panel, wherein the cover includes an opening to rotate relative to the can end to position the opening over the pour panel when the cover is in a first position and position a body of the cover over the pour panel when the cover is in a second position different than the first position.

13. The can end assembly of claim 12, wherein the cover includes an opening to rotate relative to the can end to position the opening over the pour panel when the cover is in a first position and position a body of the cover over the pour panel when the cover is in a second position different than the first position.

14. The can end assembly of claim 13, wherein the opening of the cover is to align with the pour panel to allow access to the pour panel when the cover is in the first position, the opening of the cover to offset relative to the pour panel such that the opening is misaligned with the pour panel to at least one of restrict or prevent access to the pour panel when the cover is in the second position.

15. The can end assembly of claim 12, wherein the cover includes a hook formed on a side wall of the cover, the hook to receive the protrusion when the cover is in the second position.

16. The can end assembly of claim 11, wherein the can end includes a guide pin protruding from the center panel, and wherein the cover includes a track to receive the guide pin.

17. The can end assembly of claim 11, wherein the cover includes a retainer slot formed in a side wall of the cover to receive the protrusion.

18. The can end assembly of claim 17, wherein the retainer slot has at least one of a straight or horizontal shape.

19. The can end assembly of claim 17, wherein at least a portion of the slot has a tapered profile.

20. The can end assembly of claim 11, wherein the cover is rotatably coupled to a peripheral edge of the can end.

21. The can end assembly of claim 11, wherein a peripheral edge of the cover is curled around the peripheral edge of the can end.

22. A can end assembly comprising:

means for sealing a container, the means for sealing including first means for accessing contents stored in the container;

means for rupturing the first means for accessing to enable access to the contents;

means for covering the first means for accessing after rupturing, the means for covering rotatably coupled to the means for sealing and movable between a first position relative to the first means for accessing to enable access to contents of the container and a second position relative to the first means for accessing to cover the first means for accessing to at least one of prevent or restrict access to the contents, the means for covering positioned between the means for sealing and the means for rupturing; and means for retaining including means for receiving and means for engaging, the means for receiving provided with the means for covering and the means for engaging provided with the means for sealing.

23. The can end assembly of claim 22, further including means for staking the means for rupturing and the means for sealing.

24. The can end assembly of claim 22, wherein the means for covering including second means for accessing, the means for covering to rotate to the second position relative to the means for sealing to align the second means for accessing with the first means for accessing to allow access to the contents, the means for covering to rotate to the first position relative to the means for sealing to misalign the second means for accessing relative to the first means for accessing to at least one of restrict or prevent access to the contents.

* * * * *